US009132682B2

(12) United States Patent
Sago et al.

(10) Patent No.: US 9,132,682 B2
(45) Date of Patent: Sep. 15, 2015

(54) TAPE UNIT AND TAPE CASSETTE

(75) Inventors: Akira Sago, Seto (JP); Koshiro Yamaguchi, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 364 days.

(21) Appl. No.: 13/240,266

(22) Filed: Sep. 22, 2011

(65) Prior Publication Data

US 2012/0009001 A1 Jan. 12, 2012

Related U.S. Application Data

(63) Continuation-in-part of application No. PCT/JP2010/050253, filed on Jan. 13, 2010.

(30) Foreign Application Priority Data

Mar. 31, 2009 (JP) ..... 2009-086239

(51) Int. Cl.
*B41J 32/00* (2006.01)

(52) U.S. Cl.
CPC ..... *B41J 32/00* (2013.01)

(58) Field of Classification Search
USPC ..... 400/207, 208
See application file for complete search history.

(56) References Cited

U.S. PATENT DOCUMENTS

| | | | |
|---|---|---|---|
| 3,901,372 | A | 8/1975 | Denley |
| 4,127,883 | A | 11/1978 | Mestdagh |
| 4,226,547 | A | 10/1980 | Bradshaw et al. |
| 4,360,278 | A | 11/1982 | Paque |
| D267,330 | S | 12/1982 | Worrell |
| 4,391,539 | A | 7/1983 | Connoy |
| 4,402,619 | A | 9/1983 | Paque et al. |
| 4,557,617 | A | 12/1985 | Richardson et al. |
| 4,567,488 | A | 1/1986 | Moriguchi et al. |
| 4,678,353 | A | 7/1987 | Richardson et al. |
| 4,725,155 | A | 2/1988 | Kittel et al. |
| 4,773,775 | A | 9/1988 | Bradshaw et al. |
| 4,815,871 | A | 3/1989 | McGourty et al. |
| 4,815,874 | A | 3/1989 | Richardson et al. |
| 4,815,875 | A | 3/1989 | Richardson et al. |
| 4,832,514 | A | 5/1989 | Basile |

(Continued)

FOREIGN PATENT DOCUMENTS

| | | |
|---|---|---|
| CH | 121073 | 2/1994 |
| CH | 136498 | 12/2009 |

(Continued)

OTHER PUBLICATIONS

European Communication of EP 10711477.9 dated Sep. 6, 2012.

(Continued)

*Primary Examiner* — Nguyen Ha
(74) *Attorney, Agent, or Firm* — Banner & Witcoff, Ltd.

(57) ABSTRACT

A tape unit holds a tape roll that has a wound tape that is a print medium, and is adapted to be mounted in and removed from a cassette case. The tape unit is provided with a holder shaft portion and an indicator portion. The holder shaft portion is inserted into a shaft hole formed in a winding center of the tape roll and rotatably supports the tape roll. The indicator portion is disposed radially outside the tape roll which is supported by the holder shaft portion, and includes at least one hole portion and indicates a type of the tape.

19 Claims, 28 Drawing Sheets

(56) References Cited

U.S. PATENT DOCUMENTS 4,844,636 A 7/1989 Paque
4,880,325 A 11/1989 Ueda et al.
4,892,425 A 1/1990 Shimizu et al.
D307,296 S 4/1990 Ivarson et al.
4,915,516 A 4/1990 Shimizu et al.
4,917,514 A 4/1990 Richardson et al.
D307,918 S 5/1990 Goda
4,927,278 A 5/1990 Kuzuya et al.
4,930,913 A 6/1990 Basile
D311,416 S 10/1990 Richardson et al.
4,983,058 A 1/1991 Nagae
5,022,771 A 6/1991 Paque
D319,070 S 8/1991 Lavander
D320,391 S 10/1991 Paque
5,056,940 A 10/1991 Basile
5,078,523 A 1/1992 McGourty et al.
5,104,247 A 4/1992 Ohshima
5,111,216 A 5/1992 Richardson et al.
5,188,469 A 2/1993 Nagao et al.
5,193,919 A 3/1993 Godo et al.
5,195,835 A 3/1993 Collins
5,203,951 A 4/1993 Hattori et al.
5,223,939 A 6/1993 Imaizumi et al.
5,239,437 A 8/1993 Hoge et al.
D342,275 S 12/1993 Cooper
RE34,521 E 1/1994 Shimizu et al.
5,277,503 A 1/1994 Nagao
5,318,370 A 6/1994 Nehowig
5,348,406 A 9/1994 Yoshiaki et al.
5,350,243 A 9/1994 Ichinomiya et al.
D352,305 S 11/1994 Cooper
5,374,132 A 12/1994 Kimura
D356,333 S 3/1995 Pearce et al.
5,395,173 A 3/1995 Ueno et al.
5,399,033 A 3/1995 Putman
D357,497 S 4/1995 Gray et al.
5,411,339 A 5/1995 Bahrabadi et al.
5,419,648 A 5/1995 Nagao et al.
D359,303 S 6/1995 Gray et al.
5,424,757 A 6/1995 Thom
5,429,443 A 7/1995 Kobayashi et al.
5,431,504 A 7/1995 Beadman et al.
5,435,657 A 7/1995 Pearce et al.
5,466,076 A 11/1995 Kobayashi et al.
5,492,282 A 2/1996 Okuchi et al.
5,492,420 A 2/1996 Nunokawa et al.
5,494,362 A 2/1996 Kobayashi et al.
5,506,736 A 4/1996 Ota
5,511,891 A 4/1996 Nehowig et al.
5,518,328 A 5/1996 Okuchi et al.
D372,044 S 7/1996 Ware et al.
5,533,818 A 7/1996 Bahrabadi
5,536,092 A 7/1996 Yamaguchi
5,538,352 A 7/1996 Sugiura
5,540,510 A 7/1996 Sims et al.
5,541,796 A 7/1996 Sawada
5,553,952 A 9/1996 Umbach
5,564,843 A 10/1996 Kawaguchi
5,593,237 A 1/1997 Nozaki et al.
5,595,447 A 1/1997 Takayama et al.
5,599,119 A 2/1997 Nunokawa et al.
5,605,404 A 2/1997 Nunokawa et al.
5,620,268 A 4/1997 Yamaguchi et al.
5,634,728 A 6/1997 Nunokawa et al.
5,653,542 A 8/1997 Sugimoto et al.
5,658,083 A 8/1997 Day et al.
5,659,441 A 8/1997 Eckberg et al.
5,709,486 A 1/1998 Day
5,727,888 A 3/1998 Sugimoto et al.
5,730,536 A 3/1998 Yamaguchi
5,752,777 A 5/1998 Nunokawa et al.
5,765,954 A 6/1998 Nunokawa et al.
5,771,803 A 6/1998 Takami
5,813,773 A 9/1998 Kawai
5,813,779 A 9/1998 Palmer et al.
5,823,689 A 10/1998 Nehowig et al.
5,825,724 A 10/1998 Matsumoto et al.
5,826,995 A 10/1998 Day et al.
5,857,788 A 1/1999 Gutsell et al.
5,887,993 A 3/1999 Nunokawa et al.
5,961,225 A 10/1999 Nunokawa et al.
5,964,539 A 10/1999 Yamaguchi et al.
5,967,678 A 10/1999 Nunokawa et al.
5,997,194 A 12/1999 Nunokawa et al.
6,012,860 A 1/2000 Nunokawa et al.
6,042,280 A 3/2000 Yamaguchi et al.
6,048,118 A 4/2000 Martinez et al.
6,050,672 A 4/2000 Matsuhashi
6,059,469 A 5/2000 Hirumi
6,106,171 A 8/2000 Nunokawa et al.
6,116,796 A 9/2000 Yamaguchi et al.
6,132,120 A 10/2000 Yamaguchi et al.
6,149,325 A 11/2000 Nunokawa et al.
6,160,679 A 12/2000 Maekawa et al.
6,168,328 B1 1/2001 Ueda et al.
6,190,065 B1 2/2001 Brzuskiewicz
6,190,069 B1 2/2001 Yamaguchi et al.
6,196,740 B1 3/2001 Yamaguchi et al.
6,227,477 B1 5/2001 Komatsuzaki et al.
6,232,993 B1 5/2001 Kobayashi et al.
6,317,156 B1 11/2001 Nagasaki et al.
6,334,724 B2 1/2002 Yamaguchi et al.
6,406,202 B1 6/2002 Unno et al.
6,435,744 B1 8/2002 Dunn et al.
6,476,838 B1 11/2002 Italiano
6,485,206 B1 11/2002 Takahashi
6,520,696 B2 2/2003 Huss et al.
6,644,876 B2 11/2003 Carriere et al.
D486,853 S 2/2004 Wilken et al.
6,709,179 B2 3/2004 Yamaguchi et al.
6,910,819 B2 6/2005 Carriero et al.
6,929,415 B2 8/2005 Wilken
6,955,318 B2 10/2005 Nonomura et al.
D519,522 S 4/2006 Lee
7,070,347 B2 7/2006 Carriere et al.
7,070,348 B2 7/2006 Sugimoto et al.
7,097,372 B1 8/2006 Heyse et al.
7,121,751 B2 10/2006 Harada et al.
7,128,483 B2 10/2006 Harada et al.
D534,203 S 12/2006 Harada et al.
7,201,522 B2 4/2007 Bandholz et al.
D542,334 S 5/2007 Harada et al.
7,232,268 B2 6/2007 Sugimoto et al.
7,287,715 B2 10/2007 Ban
7,296,941 B2 11/2007 Suzuki et al.
7,357,585 B2 4/2008 Kurashina
7,404,684 B2 7/2008 Sugimoto et al.
D579,942 S 11/2008 Terry et al.
7,503,714 B2 3/2009 Yamamoto et al.
7,841,790 B2 11/2010 Yamaguchi et al.
7,942,594 B2 5/2011 Kumazaki et al.
7,965,308 B2 6/2011 Jauert et al.
8,045,288 B2 10/2011 Ota et al.
8,109,684 B2 2/2012 Yamaguchi
8,162,553 B2 4/2012 Vandermeulen
8,164,609 B2 4/2012 Liu et al.
8,382,389 B2 2/2013 Yamaguchi et al.
D681,727 S 5/2013 Van Den Broecke
8,540,444 B2 9/2013 Vandermeulen et al.
8,562,228 B2 10/2013 Yamaguchi et al.
8,641,304 B2 2/2014 Yamaguchi et al.
8,734,035 B2 5/2014 Suva et al.
8,740,482 B2 6/2014 Yamaguchi et al.
8,757,907 B2 6/2014 Yamaguchi et al.
8,764,326 B2 7/2014 Yamaguchi et al.
8,770,877 B2 7/2014 Yamaguchi et al.
2002/0006303 A1 1/2002 Yamaguchi et al.
2002/0012558 A1 1/2002 Huss et al.
2002/0047063 A1 4/2002 Kaneda et al.
2003/0081978 A1 5/2003 Carriere et al.
2004/0056143 A1* 3/2004 Nonomura ..... 242/596.8
2004/0062586 A1 4/2004 Harada et al.
2004/0233269 A1 11/2004 Tsubota
2004/0265027 A1 12/2004 Hine et al.

(56) References Cited

U.S. PATENT DOCUMENTS

| | | | |
|---|---|---|---|
| 2005/0036816 | A1 | 2/2005 | Carriere et al. |
| 2005/0152732 | A1 | 7/2005 | Bandholz et al. |
| 2005/0172981 | A1 | 8/2005 | Byun |
| 2006/0088802 | A1 | 4/2006 | Akaiwa |
| 2006/0193669 | A1 | 8/2006 | Takada et al. |
| 2006/0204304 | A1 | 9/2006 | Hioki et al. |
| 2006/0233582 | A1 | 10/2006 | Horiuchi |
| 2006/0239743 | A1 | 10/2006 | Naito |
| 2007/0009302 | A1 | 1/2007 | Vandermeulen |
| 2007/0009306 | A1 | 1/2007 | Harada et al. |
| 2007/0031171 | A1 | 2/2007 | Heyse et al. |
| 2007/0041772 | A1 | 2/2007 | Harada et al. |
| 2007/0070168 | A1 | 3/2007 | Mindler et al. |
| 2007/0098473 | A1 | 5/2007 | Heyse et al. |
| 2007/0172293 | A1 | 7/2007 | Vandermeulen |
| 2007/0237562 | A1 | 10/2007 | Kato et al. |
| 2007/0264070 | A1 | 11/2007 | Loo et al. |
| 2008/0050160 | A1 | 2/2008 | Yamaguchi et al. |
| 2008/0080922 | A1 | 4/2008 | Vandermeulen |
| 2008/0181703 | A1 | 7/2008 | Ito et al. |
| 2008/0181708 | A1 | 7/2008 | Yamaguchi et al. |
| 2008/0226373 | A1 | 9/2008 | Yamaguchi et al. |
| 2008/0232886 | A1 | 9/2008 | Kato et al. |
| 2008/0310904 | A1 | 12/2008 | Yamaguchi et al. |
| 2009/0016795 | A1 | 1/2009 | Caveney et al. |
| 2009/0190988 | A1 | 7/2009 | Vereecken et al. |
| 2009/0202283 | A1 | 8/2009 | Kumazaki et al. |
| 2009/0285617 | A1 | 11/2009 | Vandermeulen |
| 2010/0119281 | A1 | 5/2010 | Ford et al. |
| 2010/0232862 | A1 | 9/2010 | Vandermeulen |
| 2010/0247209 | A1 | 9/2010 | Yamaguchi et al. |
| 2010/0247210 | A1 | 9/2010 | Yamaguchi et al. |
| 2010/0272492 | A1 | 10/2010 | Van Britsom et al. |
| 2011/0058884 | A1 | 3/2011 | Kato et al. |
| 2012/0008999 | A1 | 1/2012 | Yamaguchi et al. |
| 2012/0027485 | A1 | 2/2012 | Suva et al. |
| 2012/0027486 | A1 | 2/2012 | Suva et al. |
| 2012/0027487 | A1 | 2/2012 | Suva et al. |
| 2012/0057917 | A1 | 3/2012 | Van Britsom et al. |
| 2012/0080550 | A1 | 4/2012 | Yamaguchi et al. |
| 2012/0170959 | A1 | 7/2012 | Vandermeulen et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0218458 | A1 | 8/2014 | Suva et al. |

FOREIGN PATENT DOCUMENTS

| | | | |
|---|---|---|---|
| CN | 1148547 | A | 4/1997 |
| CN | 1148548 | | 4/1997 |
| CN | 1469811 | | 1/2001 |
| CN | 1289293 | | 3/2001 |
| CN | 1085151 | C | 5/2002 |
| CN | 1376115 | | 10/2002 |
| CN | 1397431 | | 2/2003 |
| CN | 1415482 | A | 5/2003 |
| CN | 1415484 | | 5/2003 |
| CN | 1493462 | | 5/2004 |
| CN | 1636755 | | 7/2005 |
| CN | 1642746 | | 7/2005 |
| CN | 1762720 | | 4/2006 |
| CN | 1827386 | | 9/2006 |
| CN | 1835867 | | 9/2006 |
| CN | 1990261 | A | 7/2007 |
| CN | 101039807 | A | 9/2007 |
| CN | 101060985 | | 10/2007 |
| CN | 101128324 | | 2/2008 |
| CN | 101229724 | | 7/2008 |
| CN | 101264071 | A | 9/2008 |
| CN | 101264701 | A | 9/2008 |
| CN | 101264702 | A | 9/2008 |
| CN | 101310989 | | 11/2008 |
| CN | 101327696 | | 12/2008 |
| CN | 102616025 | | 8/2012 |
| EP | 119179 | A1 | 9/1984 |
| EP | 0329369 | | 8/1989 |
| EP | 0329369 | A2 | 8/1989 |
| EP | 0511602 | | 11/1992 |
| EP | 0511602 | A1 | 11/1992 |
| EP | 0555954 | A2 | 8/1993 |
| EP | 0629509 | A2 | 12/1994 |
| EP | 0635375 | | 1/1995 |
| EP | 0644506 | | 3/1995 |
| EP | 0684143 | | 11/1995 |
| EP | 0684143 | A2 | 11/1995 |
| EP | 734878 | | 10/1996 |
| EP | 734878 | A2 | 10/1996 |
| EP | 0760291 | | 3/1997 |
| EP | 0629509 | | 12/1997 |
| EP | 0644506 | | 4/1999 |
| EP | 0644506 | B1 | 4/1999 |
| EP | 1199179 | | 4/2002 |
| EP | 1284196 | | 2/2003 |
| EP | 1284196 | A2 | 2/2003 |
| EP | 1502758 | | 2/2005 |
| EP | 1516739 | | 3/2005 |
| EP | 1516739 | A1 | 3/2005 |
| EP | 1552949 | | 7/2005 |
| EP | 1700705 | | 9/2006 |
| EP | 1700705 | A1 | 9/2006 |
| EP | 1707395 | | 10/2006 |
| EP | 1707395 | A1 | 10/2006 |
| EP | 2236304 | | 10/2010 |
| EP | 2236304 | A1 | 10/2010 |
| JP | S56-20944 | U | 2/1981 |
| JP | 58-139415 | | 9/1983 |
| JP | S58-139415 | U | 9/1983 |
| JP | 58220783 | | 12/1983 |
| JP | 5978879 | | 5/1984 |
| JP | 60-99692 | | 6/1985 |
| JP | S60-99692 | U | 7/1985 |
| JP | S61-179776 | | 8/1986 |
| JP | 62-173944 | | 11/1987 |
| JP | S63-81063 | U | 5/1988 |
| JP | 63-166557 | A | 7/1988 |
| JP | 63-203348 | A | 8/1988 |
| JP | 63-254085 | A | 10/1988 |
| JP | H01-195088 | A | 8/1989 |
| JP | H02-56664 | | 4/1990 |
| JP | H02-56665 | | 4/1990 |
| JP | H02-56666 | U | 4/1990 |
| JP | H02-147272 | | 6/1990 |
| JP | 3-093584 | A | 4/1991 |
| JP | 3-120680 | | 5/1991 |
| JP | 03-151261 | | 6/1991 |
| JP | 03151261 | | 6/1991 |
| JP | 3063155 | | 9/1991 |
| JP | 3-118672 | | 12/1991 |
| JP | H03-118672 | U | 12/1991 |
| JP | H03-120680 | U | 12/1991 |
| JP | 04-016113 | | 2/1992 |
| JP | 4-37575 | | 2/1992 |
| JP | H04-37575 | A | 2/1992 |
| JP | 4-133756 | | 5/1992 |
| JP | H04-133756 | A | 5/1992 |
| JP | 5-16342 | | 3/1993 |
| JP | 5-63067 | | 3/1993 |
| JP | H05-16342 | U | 3/1993 |
| JP | H05-18853 | | 3/1993 |
| JP | H05-63067 | A | 3/1993 |
| JP | 05104840 | | 4/1993 |
| JP | 5-155067 | | 6/1993 |
| JP | H05-155067 | A | 6/1993 |
| JP | 5-54225 | | 7/1993 |
| JP | H05-54225 | U | 7/1993 |
| JP | 5-78565 | | 10/1993 |
| JP | H05-78565 | U | 10/1993 |
| JP | 5-80765 | U | 11/1993 |
| JP | 5-294051 | | 11/1993 |
| JP | H05-294051 | A | 11/1993 |
| JP | H05-301435 | | 11/1993 |
| JP | 6-12053 | | 2/1994 |
| JP | H06-12053 | U | 2/1994 |

(56) References Cited

FOREIGN PATENT DOCUMENTS

| | | | |
|---|---|---|---|
| JP | 6-21953 | U | 3/1994 |
| JP | 07-068814 | | 3/1994 |
| JP | 6-122239 | | 5/1994 |
| JP | 6-122249 | | 5/1994 |
| JP | 6-124406 | | 5/1994 |
| JP | 6-127094 | | 5/1994 |
| JP | 6-152907 | A | 5/1994 |
| JP | H06-124406 | A | 5/1994 |
| JP | 6-53560 | U | 7/1994 |
| JP | 6-183117 | | 7/1994 |
| JP | 6-191081 | A | 7/1994 |
| JP | H06183117 | A | 7/1994 |
| JP | 6-210889 | A | 8/1994 |
| JP | 674348 | | 10/1994 |
| JP | H06-74348 | U | 10/1994 |
| JP | 6-328800 | | 11/1994 |
| JP | H06-328800 | A | 11/1994 |
| JP | 7-1782 | | 1/1995 |
| JP | 7-1805 | | 1/1995 |
| JP | 7-9743 | | 1/1995 |
| JP | 7-25123 | | 1/1995 |
| JP | H07-1805 | A | 1/1995 |
| JP | H07-9743 | A | 1/1995 |
| JP | H07-25122 | | 1/1995 |
| JP | H07-25123 | A | 1/1995 |
| JP | 7-47737 | | 2/1995 |
| JP | H07-47737 | A | 2/1995 |
| JP | 7-61009 | | 3/1995 |
| JP | 7-69497 | | 3/1995 |
| JP | 7020725 | | 3/1995 |
| JP | H07-61009 | A | 3/1995 |
| JP | H07-68877 | | 3/1995 |
| JP | H07-69497 | A | 3/1995 |
| JP | 7-89196 | | 4/1995 |
| JP | 7-101133 | | 4/1995 |
| JP | 7-108702 | A | 4/1995 |
| JP | 7089115 | | 4/1995 |
| JP | H07-89115 | A | 4/1995 |
| JP | H07-89196 | A | 4/1995 |
| JP | H07-101133 | A | 4/1995 |
| JP | H07-108730 | | 4/1995 |
| JP | 7137327 | | 5/1995 |
| JP | H07-137327 | A | 5/1995 |
| JP | 7-40456 | | 7/1995 |
| JP | H07-40456 | U | 7/1995 |
| JP | H07-214876 | | 8/1995 |
| JP | 7-237314 | A | 9/1995 |
| JP | 7-251539 | | 10/1995 |
| JP | 7-276695 | A | 10/1995 |
| JP | 7276695 | | 10/1995 |
| JP | H07-251539 | A | 10/1995 |
| JP | H07-276695 | A | 10/1995 |
| JP | 7-290803 | | 11/1995 |
| JP | H07-290803 | A | 11/1995 |
| JP | 7-314864 | | 12/1995 |
| JP | 7-314866 | | 12/1995 |
| JP | 07314862 | | 12/1995 |
| JP | 7314865 | | 12/1995 |
| JP | H07-314864 | A | 12/1995 |
| JP | H07-314865 | A | 12/1995 |
| JP | H07-314866 | A | 12/1995 |
| JP | 8-25768 | | 1/1996 |
| JP | H08-25768 | A | 1/1996 |
| JP | 8-39909 | | 2/1996 |
| JP | H08-39909 | A | 2/1996 |
| JP | 8-58211 | A | 3/1996 |
| JP | 8-118738 | | 5/1996 |
| JP | H08-118738 | A | 5/1996 |
| JP | H08-165035 | | 6/1996 |
| JP | 08216461 | | 8/1996 |
| JP | 8-252964 | A | 10/1996 |
| JP | 8-267839 | A | 10/1996 |
| JP | 8-290618 | | 11/1996 |
| JP | H08-290618 | A | 11/1996 |
| JP | 09-039347 | | 2/1997 |
| JP | 2596263 | | 4/1997 |
| JP | H09-109533 | | 4/1997 |
| JP | 9-123579 | | 5/1997 |
| JP | 9-134557 | | 5/1997 |
| JP | H09-134557 | A | 5/1997 |
| JP | 9-141986 | A | 6/1997 |
| JP | 09-141997 | | 6/1997 |
| JP | 9-188049 | | 7/1997 |
| JP | 9-188050 | | 7/1997 |
| JP | H09-188049 | A | 7/1997 |
| JP | H09-188050 | A | 7/1997 |
| JP | 09240158 | | 9/1997 |
| JP | 10-056604 | A | 2/1998 |
| JP | 10-181063 | A | 7/1998 |
| JP | H1-146945 | A | 2/1999 |
| JP | 11-78188 | | 3/1999 |
| JP | H11-78188 | A | 3/1999 |
| JP | H11-78189 | | 3/1999 |
| JP | 11-91144 | | 4/1999 |
| JP | 11-105351 | | 4/1999 |
| JP | H11-105351 | A | 4/1999 |
| JP | 11-129563 | | 5/1999 |
| JP | H11-129563 | A | 5/1999 |
| JP | 11-263055 | | 9/1999 |
| JP | H11-263055 | A | 9/1999 |
| JP | H11-263056 | A | 9/1999 |
| JP | 2000-25251 | | 1/2000 |
| JP | 2998617 | | 1/2000 |
| JP | 2000025251 | A | 1/2000 |
| JP | 2000-43336 | | 2/2000 |
| JP | 2000-043337 | A | 2/2000 |
| JP | 2000043336 | A | 2/2000 |
| JP | 2000-076372 | | 3/2000 |
| JP | 2000-85224 | | 3/2000 |
| JP | 2000085224 | A | 3/2000 |
| JP | 2000-103129 | | 4/2000 |
| JP | 2000-103131 | | 4/2000 |
| JP | 3031439 | | 4/2000 |
| JP | 2000103129 | A | 4/2000 |
| JP | 2000103131 | A | 4/2000 |
| JP | 2000-135843 | | 5/2000 |
| JP | 2000135843 | A | 5/2000 |
| JP | 2000-198258 | | 7/2000 |
| JP | 2000198258 | A | 7/2000 |
| JP | 2000-211193 | | 8/2000 |
| JP | 2000-229750 | | 8/2000 |
| JP | 2001-11594 | | 1/2001 |
| JP | 2001011594 | A | 1/2001 |
| JP | 2001-48389 | | 2/2001 |
| JP | 2001048389 | A | 2/2001 |
| JP | 2001-088359 | | 4/2001 |
| JP | 2001-121797 | A | 5/2001 |
| JP | 2001-310540 | | 11/2001 |
| JP | 2001-319447 | | 11/2001 |
| JP | 2001310540 | A | 11/2001 |
| JP | 2001319447 | A | 11/2001 |
| JP | 2002-42441 | | 2/2002 |
| JP | 2002042441 | A | 2/2002 |
| JP | 3266739 | B2 | 3/2002 |
| JP | 2002-103762 | | 4/2002 |
| JP | 2002-104568 | | 4/2002 |
| JP | 2002104568 | A | 4/2002 |
| JP | 2002-166606 | | 6/2002 |
| JP | 2002-167084 | | 6/2002 |
| JP | 2002-179300 | | 6/2002 |
| JP | 2002166605 | | 6/2002 |
| JP | 2002179300 | A | 6/2002 |
| JP | 2002-308481 | | 10/2002 |
| JP | 2002-308518 | | 10/2002 |
| JP | 2002-308518 | A | 10/2002 |
| JP | 2002192769 | | 10/2002 |
| JP | 2002308481 | A | 10/2002 |
| JP | 2002-367333 | | 12/2002 |
| JP | 3357128 | | 12/2002 |
| JP | 2002367333 | A | 12/2002 |
| JP | 2003-011454 | | 1/2003 |
| JP | 2003-026164 | | 1/2003 |
| JP | 2003-048337 | A | 2/2003 |
| JP | 2003-506235 | | 2/2003 |

(56) References Cited

FOREIGN PATENT DOCUMENTS

| | | | |
|---|---|---|---|
| JP | 3378622 | | 2/2003 |
| JP | 2003-072127 | | 3/2003 |
| JP | 3426983 | | 7/2003 |
| JP | 2003-251902 | | 9/2003 |
| JP | 2003-251904 | | 9/2003 |
| JP | 2003251902 | A | 9/2003 |
| JP | 2003-285522 | | 10/2003 |
| JP | 2003285522 | A | 10/2003 |
| JP | 2004-018077 | | 1/2004 |
| JP | 3543659 | | 7/2004 |
| JP | 3543659 | B2 | 7/2004 |
| JP | 2004-255656 | | 9/2004 |
| JP | 3564848 | B2 | 9/2004 |
| JP | 3567469 | | 9/2004 |
| JP | 2004-291591 | | 10/2004 |
| JP | 2004291591 | A | 10/2004 |
| JP | 2004-323241 | | 11/2004 |
| JP | 2004323241 | A | 11/2004 |
| JP | 3106187 | | 12/2004 |
| JP | 2005-059504 | | 3/2005 |
| JP | 2005-088597 | A | 4/2005 |
| JP | 2005-178206 | | 7/2005 |
| JP | 2006-182034 | | 7/2005 |
| JP | 2005-231203 | | 9/2005 |
| JP | 2005231203 | A | 9/2005 |
| JP | 2005-280008 | | 10/2005 |
| JP | 2005-298031 | | 10/2005 |
| JP | 2005280008 | A | 10/2005 |
| JP | 2005297348 | | 10/2005 |
| JP | 4061507 | | 11/2005 |
| JP | 2006-021432 | | 1/2006 |
| JP | 2006096030 | | 4/2006 |
| JP | 2006-168974 | A | 6/2006 |
| JP | 2006142835 | A | 6/2006 |
| JP | 2006182034 | A | 7/2006 |
| JP | 2006-240310 | A | 9/2006 |
| JP | 2006-248059 | | 9/2006 |
| JP | 2006248059 | A | 9/2006 |
| JP | 2006-264337 | | 10/2006 |
| JP | 2006-272895 | | 10/2006 |
| JP | 2006-272895 | A | 10/2006 |
| JP | 2006-272977 | | 10/2006 |
| JP | 2006-289991 | | 10/2006 |
| JP | 2006272895 | A | 10/2006 |
| JP | 2006272977 | A | 10/2006 |
| JP | 2006289991 | A | 10/2006 |
| JP | 2007-111863 | | 5/2007 |
| JP | 2007-196654 | A | 8/2007 |
| JP | 2007-268815 | | 10/2007 |
| JP | 2007-296863 | | 11/2007 |
| JP | 4003068 | | 11/2007 |
| JP | 4003068 | B2 | 11/2007 |
| JP | 2007296863 | A | 11/2007 |
| JP | 2008044180 | | 2/2008 |
| JP | 2008-80668 | | 4/2008 |
| JP | 2008-509823 | A | 4/2008 |
| JP | 2008080668 | A | 4/2008 |
| JP | 2008083432 | | 4/2008 |
| JP | 2008094103 | | 4/2008 |
| JP | 2006-142835 | | 6/2008 |
| JP | 2008-229855 | A | 10/2008 |
| JP | 2008-254384 | | 10/2008 |
| JP | 2008-279678 | | 11/2008 |
| JP | 2008265278 | | 11/2008 |
| JP | 2008-307703 | | 12/2008 |
| JP | 2009001020 | | 1/2009 |
| JP | 2009-28976 | | 2/2009 |
| JP | 2009028976 | A | 2/2009 |
| JP | 2009-509812 | A | 3/2009 |
| JP | 2009-184832 | A | 8/2009 |
| JP | 2009-214431 | | 9/2009 |
| JP | 2011-110843 | A | 6/2011 |
| JP | 2011-110845 | A | 6/2011 |
| JP | 2011-110848 | A | 6/2011 |
| WO | 00/32401 | | 6/2000 |
| WO | 0032401 | A1 | 6/2000 |
| WO | 0110649 | | 2/2001 |
| WO | 0232680 | | 4/2002 |
| WO | 03/080350 | | 10/2003 |
| WO | 03080350 | A1 | 10/2003 |
| WO | 2006/033431 | | 2/2006 |
| WO | 2006013466 | | 2/2006 |
| WO | 2006/024913 | | 3/2006 |
| WO | 2006024913 | A2 | 3/2006 |
| WO | 2006/090842 | | 8/2006 |
| WO | 2006090842 | A1 | 8/2006 |
| WO | 2009/107534 | A1 | 9/2009 |
| WO | 2010/113782 | | 10/2010 |

OTHER PUBLICATIONS

NZ Examination Report of NZ 596044 dated Sep. 28, 2012.

Japanese Office Action issued in Japanese Application No. 2011-506968 on Jan. 29, 2013.

Japanese Office Action issued in Japanese Application No. 2009-156398 on Apr. 2, 2013.

Japanese Office Action issued in Japanese Application No. 2009-156403 on Apr. 2, 2013.

Japanese Office Action issued in Japanese Application No. 2009-156281 on Apr. 2, 2013.

Japanese Office Action issued in Japanese Application No. 2009-156355 on Apr. 2, 2013.

Japanese Office Action issued in Japanese Application No. 2009-156399 on Apr. 2, 2013.

Japanese Office Action issued in Japanese Application No. 2009-156404 on Apr. 2, 2013.

Japanese Office Action issued in Japanese Application No. 2009-156350 on Apr. 2, 2013.

Japanese Office Action issued in Japanese Application No. 2009-156357 on Apr. 2, 2013.

Japanese Office Action issued in Japanese Application No. 2009-156371 on Apr. 2, 2013.

Japanese Office Action issued in Japanese Application No. 2009-270325 on Apr. 2, 2013.

Chinese Office Action issued in Chinese Application No. 200980158165.9 on Mar. 8, 2013.

European Search Report issued in Application No. 09852278.2 on Apr. 8, 2013.

Japanese Office Action in JP 2009-086239 on May 8, 2012.

Japanese Office Action in JP 2009-086222 on Jun. 12, 2012.

International Preliminary Report on Patentability in PCT/JP2010/055310 on Apr. 11, 2012.

Japanese Office Action issued in Japanese Application 2010-73748 on Apr. 23, 2013.

Japanese Office Action issued in Japanese Application 2010-73750 on Apr. 23, 2013.

Chinese Office Action issued in Chinese Application No. 200910262680.3 on May 2, 2013.

Chinese Office Action issued in Chinese Application 200910262679.0 on May 2, 2013.

Chinese Office Action issued in Chinese Application 200910262677.1 on May 2, 2013.

Japanese Office Action issued in Japanese Application 2010-073747 on May 14, 2013.

Japanese Office Action issued in Japanese Application 2010-073749 on May 21, 2013.

Japanese Office Action issued in Japanese Application 2010-073751 on May 28, 2013.

Japanese Office Action issued in Japanese Application 2010-073754 on Jun. 4, 2013.

Japanese Office Action issued in Japanese Application 2010-073755 on May 21, 2013.

Japanese Office Action issued in Japanese Application 2009-156350 on Jul. 2, 2013.

Japanese Office Action issued in Japanese Application 2009-156281 on Jul. 2, 2013.

Chinese Office Action issued in Chinese Application 2009-80161443.6 on Jun. 4, 2013.

(56) References Cited

OTHER PUBLICATIONS

New Zealand Office Action issued in New Zealand Application 596044 on Jul. 10, 2013.
Chinese Office Action issued in Chinese Application No. 200910262676.7 on Apr. 26, 2013.
Chinese Office Action issued in Chinese Application No. 200910262678.6 on Apr. 19, 2013.
Chinese Office Action issued in Chinese Application No. 201080013099.9 on Apr. 15, 2013.
Japanese Office Action issued in Japanese Application No. 2009-154699 on May 21, 2013.
Japanese Office Action issued in Japanese Application No. 2009-154698 on May 21, 2013.
Japanese Office Action of JP 2010-084500 dated Jul. 13, 2012.
Japanese Office Action of JP 2010-084501 dated Jul. 3, 2012.
Japanese Office Action of JP 2010-084502 dated Jul. 3, 2012.
Japanese Office Action of JP 2009-270056 dated Nov. 13, 2012.
Japanese Office Action of JP 2009-297502 dated Nov. 13, 2012.
Notification of reasons for rejection issued in the related Japanese Application No. 2009-088241, Nov. 15, 2011, JPO, Japan.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
International Preliminary Report on Patentability in PCT/JP2009/071568 on Nov. 15, 2011.
International Preliminary Report on Patentability in PCT/JP2010/055324 on Nov. 15, 2011q.
International Preliminary Report on Patentability in PCT/JP2010/055326 on Nov. 15, 2011.
International Preliminary Report on Patentability in PCT/JP2010/050253 on Nov. 15, 2011.
Japanese Office Action issue in Application No. 2011-507142 on Nov. 26, 2013.
European Office Action issued in Application No. 10711776.4 on Nov. 22, 2013.
New Zealand Office Action issue in Application No. 596044 on Nov. 8, 2013.
Japanese Office Action issue in Application No. 2011-507049 on Dec. 3, 2013.
Chinese Office Action issue in Application No. 200980161405.0 on Nov. 1, 2013.
U.S. Office Action issue in U.S. Appl. No. 13/934,512 on Nov. 19, 2013.
Chinese Office Action issued in Chinese Application No. 200910262675.2 on Aug. 7, 2013.
Chinese Office Action issued in Chinese Application No. 201080013339.5 on Aug. 22, 2013.
Japanese Office Action issued in Japanese Application No. 2011507143 on Sep. 3, 2013.
Japanese Office Action issued in Japanese Application No. 2011547222 on Oct. 1, 2013.
Extended European Search Report issued in Application No. 09842716.4 on Nov. 6, 2013.
Chinese Office Action issued in Application No. 201010150088.7 on Sep. 30, 2013.
Chinese Office Action issued in Application No. 200980158165.9 on Oct. 28, 2013.
Extended European Search Report issued in Application No. 10758310.6 on Nov. 12, 2013.
U.S. Office Action issued in U.S. Appl. No. 13/240,216 on Nov. 13, 2013.
Office Action issued in Chinese Patent Application 201010274378.2 dated Jan. 22, 2014.
Extended European Search Report issued Dec. 16, 2013 in EP App. No. 12160324.5.
Extended European Search Report issued Dec. 18, 2013 in EP App. No. 12160192.6.
Extended European Search Report issued Dec. 20, 2013 in EP App. No. 12161271.7.
Office Action issued Dec. 19, 2013 in Chinese Application No. 200910262674.8.
Office Action issued Jan. 17, 2014 in Chinese Application No. 201210071810.7.
Office Action issued Jan. 3, 2014 in Australian Application No. 2010231426.
Office Action issued Dec. 30, 2013 in Chinese Application No. 201010209208.6.
Office Action issued Dec. 30, 2013 in Chinese Application No. 201210070147.9.
Extended European Search Report issued Feb. 5, 2014 in EP App. No. 09852818.5.
New Zealand Office Action issued in Application No. 596044 on Sep. 25, 2013.
Chinese Office Action issued in Application No. 201010150928 on Sep. 3, 2013.
U.S. Office Action issued in U.S. Appl. No. 13/240,266 on Oct. 16, 2013.
Chinese Office Action issued in Application No. 201010150090.4 on Sep. 26, 2013.
Chinese Office Action issued in Application No. 201010150109.5 on Sep. 22, 2013.
Final Office Action issued Dec. 23, 2013 in U.S. Appl. No. 13/431,350.
Mar. 25, 2014 Non-Final Office Action issued in U.S. Appl. No. 13/431,371.
Mar. 26, 2014 Final Office Action issued in U.S. Appl. No. 12/732,457.
Notice of Allowance issued in related U.S. Appl. No. 12/732,747 mailed Feb. 19, 2014.
Notice of Allowance issued in related U.S. Appl. No. 12/732,404 mailed Feb. 4, 2014.
Notice of Allowance issued in related U.S. Appl. No. 12/732,828 mailed Jan. 27, 2014.
Notice of Allowance issued in corresponding U.S. Appl. No. 12/644,451 mailed Feb. 24, 2014.
Non-Final Office Action received in corresponding U.S. Appl. No. 13/430,080 mailed Mar. 10, 2014.
Office Action issued May 9, 2014 in Vietnamese Application No. 1-2011-02491.
Notice of Allowance issued in corresponding U.S. Appl. No. 12/644,572 mailed Apr. 11, 2014.
Final Office Action received in corresponding U.S. Appl. No. 13/240,216 mailed May 7, 2014.
Notice of Allowance issued in U.S. Appl. No. 13/934,512 mailed May 6, 2014.
Non-Final Office Action received in corresponding U.S. Appl. No. 14/226,256 mailed May 22, 2014.
Office Action issued Apr. 1, 2014 in Japanese Application No. 2013-035990.
Office Action issued Mar. 13, 2014 in Chinese Application No. 201010150928.
Office Action issued Apr. 15, 2014 in Australian Application No. 2009332345.
Office Action issued Apr. 1, 2001 in Chinese Application No. 20101015019.
Office Action issued Apr. 2, 2014 in Chinese Application No. 201210070968.
Office Action issued Apr. 17, 2014 in Russian Application No. 2011143817.
Office Action issued Jan. 3, 2014 in Austrialian Application No. 2010231426.
Sep. 2, 2014 (US) Office Action issued in U.S. Appl. No. 14/226,165.
Sep. 10, 2014—(US) Notice of Allowance—U.S. Appl. No. 13/934,512.

(56) References Cited

OTHER PUBLICATIONS

Sep. 9, 2014—(US) Non-Final Office Action—U.S. Appl. No. 14/226,417.
Sep. 9, 2014—(US) Non-Final Office Action—U.S. Appl. No. 14/226,380.
Sep. 12, 2014—(US) Final Office Action—U.S. Appl. No. 13/431,371.
Sep. 11, 2014—(US) Non-Final Office Action—U.S. Appl. No. 13/848,750.
Sep. 22, 2014—(US) Non-Final Office Action—U.S. Appl. No. 14/141,673.
Sep. 25, 2014—(US) Non-Final Office Action—U.S. Appl. No. 14/226,424.
Jan. 20, 2015—(US) Non-Final Office Action—U.S. Appl. No. 13/431,371.
Jan. 28, 2015—(US) Notice of Allowance—U.S. Appl. No. 13/431,277.
Nov. 12, 2014 (MX) Office Action in Application No. MX/a/2011/013553.
Dec. 26, 2014—(CN) Office Action in Application No. 201080013339.5.
Jan. 22, 2015—(US) Non-Final Office Action—U.S. Appl. No. 14/226,411.
Feb. 10, 2015—(US) Notice of Allowance—U.S. Appl. No. 14/226,380.
Dec. 5, 2014—(US) Non-Final Office Action—U.S. Appl. No. 14/226,325.
Dec. 1, 2014—(US) Non-Final Office Action—U.S. Appl. No. 14/226,289.
Nov. 4, 2014—(US) Non-Final Office Action—U.S. Appl. No. 14/226,428.
Nov. 5, 2014—(US) Non-Final Office Action—U.S. Appl. No. 14/226,373.
Nov. 25, 2014—(US) Notice of Allowance—U.S. Appl. No. 13/934,512.
Oct. 10, 2014—(US) Notice of Allowance—U.S. Appl. No. 12/732,457.
Oct. 27, 2014—(US) Non-Final Office Action—U.S. Appl. No. 14/141,576.
Sep. 24, 2014—(JP) Notification of Rejection—App 2013-142488—Eng Tran.
Sep. 24, 2014—(US) Notice of Allowance—U.S. Appl. No. 13/431,277.
Jan. 22, 2015—(US) Notice of Allowance—U.S. Appl. No. 12/732,457.
Jan. 16, 2015—(US) Non-Final Office Action—U.S. Appl. No. 14/226,402.
Dec. 16, 2014—(US) Notice of Allowance—U.S. Appl. No. 13/240,216.
Dec. 16, 2014—(US) Non-Final Office Action—U.S. Appl. No. 14/226,259.
Jan. 2, 2015—(US) Non-Final Office Action—U.S. Appl. No. 14/226,201.
Jan. 5, 2015—(US) Non-Final Office Action—U.S. Appl. No. 14/226,201.
Feb. 13, 2015—(US) Non-Final Office Action—U.S. Appl. No. 13/240,322.
Sep. 12, 2014—(US) Non-Final Office Action—U.S. Appl. No. 14/226,386.
Oct. 2, 2014—(US) Non-Final Office Action—U.S. Appl. No. 13/430,033.
Nov. 4, 2014—(US) Non-Final Office Action—U.S. Appl. No. 14/226,367.
Oct. 30, 2014—(US) Final Office Action U.S. Appl. No. 14/226,256.
Jun. 25, 2015—(US) Non-Final Office Action—U.S. Appl. No. 13/431,350.
Jun. 19, 2015 (CN) Notification of First Office Action—App 201310659875.8—Eng Tran.

* cited by examiner

TAPE UNIT AND TAPE CASSETTE

CROSS-REFERENCE TO RELATED APPLICATION

This application is a continuation-in-part of International Application No. PCT/JP2010/050253, filed Jan. 13, 2010 which claims priority from Japanese Patent Application No. 2009-086239, filed on Mar. 31, 2009. The disclosure of the foregoing application is hereby incorporated by reference in its entirety.

BACKGROUND

The present disclosure relates to a tape cassette that can be freely mounted in and removed from a tape printer and to a tape unit that is housed in the tape cassette.

In known art, a refill type tape cassette is known in which a tape unit, which has a tape wound around a tape holder, can be mounted in and removed from a box-shaped cassette case. In the refill type tape cassette, only the tape unit housed inside the cassette case is replaced when, for example, a remaining amount of the tape is low, or when a tape type is changed etc. By only replacing the tape unit, the cassette case can be re-used.

In the refill type tape cassette, a plurality of hole portions, which penetrate in the up-down direction, are provided on a rear right portion of the cassette case. A plurality of bar-shaped blocking portions, which protrude in the up-down direction, are provided on a rear right portion of the tape unit in accordance with a type of the tape. When the tape unit is housed in the cassette case, the plurality of blocking portions selectively fit into the plurality of hole portions. In a cassette mounting portion of a tape printer, a plurality of micro-switches are provided that are constantly urged in the upward direction. When the tape cassette is inserted into the cassette mounting portion, the downwardly protruding plurality of blocking portions selectively depress the plurality of micro-switches. The tape printer identifies the type of the tape by detecting which of the plurality of micro-switches are depressed and which of the micro-switches are not depressed.

SUMMARY

In the refill type tape cassette, at the time of manufacture of the tape cassette or at the time of replacement of the tape unit, for example, there is a risk that a tape that is different to the type of the tape corresponding to the plurality of blocking portions may be mistakenly housed inside the cassette case. When the type of the tape housed inside the cassette case does not correspond to the plurality of blocking portions, the tape printer mistakenly detects the type of the tape. In this case, when the tape printer performs a printing operation, there is a risk that tape printing defects and movement defects may occur.

Various exemplary embodiments of the broad principles derived herein provide a tape unit and a tape cassette that are capable of inhibiting a wrong type of tape from being housed in a cassette case.

The exemplary embodiments provide a tape unit that holds a tape roll that has a wound tape that is a print medium, and that is adapted to be mounted in and removed from a cassette case. The tape unit is provided with a holder shaft portion and an indicator portion. The holder shaft portion is inserted into a shaft hole formed in a winding center of the tape roll and rotatably supports the tape roll. The indicator portion is disposed radially outside the tape roll which is supported by the holder shaft portion, and includes at least one hole portion and indicates a type of the tape.

The exemplary embodiments also provide tape cassette that includes a tape unit that holds a tape roll that has a wound tape that is a print medium, and a cassette case into which the tape unit can be mounted and from which the tape unit can be removed. The tape unit is provided with a holder shaft portion and an indicator portion. The holder shaft portion is inserted into a shaft hole formed in a winding center of the tape roll and rotatably supports the tape roll. The indicator portion is disposed radially outside the tape roll which is supported by the holder shaft portion, and includes at least one hole portion and indicates a type of the tape. The cassette case is provided with an indicator exposure portion that, in a state in which the tape unit is mounted inside the cassette case, exposes the indicator portion to an outside of the cassette case.

BRIEF DESCRIPTION OF THE DRAWINGS

Exemplary embodiments will be described below in detail with reference to the accompanying drawings in which.

DETAILED DESCRIPTION OF THE EXEMPLARY EMBODIMENTS

Hereinafter, various embodiments of the present disclosure will be explained with reference to the drawings. Note that in the explanation that follows, a video conference system that includes conference terminal devices that transmit and receive audio data and video data will be explained as an example of a conference system, but the present disclosure can also be applied to an audio conference system that includes conference terminal devices that transmit and receive audio data only.

A tape printer 1 and a tape cassette 30 according to the present embodiment will be explained with reference to FIG. 1 to FIG. 28. In the explanation of the present embodiment, the lower left side, the upper right side, the lower right side and the upper left side in FIG. 1 respectively correspond to the front side, the rear side, the right side and the left side of the tape printer I. The lower right side, the upper left side, the upper right side and the lower left side in FIG. 3 respectively correspond to the front side, the rear side, the right side and the left side of the tape cassette 30.

Figure 3:
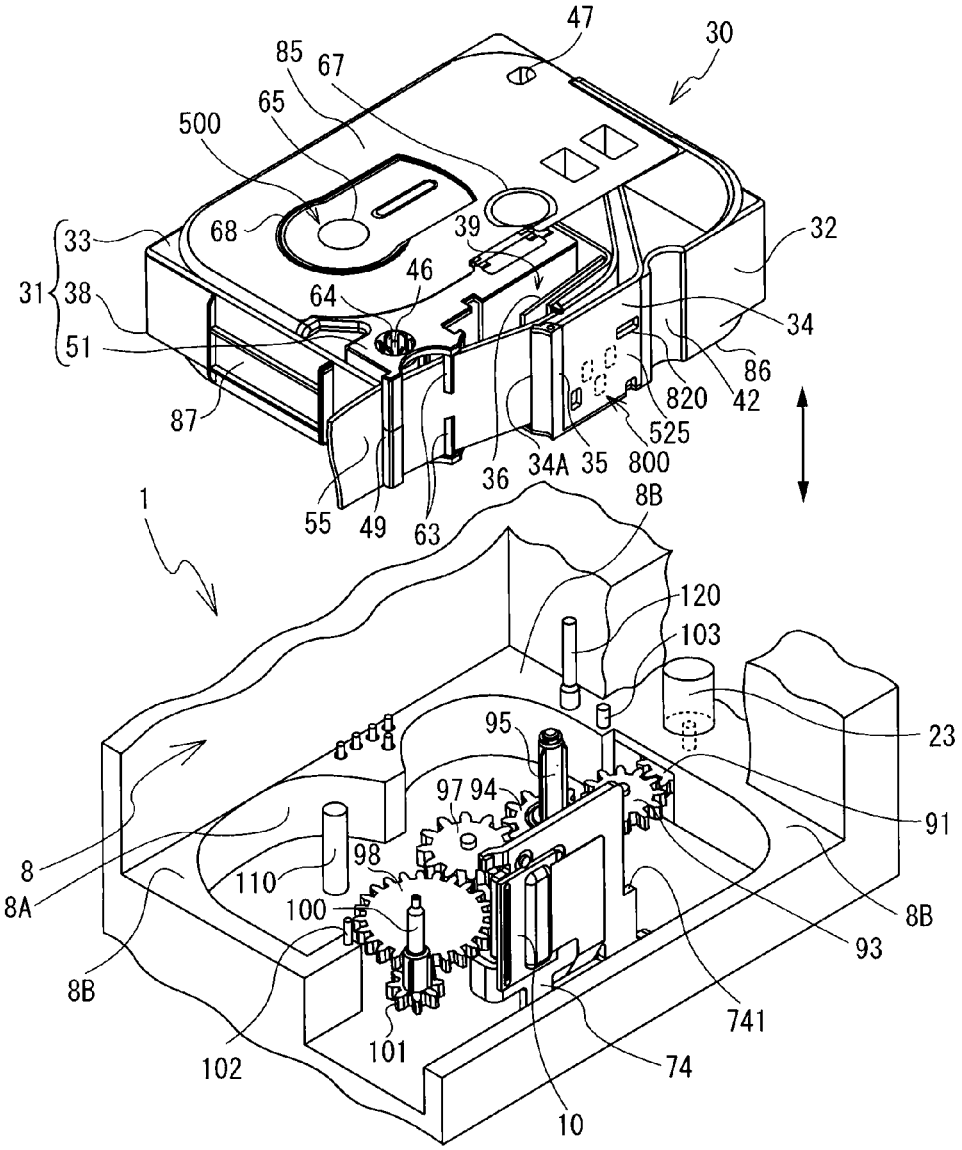
FIG. 3 is an oblique view for explaining a tape cassette 30 and a cassette mounting portion 8.

Note that, in actuality a gear train, including gears 91, 93, 94, 97, 98 and 101 shown in FIG. 3, is covered up by the bottom surface of a cavity 8A, but as it is necessary to explain the gear train, the bottom surface of the cavity 8A is not shown in FIG. 3. In FIG. 3, side walls that form a periphery around a cassette mounting portion 8 are shown schematically, but this is simply a schematic diagram, and the side walls shown in the drawing are depicted as thicker than they are in actuality. Moreover, in FIG. 5 and FIG. 6, a state in which the tape cassette 30 is mounted in the cassette mounting portion 8 is shown with a cassette lid 33 and an auxiliary cover 51 removed.

First, an overview of the configuration of the tape printer 1 according to the present embodiment will be explained. The tape printer 1 is a general-purpose tape printer in which various types of tape cassettes can be used, such as a heat-sensitive type, a receptor type, a heat-sensitive laminated type, and the like. The thermal type is a type of tape cassette in which only a heat sensitive paper tape is housed. The receptor type is a type of tape cassette in which a printing tape and an ink ribbon are housed. The laminated type is a type of tape cassette in which a double-sided adhesive tape, a film tape, and an ink ribbon are housed. The heat sensitive laminated type is a type of tape cassette in which a double-sided adhesive tape and a heat sensitive paper tape are housed.

Figure 1:
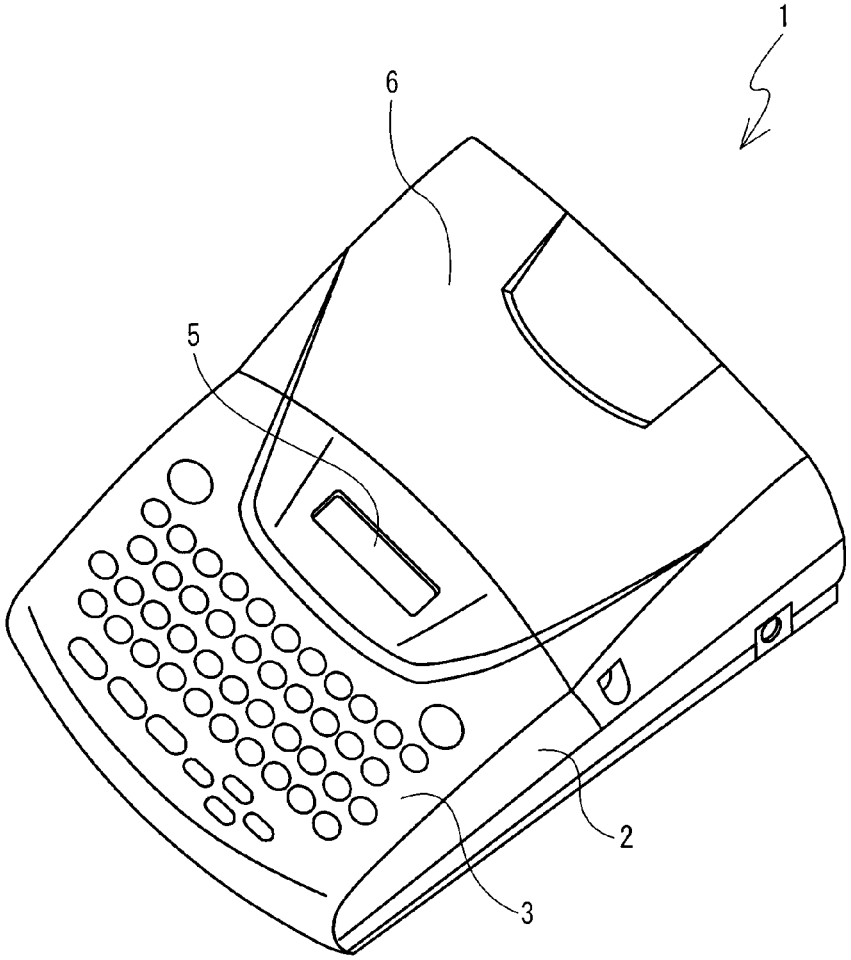
FIG. 1 is an oblique view of a tape printer 1 from above in which a cassette cover 6 is in a closed state.
Figure 2:
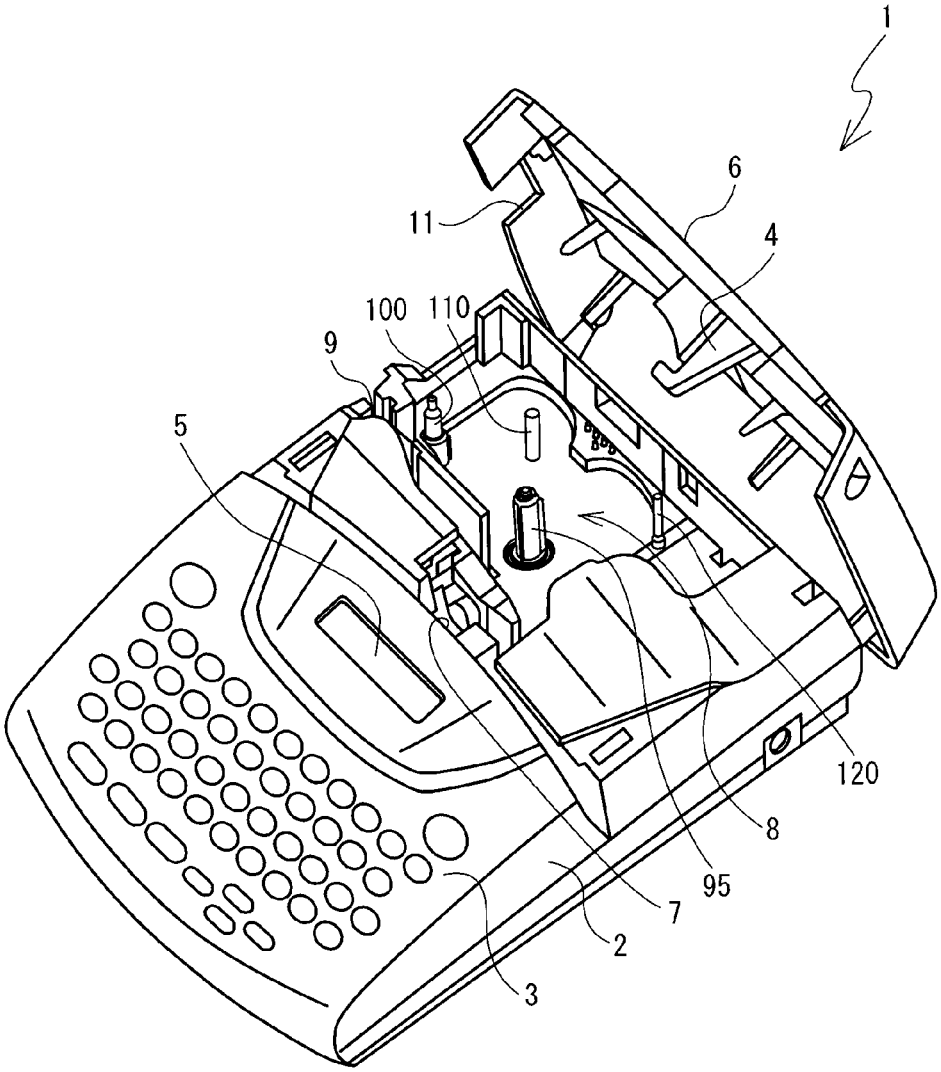
FIG. 2 is an oblique view of the tape printer 1 from above in which the cassette cover 6 is in an open state.

As shown in FIG. 1 and FIG. 2, the tape printer 1 is provided with a main body cover 2 that has a rectangular shape in a plan view. A keyboard 3 is provided on the front side of the main body cover 2, the keyboard 3 including character keys such as characters, symbols and numerals, a variety of function keys and so on. On the rear side of the keyboard 3 is positioned a display 5 that can display input characters and symbols. On the rear side of the display 5 is provided a cassette cover 6 that is opened and closed when the tape cassette 30 (refer to FIG. 3) is replaced. A discharge slit 9, which discharges a printed tape to the outside, is provided to the rear of the left side face of the main body cover 2. A discharge window 11 is provided in the left side face of the cassette cover 6 such that, when the cassette cover 6 is in a closed state, the discharge window 11 exposes the discharge slit 9 to the outside. A hook-shaped latch lock 4 that protrudes downward from the bottom side of the cassette cover 6 is provided substantially at the center of the front side of the cassette cover 6. A lock hole 7 is provided in the main body cover 2 in a position corresponding to the latch lock 4. When the cassette cover 6 is closed, the latch lock 4 is fitted into the lock hole 7, preventing the cassette cover 6 from opening on its own.

Next, the internal configuration of the main body cover 2 underneath the cassette cover 6 will be explained with reference to FIG. 2 to FIG. 6. In FIG. 3 to FIG. 6, for ease of understanding, the internal configuration of the main body cover 2 (in particular, the shape and the structure of the cassette mounting portion 8) is schematically shown. As shown in FIG. 2 to FIG. 6, the cassette mounting portion 8 is an area in which the tape cassette 30 can be freely mounted or removed, and includes a cavity 8A and a corner support portion 8B. The cavity 8A is formed as a recessed portion that has a flat bottom surface and is shaped such that it roughly corresponds to the plan shape of a cassette case 31. The corner support portion 8B is a flat portion that extends horizontally from the outer edge of the cavity 8A. In a case where the tape cassette 30 has been mounted in the cassette mounting portion 8, the corner support portion 8B is a part that is positioned opposite the underside of the outer edge of the tape cassette 30 (more specifically, corner portions 321 to 324, which will be described later).

A head holder 74 is provided in a fixed condition on the front portion of the cassette mounting portion 8, and a thermal head 10 that is provided with a heating element (not shown in the drawings) is mounted on the head holder 74. A tape feed motor 23 that is a stepping motor is provided on the outside of the cassette mounting portion 8 (on the upper right side in FIG. 3). The gear 91 is affixed to the lower end of a drive shaft of the tape feed motor 23. The gear 91 meshes with the gear 93 through an opening. The gear 93 meshes with the gear 94. A substantially cylindrical ribbon winding shaft 95 is provided in a vertical orientation on a top face of the gear 94. The gear 94 meshes with the gear 97. The gear 97 meshes with the gear 98. The gear 98 meshes with the gear 101. A substantially cylindrical tape drive shaft 100 is provided in a vertical orientation on a top face of the gear 101. A plurality of cam members 100A are provided on the tape drive shaft 100, extending from a base end toward a leading end in a radiating pattern in a plan view (refer to FIG. 22).

When the tape feed motor 23 rotationally drives the gear 91 in the counterclockwise direction with the tape cassette 30 in the state of having been mounted in the cassette mounting portion 8, the ribbon winding shaft 95 is rotationally driven in the counterclockwise direction through the gear 93 and the gear 94. The ribbon winding shaft 95 rotationally drives a ribbon winding spool (not shown in the drawings) that is mounted on the ribbon winding shaft 95. Furthermore, the rotation of the gear 94 is transmitted to the tape drive shaft 100 through the gear 97, the gear 98 and the gear 101, and the tape drive shaft 100 is rotationally driven in the clockwise direction. The tape drive shaft 100 rotationally drives a tape drive roller 46 that is mounted on the tape drive shaft 100. A substantially cylindrical auxiliary shaft 110 is provided in a vertical orientation to the rear of the gear 98, and this will be described in more detail later.

Two positioning pins 102 and 103 are provided in two locations on the corner support portion 8B. Specifically, the positioning pin 102 is provided on the left side of the cavity 8A, and the positioning pin 103 is provided on the right side of the cavity 8A, respectively. In a case where the tape cassette 30 has been mounted in the cassette mounting portion 8, the positioning pins 102, 103 are respectively inserted into pin holes 52, 53 (refer to FIG. 12), which are two recessed portions formed on the bottom surface of the tape cassette 30, thus positioning the tape cassette 30 in the front-rear and left-right directions at left and right positions of the outer edge of the tape cassette 30.

A substantially cylindrical guide shaft 120 is provided in a vertical orientation on the right side of the cassette mounting portion K toward the rear. The guide shaft 120 includes two shaft portions of different diameters (a large diameter portion 120A and a small diameter portion 120B) and a tapered portion 120C (refer to FIG. 22). The large diameter portion 120A is a shaft portion that forms a base end of the guide shaft 120, and it has the largest diameter in the guide shaft 120. The small diameter portion 120B is a shaft portion that forms a leading end of the guide shaft 120, and its diameter is smaller than that of the large diameter portion 120A. The tapered portion 120C is a shaft portion that is provided between the large diameter portion 120A and the small diameter portion 120B. The tapered portion 120C has a tapered face whose diameter gradually decreases from the large diameter portion 120A side toward the small diameter portion 120B side.

The positional relationships of various vertically oriented members that are provided in the cassette mounting portion 8 will be explained with reference to FIG. 4. The broken line in FIG. 4 indicates a parting line J that will be described later. The tape drive shaft 100, the guide shaft 120, the auxiliary shaft 110, the ribbon winding shaft 95, and the head holder 74 are provided in positions that respectively correspond to a roller support hole 64, a guide hole 47, a tape support hole 65, a winding spool support hole 67, and a head insertion portion 39 of the tape cassette 30 (refer to FIG. 22).

The tape drive shaft 100 is provided standing in a first shaft installation area 8C that includes a corner portion that is positioned in the left front part of the cassette mounting portion 8. The first shaft installation area 8C is adjacent to and on the left side of the head holder 74, which is fixed in the center of the front portion of the cassette mounting portion 8. The first shaft installation area 8C is positioned to the downstream side of the printing position of the thermal head 10 in a feed direction of a printing tape 55 (hereinafter referred to as a tape feed direction). The guide shaft 120 is provided standing in a second shaft installation area 8D that includes a corner portion that is positioned in the right rear part of the cassette mounting portion 8. In other words, when the cassette mounting portion 8 is seen in a plan view, the corner portion that is included in the second shaft installation area 8D is positioned diagonally opposite the corner portion that is included in the first shaft installation area 8C.

When the cassette mounting portion 8 is partitioned in the plan view, taking as a reference the parting line J, which links the tape drive shaft 100 and the guide shaft 120 in the plan view, an area to the rear of the parting line J is a first installation area 8E and an area to the front of the parting line J is a second installation area 8F. The auxiliary shaft 110 is provided standing in the first installation area 8E, more specifically, to the left rear from the center of the cassette mounting portion 8 in the plan view. The ribbon winding shaft 95 is provided standing in the second installation area 8F, more specifically, to the right front from the center of the cassette mounting portion 8 in the plan view. The auxiliary shaft 110 and the ribbon take-up shaft 95 are positioned substantially symmetrically to each other with the parting line J as the center in the plan view.

The positioning pin 102 is provided adjacent to and to the rear of the tape drive shaft 100. The positioning pin 103 is provided adjacent to and to the front of the guide shaft 120. The positioning pins 102 and 103 position the tape cassette 30 that has been mounted in the cassette mounting portion 8 in the vicinity of the tape drive shaft 100 and the guide shaft 120, respectively.

The height relationships of each of the members provided standing on the cassette mounting portion 8 differ depending on whether the member is provided in the above-described cavity 8A or on the corner support portion 8B. The members provided on the corner support portion 8B (in the present embodiment, the guide shaft 120 and the positioning pins 102 and 103) are provided standing higher than the members provided in the cavity 8A (in the present embodiment, the ribbon winding shaft 95, the tape drive shaft 100, the auxiliary shaft 110 and the head holder 74). The height relationships between each of the members provided standing on the cassette mounting portion 8 will be described later.

Returning to FIG. 2 to FIG. 6, an arm-shaped platen holder 12 is provided in front of the head holder 74, being supported such that the platen holder 12 can swing around a shaft support portion 12A. A platen roller 15 and a movable feed roller 14 are both rotatably supported around a leading end of the platen holder 12. The platen roller 15 is positioned opposite the thermal head 10 and is able to come into contact with and separated from the thermal head 10. The movable feed roller 14 is positioned opposite the tape drive roller 46 that fits with the tape drive shaft 100 by insertion, and is able to come into contact with and separate from the tape drive roller 46.

Figure 5:
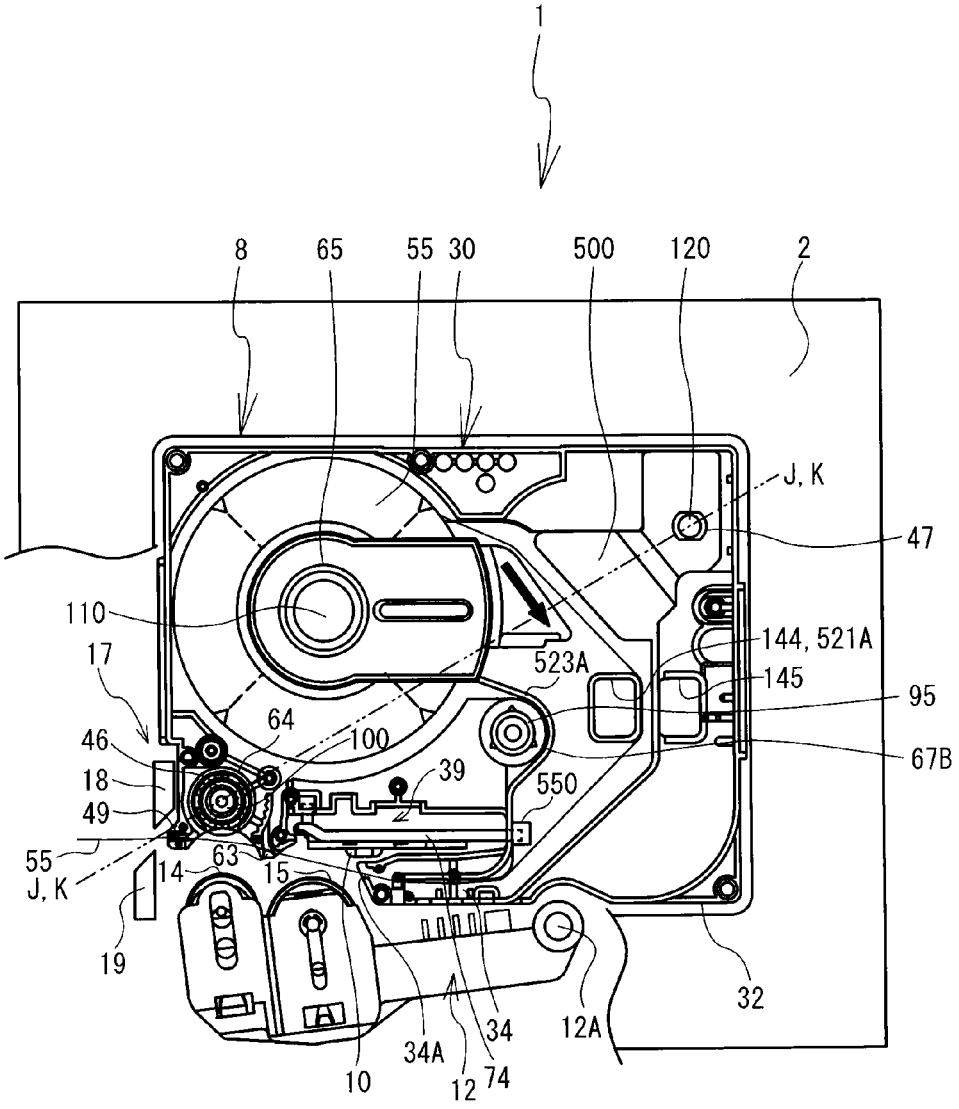
FIG. 5 is a plan view of the cassette mounting portion 8 in which the tape cassette 30 has been mounted, in a case where a platen holder 12 is in a standby position.

A release lever that is not shown in the drawings and that moves in the left-right direction in conjunction with the opening and closing of the cassette cover 6 is coupled to the platen holder 12. When the cassette cover 6 is opened, the release lever moves to the right, and the platen holder 12 moves toward a stand-by position that is shown in FIG. 5. In the stand-by position that is shown in FIG. 5, the platen holder 12 is separated from the cassette mounting portion 8, and the tape cassette 30 can therefore be mounted in or removed from the cassette mounting portion 8. The platen holder 12 is constantly elastically energized toward the standby position by a coil spring that is not shown in the drawings.

Figure 6:
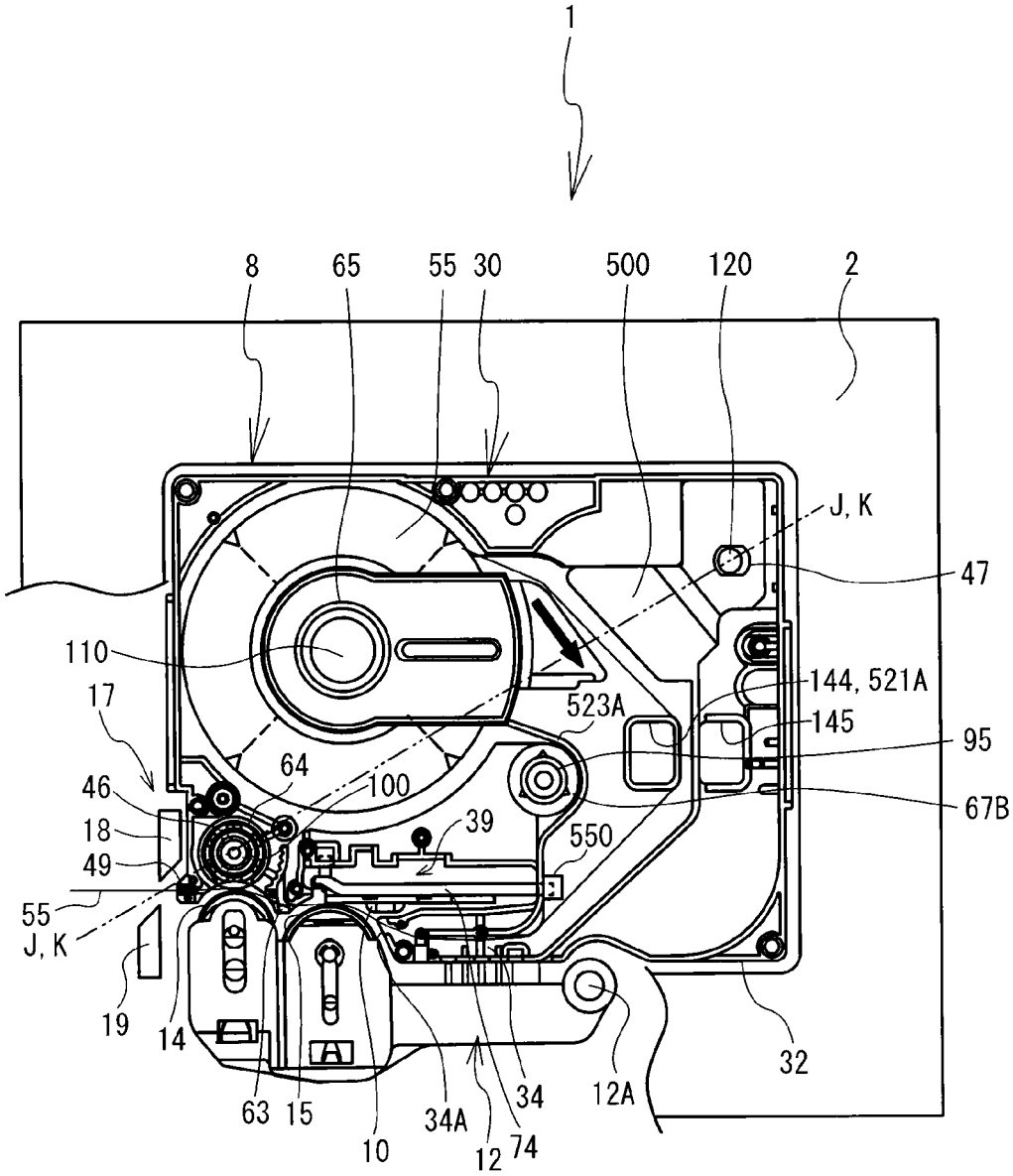
FIG. 6 is a plan view of the cassette mounting portion 8 in which the tape cassette 30 has been mounted, in a case where the platen holder 12 is in a printing position.

When the cassette cover 6 is closed, the release lever moves to the left, and the platen holder 12 moves toward a printing position that is shown in FIG. 6. In the printing position that is shown in FIG. 6, the platen holder 12 is in proximity with the cassette mounting portion 8. As a result, when the tape cassette 30 is mounted in the cassette mounting portion 8, the platen roller 15 applies pressure to the thermal head 10 via a tape of a print medium (in the present embodiment, the printing tape 55). The movable feed roller 14 applies pressure to the tape drive roller 46 via the tape. In the printing position that is shown in FIG. 6, it is possible for the tape printer 1 to perform printing using the tape cassette 30 that has been mounted in the cassette mounting portion 8.

A feed path, through which a printed tape is fed, is provided between a tape discharge portion 49 and the discharge slit 9. A cutting mechanism 17 that cuts the printed tape at a predetermined position is provided on the feed path. The cutting mechanism 17 is provided with a fixed blade 18, and a movable blade 19 that is positioned opposite the fixed blade 18 and that is supported such that it can move in the forward-rearward direction (in the up-down direction shown in FIG. 5 and FIG. 6). The movable blade 19 is moved in the forward-rearward direction by a cutter motor 24 (refer to FIG. 10).

Figure 7:
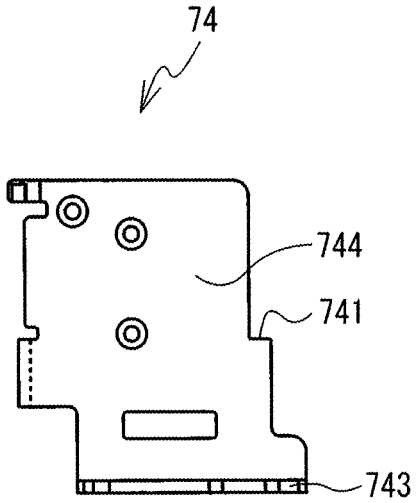
FIG. 7 is a front view of a head holder 74.

A detailed structure of the head holder 74 will be explained with reference to FIG. 4 and FIG. 7. The head holder 74 is formed from a single plate-shaped member and is provided with a base portion 743 and a head anchoring portion 744. The base portion 743 is fastened below the bottom face (not shown in the drawings) of the cavity 8A. The head anchoring portion 744 is bent such that it is roughly orthogonal to and extends upward from the base portion 743, and it is oriented in the left-right direction of the tape printer 1. The head holder 74 is arranged in a position on the cassette mounting portion 8 such that, when the tape cassette 30 is mounted, the position of the head holder 74 corresponds to the head insertion portion 39 that will be described later. Note that the right edge portion of the head holder 74 extends farther to the right than does the right edge portion of the head insertion portion 39. The thermal head 10 is affixed to the front surface of the head anchoring portion 744.

A cassette support portion 741, which supports, from below, the tape cassette 30 that is mounted in the tape printer 1, is provided on the head anchoring portion 744. The cassette support portion 741 is a stepped portion that is formed at a specified height by cutting out a right edge portion of the head anchoring portion 744, in an L shape in a front view. The cassette support portion 741 supports the tape cassette 30 on the upstream side of the thermal head 10 in the tape feed direction. The cassette support portion 741 is set at a position at a predetermined distance in the up-down direction from a central position of the thermal head 10 in the up-down direction. Accordingly, the cassette support portion 741 serves as a reference for positioning the tape cassette 30 in the up-down direction in relation to the central position of the thermal head 10 in the up-down direction. Support of the tape cassette 30 by the cassette support portion 741 will be explained in more detail later.

Figure 4:
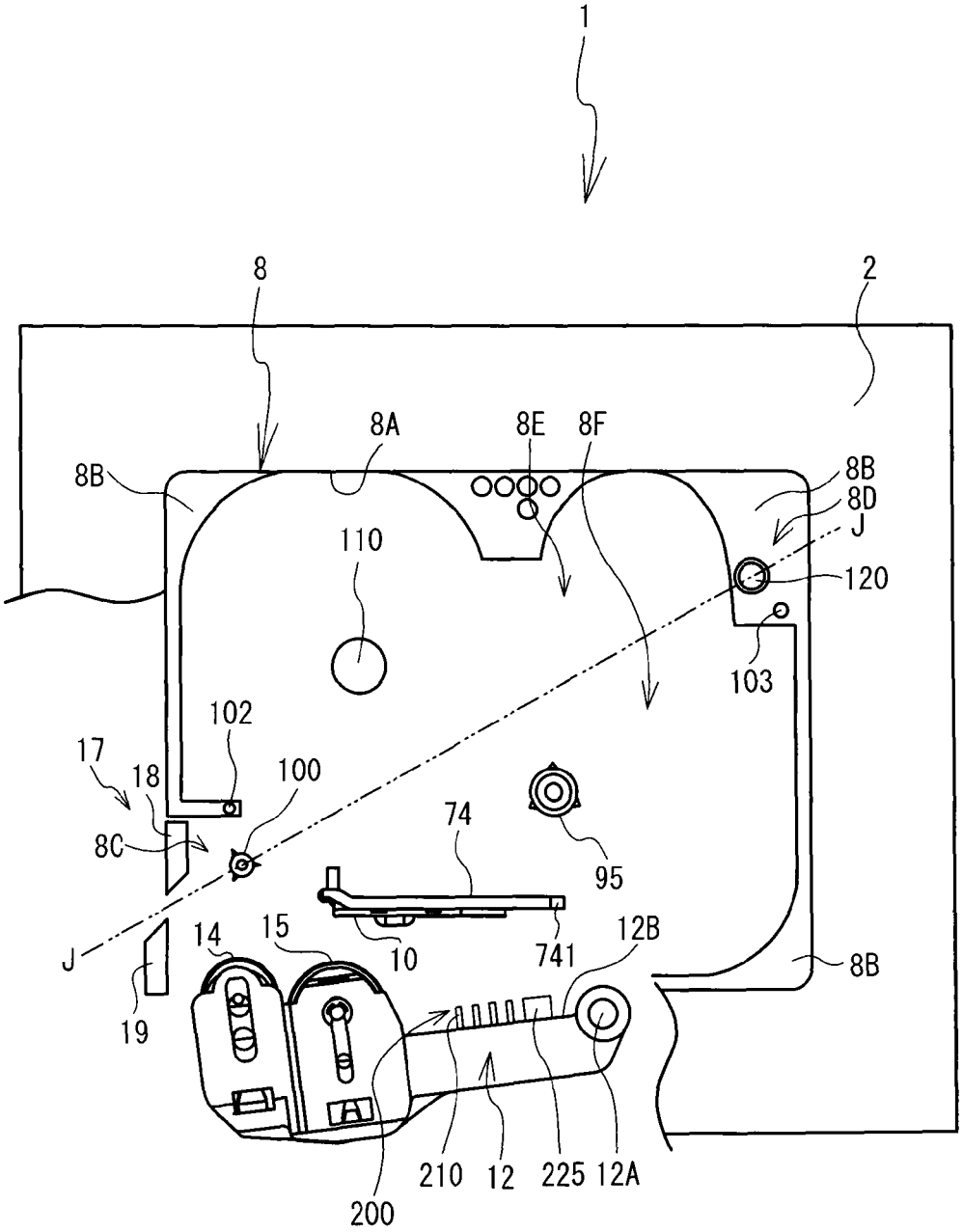
FIG. 4 is a plan view of the cassette mounting portion 8.

As shown in FIG. 4 to FIG. 6, an arm detection portion 200 is provided slightly to the right of a central position in the longitudinal direction on the rear surface of the platen holder 12, namely, the surface that is positioned opposite the thermal head It). Hereinafter, the rear surface of the platen holder 12 is referred to as a cassette facing surface 12B. The arm detection portion 200 includes a plurality of detection switches 210. Switch terminals 222 of each of the detection switches 210 protrude substantially horizontally from the cassette-facing surface 12B toward the cassette mounting portion 8.

In other words, each of the detection switches 210 protrude in a direction that is substantially orthogonal to the direction in which the tape cassette 30 is adapted to be mounted in and removed from the cassette mounting portion 8 (the up-down direction in FIG. 3), and are positioned opposite the front surface (more specifically, a leading end front wall 525 which will be described later) of the tape cassette 30 that is present inside the cassette mounting portion 8. In a state in which the tape cassette 30 is correctly mounted in the cassette mounting portion 8, each of the detection switches 210 are provided in a height position corresponding to an arm indicator portion 800 (refer to FIG. 3), which will be described later.

Figure 8:
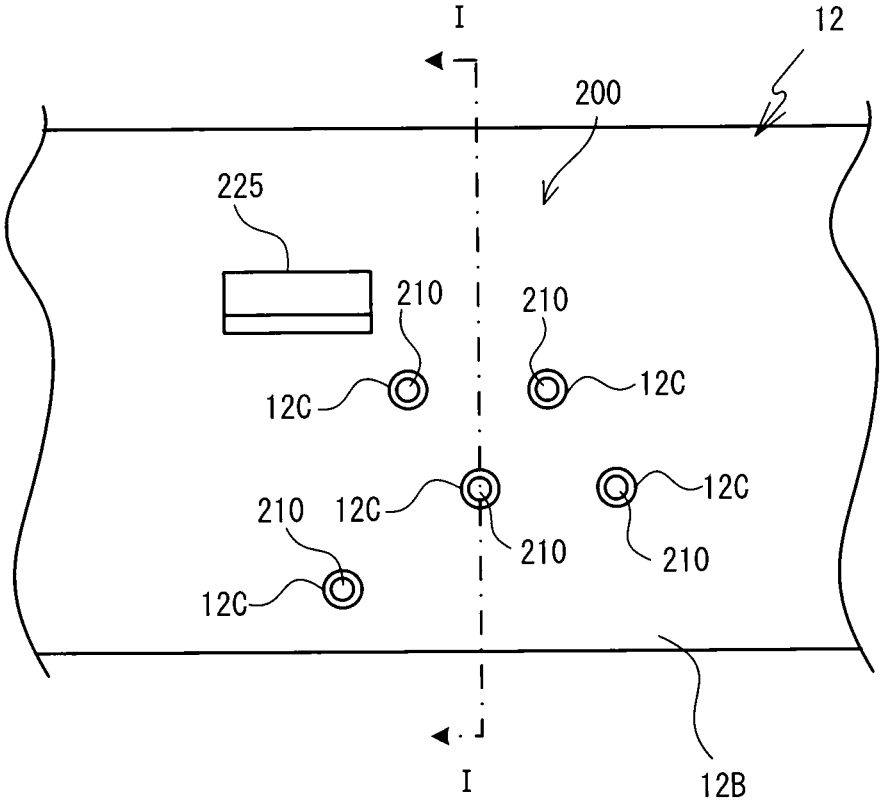
FIG. 8 is a rear view of the platen holder 12.

A detailed arrangement and structure of the detection switches 210 provided on the platen holder 12 will be explained with reference to FIG. 8 and FIG. 9. As shown in FIG. 8, five through holes 12C are provided, arranged in three rows in the up-down direction, in the cassette-facing surface 12B of the platen holder 12. Specifically, they are arranged as two holes in a top row, two holes in a middle row and one hole in a bottom row. The position of each of the through holes 12C is different in the left-right direction. More specifically, the five through holes 12C are arranged in a zigzag pattern, from the right side of the cassette-facing surface 12B (the left side in FIG. 8), in order from the bottom row, to the right end of the top row, to the right end of the middle row, to the left end of the top row, to the left end of the middle row. Five of the detection switches 210 are provided corresponding to the five through holes 12C.

Figure 9:
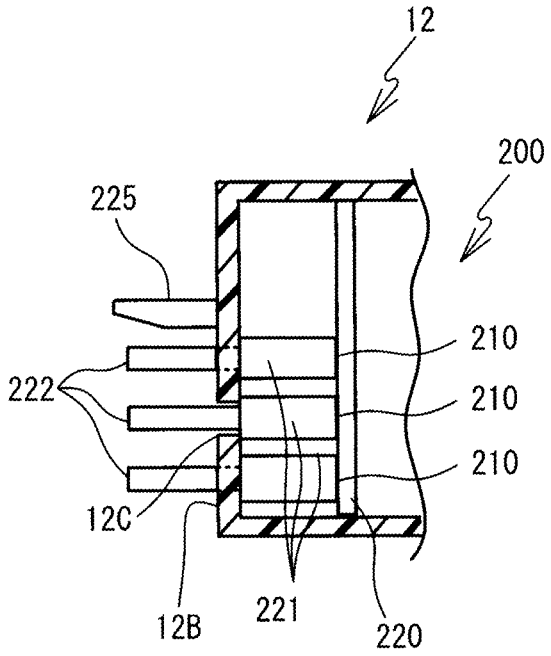
FIG. 9 is a sectional view looking in the direction of the arrows on the line 1-1 shown in FIG. 8.

As shown in FIG. 9, the detection switches 210 are provided with bodies 221, which are substantially cylindrical bodies that are installed in the interior of the platen holder 12, and with the switch terminals 222, which are rod-shaped terminals that can advance from and retract into one end of each of the bodies 221 in the axis line direction. The other end of each of the bodies 221 is fastened to a switch support plate 220 in the interior of the platen holder 12. The switch terminals 222 can advance and retract through the plurality of through holes 12C formed in the cassette facing surface 12B of the platen holder 12. The switch terminals 222 are maintained in a state of protruding from the bodies 221 by spring members (not shown in the drawings) that are normally provided in the interiors of the bodies 221. When the switch terminals 222 are not being pressed, they are in the state of protruding from the bodies 221 (an off state), and when the switch terminals 222 are being pressed, they are in the state of being pushed into the bodies 221 (an on state).

In a case where the tape cassette 30 has been mounted in the cassette mounting portion 8, when the platen holder 12 moves toward the stand-by position (refer to FIG. 5), each of the detection switches 210 is separated from the tape cassette 30 and thus they are all in the off state. When the platen holder 12 moves toward the printing position (refer to FIG. 6), the detection switches 210 are positioned opposite the front face of the tape cassette 30 (more specifically, the leading end front wall 525) and are selectively pressed by the arm indicator portion 800. The tape printer 1 detects the type of the tape in the tape cassette 30 based on a combination of the on and off states of the detection switches 210. Detection of the tape type by the arm detection portion 200 will be explained in more detail later.

As shown in FIG. 4 and FIG. 5, a latch piece 225 that is a plate-shaped projecting portion that extends in the left-right direction is provided in the cassette facing surface 12B of the platen holder 12. The latch piece 225 projects substantially horizontally toward the cassette mounting portion 8 from the cassette facing surface 12B, in the same manner as the switch terminals 222 of the detection switches 210. In other words, the latch piece 225 protrudes such that it is opposite to the front surface (more specifically, the leading end front wall 525) of the tape cassette 30 that is in the cassette mounting portion 8. When the tape cassette 30 is mounted in the correct position in the cassette mounting portion 8, the latch piece 225 is provided at a height position corresponding to a latch hole 820 (refer to FIG. 3) that will be described later.

An arrangement and structure of the latch piece 225 on the platen holder 12 will be explained with reference to FIG. 8 and FIG. 9. As shown in FIG. 8, the latch piece 225 is provided on the cassette facing surface 12B of the platen holder 12 and is positioned above the detection switches 210 in the top row, extending to the right from a position in the left-right direction between the detection switch 210 on the right side (the left side in FIG. 8) in the top row and the detection switch 210 in the bottom row As shown in FIG. 9, the latch piece 225 is formed as an integral part of the platen holder 12, such that it protrudes toward the rear (the left side in FIG. 9) from the cassette facing surface 12B of the platen holder 12. Taking the cassette facing surface 12B as a reference, a height of protrusion of the latch piece 225 is substantially the same as or slightly greater than a height of protrusion of the switch terminals 222 from each of the detection switches 210.

Figure 10:
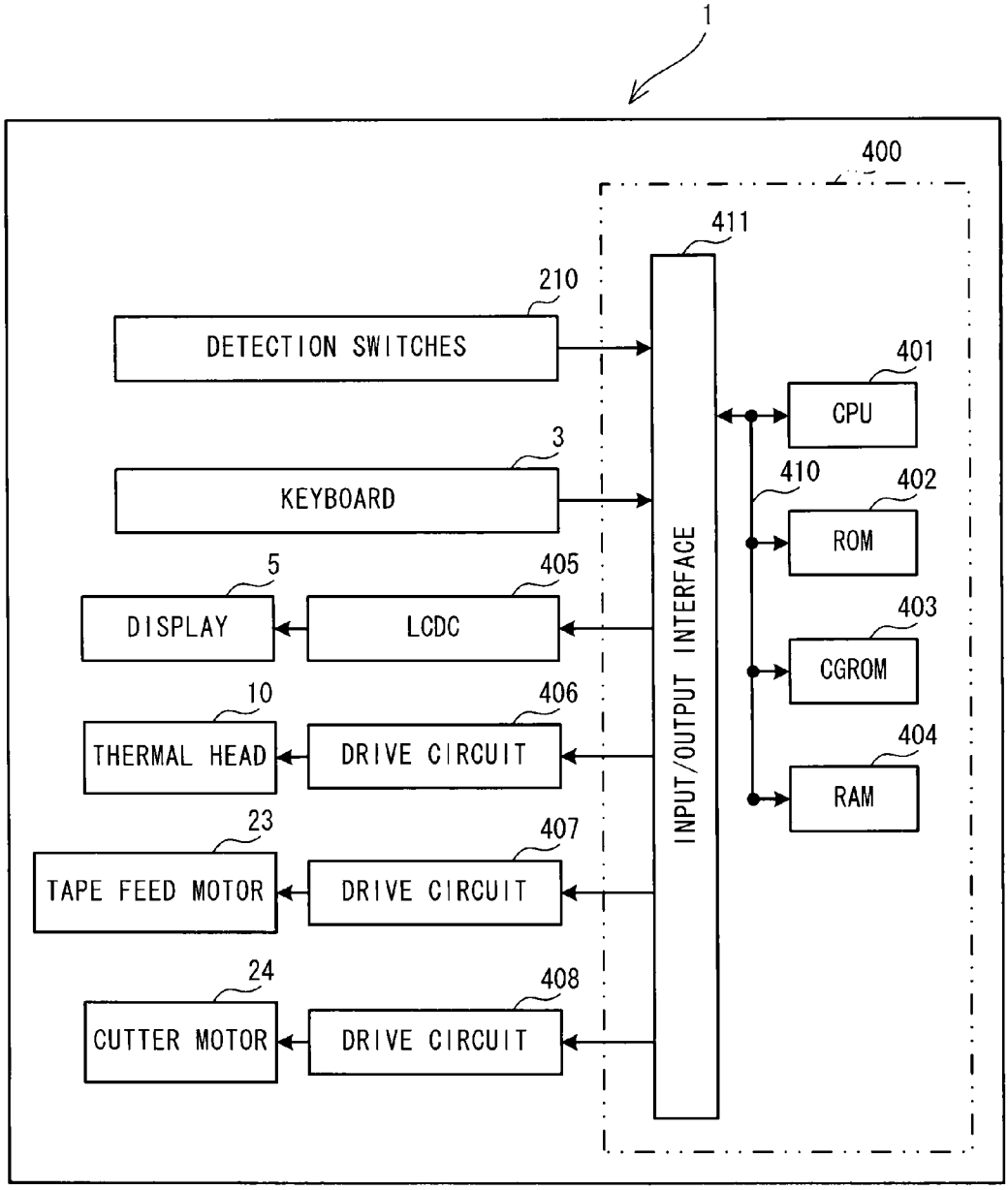
FIG. 10 is a block diagram that shows an electrical configuration of the tape printer 1.

An electrical configuration of the tape printer 1 will be explained with reference to FIG. 10. As shown in FIG. 10, the tape printer 1 is provided with a control circuit 400 that is formed on a control board. In the control circuit 400, a ROM 402, a CGROM 403, a RAM 404, and an input-output interface 411 are connected to a CPU 401 through a data bus 410.

Various types of programs that the CPU 401 executes in order to control the tape printer 1 are stored in the ROM 402. Tables for specifying the type of tape of the tape cassette 30 that is mounted in the cassette mounting portion 8 are also stored in the ROM 402. Printing dot pattern data for printing characters are stored in the CGROM 403. A plurality of storage areas are provided in the RAM 404 for a text memory, a character buffer, and the like.

The detection switches 210, the keyboard 3, a liquid crystal drive circuit (LCDC) 405, drive circuits 406, 407, 408, and the like are connected to the input-output interface 411. The drive circuit 406 is an electronic circuit for driving the thermal head 10. The drive circuit 407 is an electronic circuit for driving the tape feed motor 23. The drive circuit 408 is an electronic circuit for driving the cutter motor 24, which operates the movable blade 19. The liquid crystal drive circuit (LCDC) 405 includes a video RAM (not shown in the drawings) for outputting display data to the display 5.

Next, the structure of the tape cassette 30 according to the present embodiment will be explained. The tape cassette 30 according to the present embodiment is the refill type tape cassette in which a tape unit 500 housed in the cassette case 31 can be replaced.

The overall structure of the tape cassette 30 will be explained with reference to FIG. 3, FIG. 5, FIG. 6 and FIG. 11 to FIG. 13. In FIG. 13, in order to clearly show a shape of a front portion of a case body 38, the drawing is shown with the tape drive roller 46 and the auxiliary cover 51 removed. The tape cassette 30 has the cassette case 31, which is a housing whose overall shape is roughly rectangular (box-shaped), with corner portions that are rounded in a plan view The cassette case 31 includes the case body 38, the cassette lid 33 and the auxiliary cover 51. The case body 38 is a box-shaped body that is open in the upward direction, and that houses the tape unit 500. The cassette lid 33 is a lid that can be freely mounted on and removed from the opening of the case body 38 in the upward direction. The auxiliary cover 51 is a plate-shaped member that covers, from above, the tape drive roller 46 and so on provided in the case body 38.

The above-described cassette case 31 includes a top wall surface 85 and a bottom wall surface 86, which are a pair of surfaces each forming a flat rectangular shape and arranged opposing each other in the up-down direction, and a side wall 87, which is formed at a predetermined height around the outer edges of the top wall surface 85 and the bottom wall surface 86. In the present embodiment, the top wall surface 85 includes a top plate 33A (refer to FIG. 13) of the cassette lid 33, which will be described later, and the auxiliary cover 51. The bottom wall surface 86 is a bottom plate of the case body 38 that will be described later.

In the cassette case 31, the whole perimeter of the top wall surface 85 and the bottom wall surface 86 need not necessarily be enclosed by the side wall 87. For example, an opening that exposes the interior of the cassette case 31 to the outside may be provided in a portion of the side wall 87 (in a rear wall, for example), and bosses connecting the top wall surface 85 and the bottom wall surface 86 may be provided in positions facing the opening.

When the tape cassette 30 is seen from center in the plan view, the tape support hole 65 that rotatably supports the printing tape 55 provided in the tape unit 500 is formed on the left and to the rear. The auxiliary shaft 110 can be inserted into and removed from the tape support holed 65 when the tape cassette 30 is mounted or removed, and this will be explained in more detail later.

When the tape cassette 30 is seen from center in the plan view, the winding spool support hole 67 is formed on the right and to the front. The winding spool support hole 67 pulls an ink ribbon from a ribbon spool (not shown in the drawings) and rotatably supports a ribbon winding spool (not shown in the drawings) that winds the ink ribbon that has been used for printing characters and the like. In the present embodiment, the printing tape 55 is a heat-sensitive paper tape that has heat sensitive color developing properties, and that can print characters and the like without using the ink ribbon. The tape cassette 30 therefore does not need to house the ink ribbon and the ribbon spool and the ribbon winding spool are not provided.

An arm portion 34 is provided on the right side of the front surface of the tape cassette 30, extending slightly to the front of the tape cassette 30 and bent back orthogonally toward the center. The arm portion 34 guides the printing tape 55 that is housed inside the cassette case 31, and discharges it to the front of the head insertion portion 39 from a discharge outlet 34A provided at a leading end. The head insertion portion 39 is a gap that is surrounded by the arm portion 34 and the above-described head holder 74 is inserted into the head insertion portion 39.

The roller support hole 64 is provided on a left front portion of the tape cassette 30. The tape drive roller 46, into which and from which the above-described tape drive shaft 100 is inserted and removed, is rotatably supported by the inner side of the roller support hole 64. The tape drive roller 46 pulls out the unused printing tape 55 by a coordinated operation with the movable feed roller 14 that is positioned opposite the tape drive roller 46. A pair of upper-lower restraining members 63 are provided on the upstream side in the tape feed direction as seen from the tape drive roller 46. The restraining members 63 restrain a printed tape in the width direction and guide it to the tape discharge portion 49, on the downstream side in the tape feed direction as seen from the thermal head 10.

The tape discharge portion 49 is a plate-shaped member that extends between the top wall surface 85 and the bottom wall surface 86 and that is provided such that it is in front of and slightly separated from the front edge of the left side face of the cassette case 31. The tape discharge portion 49 guides the printed printing tape 55, which has been fed through the tape drive roller 46, into a passage that is formed between the tape discharge portion 49 and the front edge of the left side face of the cassette case 31, and then discharges the printed printing tape 55 through the discharge slit 9 positioned at a final end of the passage.

The guide hole 47, into and out of which the above-described guide shaft 120 is inserted and removed when the tape cassette 30 is mounted and removed, is provided in a right rear portion of the tape cassette 30. In the present embodiment, the shape of the opening of the guide hole 47 is such that two sides that oppose each other in the front-rear direction in a plan view are straight lines and two sides that oppose each other in the left-right direction are curved lines on which every point is the same distance from the center of the opening of the guide hole 47. A width of the opening of the guide hole 47 is larger than the diameter of the small diameter portion 120B of the guide shaft 120 in all directions passing through the center of the opening of the guide hole 47 in the plan view. Note that the width of the opening of the guide hole 47 in the plan view is largest in the left-right direction passing through the center of the opening of the guide hole 47, and the width of the opening in the plan view is smallest in the front-rear direction passing through the center of the opening of the guide hole 47. The width of the opening in the front-rear direction passing through the center of the opening of the guide hole 47 is substantially equal to the diameter of the large diameter portion 120A of the guide shaft 120.

The arm indicator portion 800 and the latch hole 820 are provided in the front surface of the tape cassette 30 (more specifically, the front surface of the arm portion 34). The arm indicator portion 800 is a part that allows a person to identify the type of tape housed in the tape cassette 30. Further, the arm indicator portion 800 is a part that causes, by selectively depressing the detection switches 210 of the arm detection portion 200, the tape printer 1 to detect the type of tape of the tape cassette 30. The latch piece 225 is inserted into the latch hole 820. The arm indicator portion 800 and the latch hole 820 will be separately described later.

Figure 13:
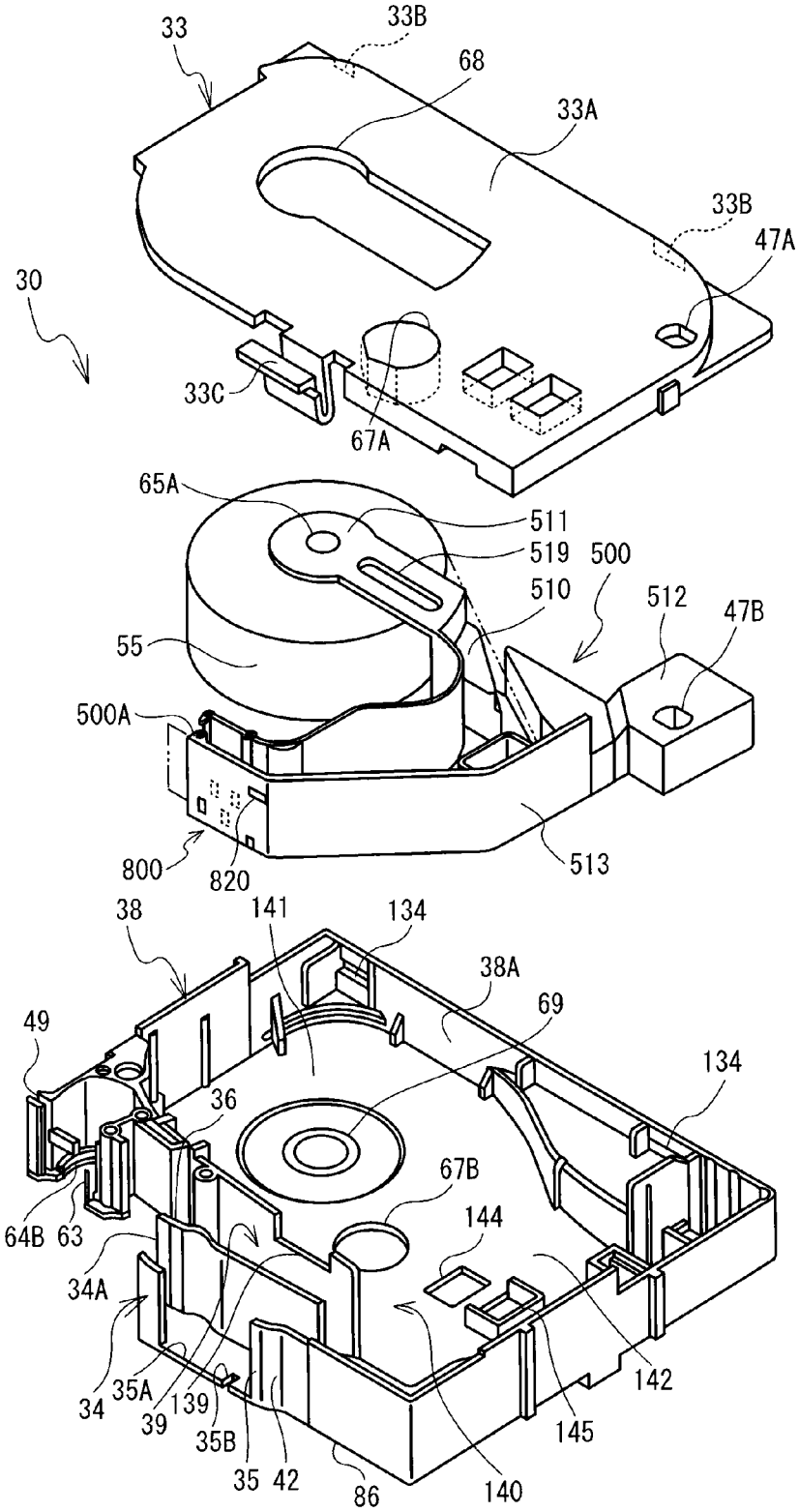
FIG. 13 is an exploded view of the tape cassette 30.
Figure 14:
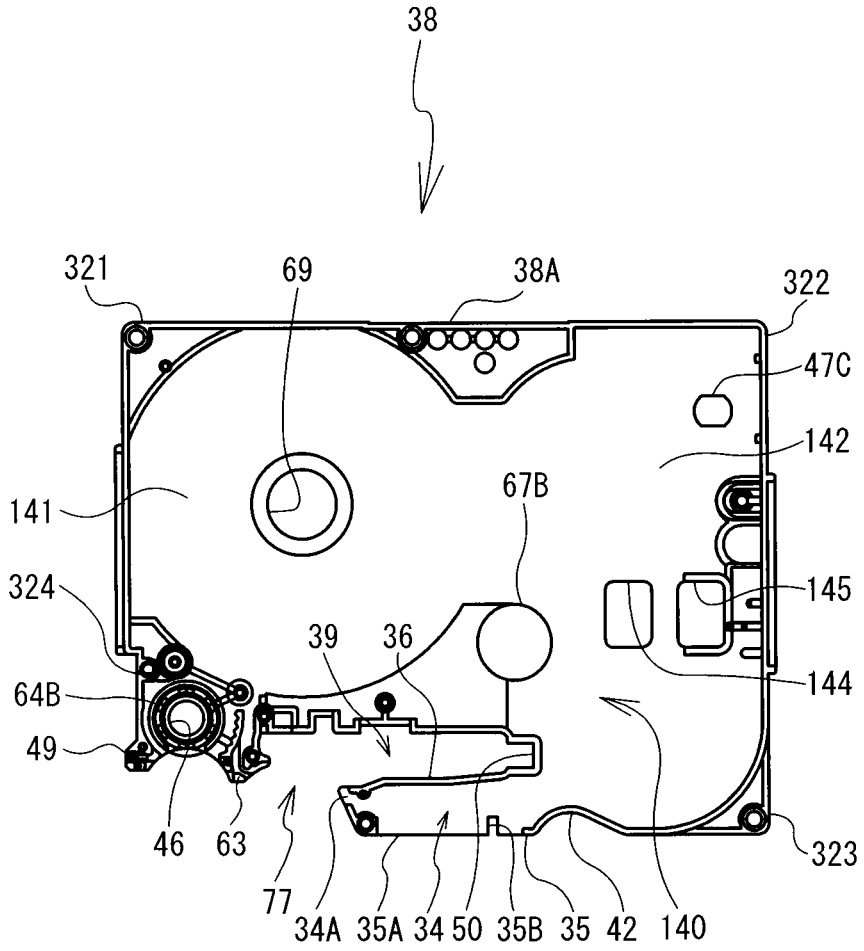
FIG. 14 is a plan view of a case body 38.

The case body 38 will be explained with reference to FIG. 3, and FIG. 11 to FIG. 15. In FIG. 14, in order to clearly show the shape of the front portion of the case body 38, the case body 38 is shown with the auxiliary cover 51 removed. In actuality, the auxiliary cover 51 is provided from the center of the front portion of the case body 38 over to the left edge portion. For that reason, in a state in which the tape unit 500 and the cassette lid 33 are not assembled, the case body 38 is open in the upward direction apart from parts over which the auxiliary cover 51 is provided.

Figure 11:
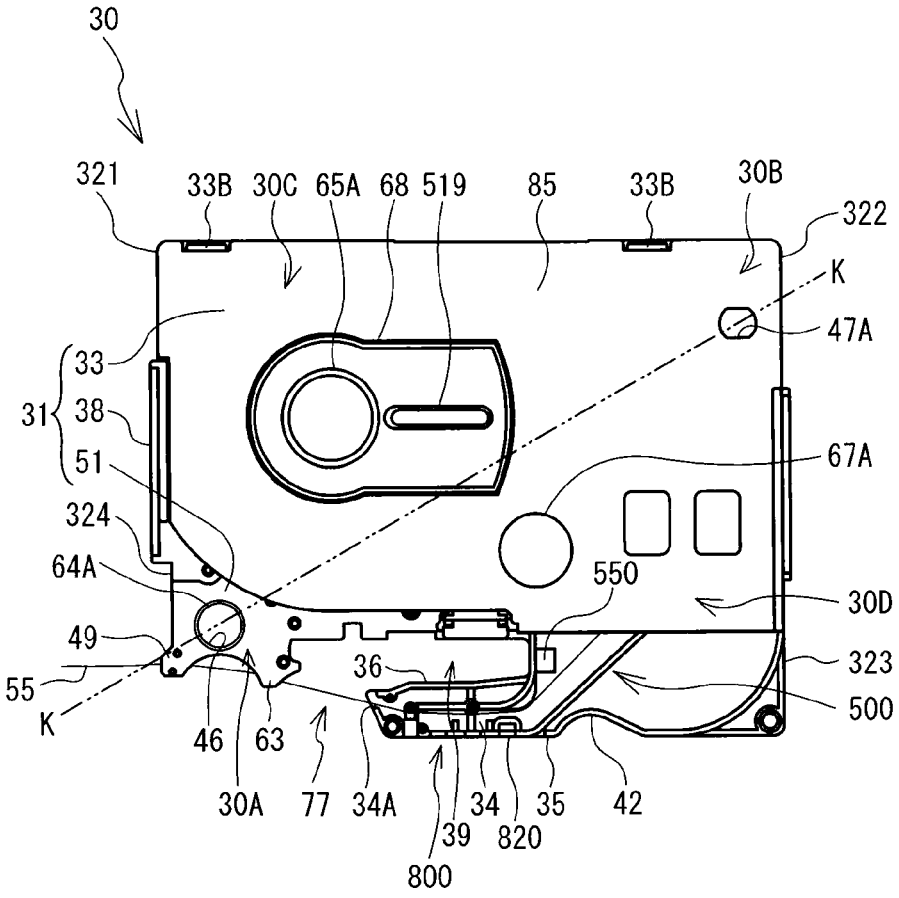
FIG. 11 is a plan view of the tape cassette 30.
Figure 12:
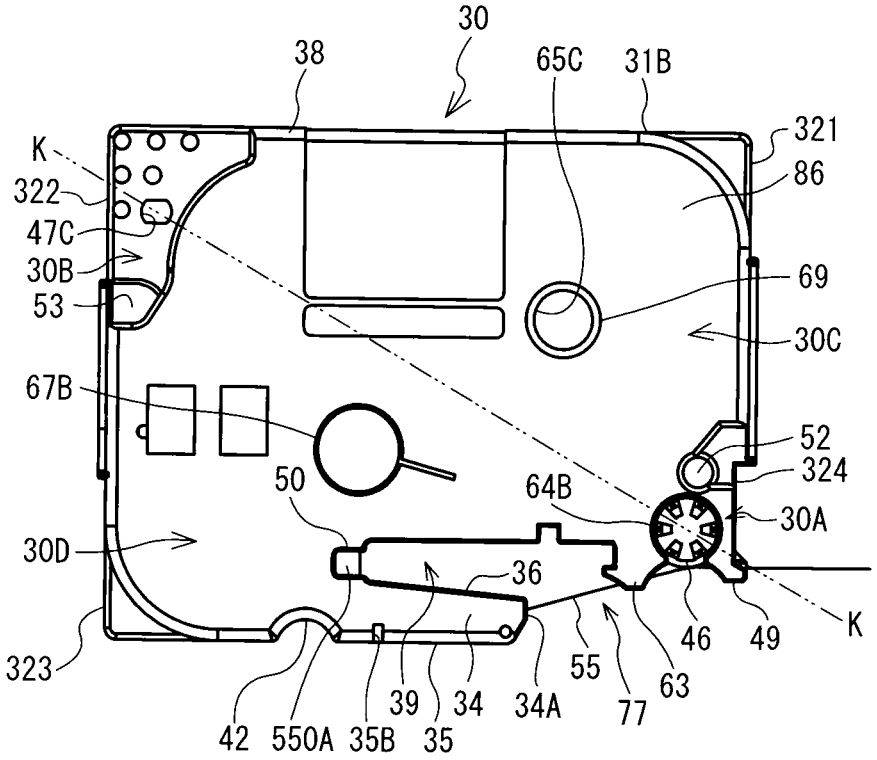
FIG. 12 is a bottom view of the tape cassette 30.

As shown in FIG. 11, FIG. 12 and FIG. 14, the case body 38 has four corner portions 321 to 324 that are formed to have the same width (the same length in the up-down direction) regardless of the type of the tape of the tape cassette 30. Hereinafter, the left rear corner portion will be called the first corner portion 321, the right rear corner portion will be called the second corner portion 322, the right front corner portion will be called the third corner portion 323, and the left front corner portion will be called the fourth corner portion 324. The four corner portions 321 to 324 protrude toward the outside from the side laces of the case body 38, such that they form right angles in a plan view. However, the left front fourth corner portion 324 does not form a right angle, because the tape discharge portion 49 is provided at that corner.

As shown in FIG. 12, when the tape cassette 30 has been mounted in the cassette mounting portion 8, the bottom surfaces of each of the corner portions 321 to 324 are portions that are positioned opposite the above-described corner support portion 8B. The pin holes 52, 53 that respectively correspond to the above-described positioning pins 102, 103 are provided in two locations on the bottom surfaces of the second corner portion 322 and fourth corner portion 324.

As shown in FIG. 3, a portion that extends around the side faces of the entire case body 38 (including each of the corner portions 321 to 324) at the same position in the up-down (height) direction of the case body 38 as each of the corner portions 321 to 324, and with the same width as the corner portions 321 to 324, is called a common portion 32. Specifically, the common portion 32 is a portion whose width is symmetrical in the up-down direction in relation to a center line N that describes the center of the case body 38 in the up-down (height) direction (refer to FIG. 21). The height of the tape cassette 30 varies according to the tape width of the print medium (in the present embodiment, the printing tape 55) that is housed. However, a width T (the length in the up-down direction) of the common portion 32 is set as a constant dimension, regardless of the tape width of the tape.

For example, when the width T of the common portion 32 is 12 mm, if the tape width is larger (for example, 18 mm, 24 mm, 36 mm), the height of the case body 38 also accordingly becomes larger, but the width T of the common portion 32 (refer to FIG. 21) is constant. When the tape width is equal to or less than the width T of the common portion 32 (for example, 6 mm, 12 mm), the height (width) of the case body 38 is the width T of the common portion 32+a predetermined width. In that case, the height of the case body 38 (namely the cassette case 31) is at its lowest value.

As shown in FIG. 11 to FIG. 14, a semi-circular groove 42 that is a groove that is roughly semi-circular in a plan view is provided on the front surface of the case body 38, such that it spans the up-down direction (namely from the top wall surface 85 to the bottom wall surface 86) of the case body 38. The semi-circular groove 42 is a cut-out that is provided such that the shaft support portion 12A (refer to FIG. 4) of the platen holder 12 will not interfere with the tape cassette 30 when the tape cassette 30 has been mounted in the cassette mounting portion 8.

The portion of the case body 38 that extends to the left from the semi-circular groove 42 is called an arm front surface wall 35, which forms part of the front surface of the tape cassette 30. The portion that extends to the left from the right side of the case body 38 and that is defined by the arm front surface wall 35 and by an arm rear surface wall 36 that is positioned separately to the arm front surface 35 in the rearward direction and extending in the height direction, is the above-described arm portion 34. The left end of the arm front surface wall 35 is bent toward the rear, and a gap that is formed extending in the up-down direction between the left ends of the arm front surface wall 35 and the arm rear surface wall 36 is the above-mentioned discharge outlet 34A. The printing tape 55 that is pulled out from the tape unit 500 is guided in the arm portion 34, and is discharged from the discharge outlet 34A toward an open portion 77. The open portion 77 is formed between the discharge outlet 34A and the tape discharge portion 49, and is a portion that exposes the printing tape 55.

In the arm front surface wall 35, an identification opening 35A is formed, which is a recessed portion having a notched shape from the top edge of the arm front surface wall 35 in the downward direction. The identification opening 35A is formed extending from slightly on the right side of the discharge outlet 34A to slightly to the left side of the semi-circular groove 42, from the bottom plate (namely, the bottom wall surface 86) of the case body 38 in the upward direction. A notched portion 35B, which extends from the front end portion of the bottom wall surface 86 toward the rear, is formed in the identification opening 35A. When the tape unit 500 is housed in the case body 38, the leading end front wall 525, which will be described later, is fitted into the identification opening 35A, and this will be described in more detail later.

A space that is bounded by the arm rear surface wall 36 and a perimeter wall surface that is provided to the rear of the arm rear surface wall 36, that is roughly rectangular in a plan view, and that extends through the up-down direction of the tape cassette 30 is the above-described head insertion portion 39. The head insertion portion 39 is continuous with the outside on the front side of the tape cassette 30 through the open portion 77 that is the opening provided in the front surface of the tape cassette 30. At the open portion 77, one side of the printing tape 55 that is discharged from the discharge outlet 34A of the arm portion 34 is exposed in front, and the other side is positioned opposite the thermal head 10. The thermal head 10 can perform printing on the printing tape 55 that is exposed at the open portion 77.

A cut out portion 50 that extends through the up-down direction is formed on the right edge portion of the head insertion portion 39, being indented to the right when seen from the head insertion portion 39 in a plan view. When the head holder 74 is inserted into the head insertion portion 39, the cut out portion 50 is a portion that allows the right edge portion of the head holder 74 to escape in the upward direction such that the right edge portion of the head holder 74 (more specifically, the cassette support portion 741) does not come into contact with the case body 38.

A latch oblong hole 139 is provided to the rear of the head insertion portion 39, into which is latched an elastic latch hook body 33C that will be described later. A pair of latch holes 134 are drilled in positions on both sides of a rear wall 38A of the case body 38, into which latch tabs 33B, which will be described later, are respectively latched. In addition, the roller support hole 64, which supports the above-described tape drive roller 46 such that it can rotate freely, is formed between the head insertion portion 39 and the left side wall of the case body 38.

Figure 15:
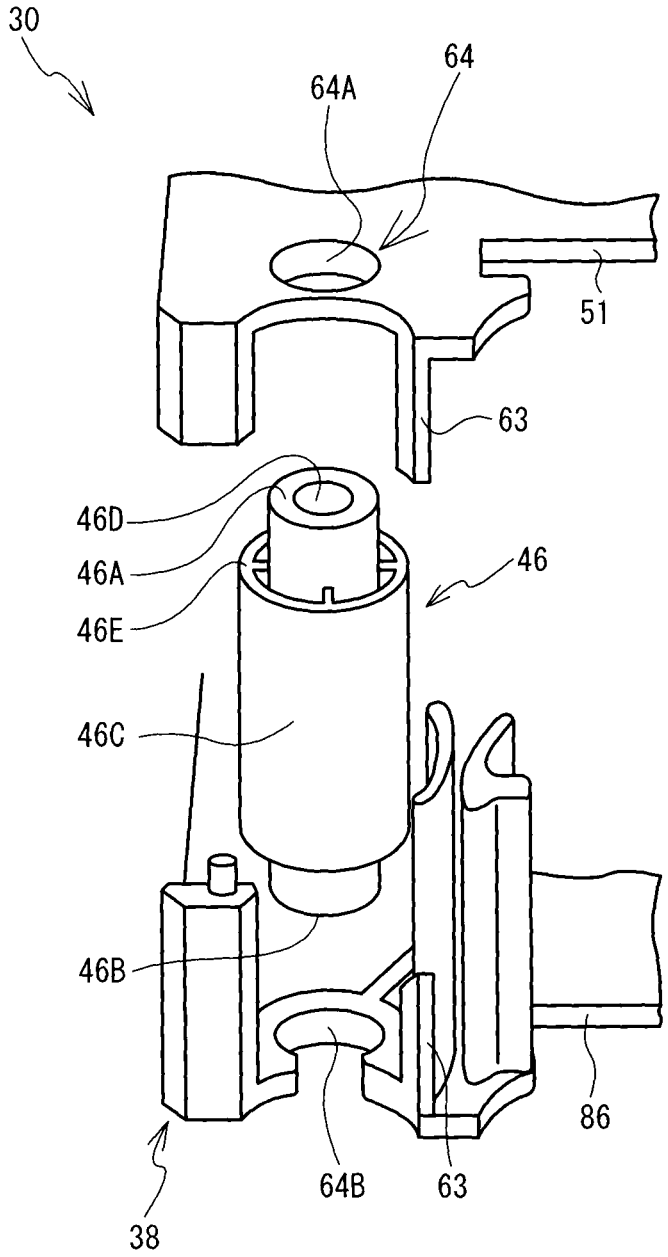
FIG. 15 is an exploded oblique view of a roller support hole 64 and a tape drive roller 46.

As shown in FIG. 15, the roller support hole 64 includes two openings 64A. 64B that are provided opposite each other in the up-down direction. The opening 64A is formed in the auxiliary cover 51 (namely, in the top wall surface 85). The opening 64B is formed in the bottom wall (namely, the bottom wall surface 86) of the case body 38. The above-described restraining members 63 are provided in positions in the vicinity of each of the openings 64A, 64B such that they project in directions opposing each other along the front edge of the cassette case 31. A width between base ends of the pair of restraining members 63 is set to be the same as the tape width of the printing tape 55.

The tape drive roller 46 is a cylindrical body that has substantially the same height as the width dimension of the cassette case 31 (namely, the length in the up-down direction). A diameter of a main body portion 46E of the tape drive roller 46 is larger than the openings 64A, 6413, and an outer perimeter surface of the main body portion 46E is a roller surface 46C that comes into contact with the print medium. The up-down direction length of the roller 46C (namely, a tape feed width) is set to be the same as the tape width of the print medium. A top end portion 46A and a bottom end portion 46B that protrude respectively from the top and the bottom of the main body portion 46E of the tape drive roller 46 each have a diameter that is slightly smaller than the openings 64A, 64B. In the interior of the tape drive roller 46, the two end portions 46A, 46B are linked via a shaft hole 46D that penetrates the main body portion 46E in the up-down direction.

In the interior of the cassette case 31, the top end portion 46A is fitted into the opening 64A, and the bottom end portion 46B is fitted into the opening 64B. The main body portion 46E comes into contact from below with the auxiliary cover 51, thus restraining its movement in the upward direction, and comes into contact with the case body 38 from above, thus restraining its movement in the downward direction. In this way, the tape drive roller 46 is supported by the two end portions 46A, 46B while being able to freely rotate around an axis line inside the cassette case 31.

A plurality of engaging ribs 46F (refer to FIG. 26) are provided on the lower end of an inner perimeter surface (namely, an inside wall forming the shaft hole 46D) of the tape drive roller 46. When the tape cassette 30 is mounted in the cassette mounting portion 8, the above-described tape drive shaft 100 is inserted into the shaft hole 46D via the opening 64B. The plurality of cam members 100A formed around the tape drive shaft 100 mesh with the engaging ribs 46F provided on the tape drive roller 46. In this way, the rotation of the tape drive shaft 100 is transmitted to the tape drive roller 46 (namely, the tape drive roller 46 rotates in accordance with the rotation of the tape drive shaft 100).

As shown in FIG. 14, a tape housing portion 141, which houses the tape spool 40 provided in the tape unit 500 that will be described later, is provided in a left rear portion of the case body 38. When the cassette lid 33 is mounted on the case body 38, the tape housing portion 141 has a depth that houses the tape spool 40, which will be described later, such that it can rotate. The depth of the tape housing portion 141 varies depending on the width of the tape provided in the tape unit 500.

A holder housing portion 142, which houses a tape holder 510 provided in the tape unit 500 that will be described later, is provided in a right portion of the case body 38. The holder housing portion 142 has a depth that is substantially the same as that of the tape housing portion 141 and the arm portion 34. The holder housing portion 142 is a space that is linked to the tape housing portion 141 in the left-right direction, and is also linked to the arm portion 34 in the left-right direction. More specifically, the tape housing portion 141, the holder housing portion 142 and the arm portion 34 are a single space that is linked in the horizontal direction and is open in the upward direction, forming a unit housing portion 140 that houses the tape unit 500.

A tape opening 69, an opening 67B and a third guide forming hole 47C are respectively formed in the bottom wall (specifically, the bottom wall surface 86) of the case body 38. The tape opening 69 is provided in a substantially central position of the tape housing portion 141, and is a hole portion that is positioned opposite the above-described tape support hole 65. The opening 67B is provided to the rear of the arm portion 34, and is a hole portion that forms part of the above-described winding spool support hole 67. The third guide forming hole 47C is provided in a right rear portion of the case body 38, and is a hole portion that forms part of the above-described guide hole 47. The tape opening 69, the opening 67B and the third guide forming hole 47C will be explained separately in more detail later.

A pair of square holes 144, 145 are formed in the bottom wall (specifically, the bottom wall surface 86) of the case body 38, sandwiching a feed path of the printing tape 55 that is wound around the tape spool 40. When the tape cassette 30 is mounted in the cassette mounting portion 8, a photo sensor (not shown in the drawings) which is formed of a photo emitter and a photo receptor and which is provided standing in the cassette mounting portion 8, is fitted into the pair of square holes 144, 145. When tape printing is performed, the printing tape 55 that is pulled from the tape spool 40 is detected by the photo sensor (not shown in the drawings).

Figure 16:
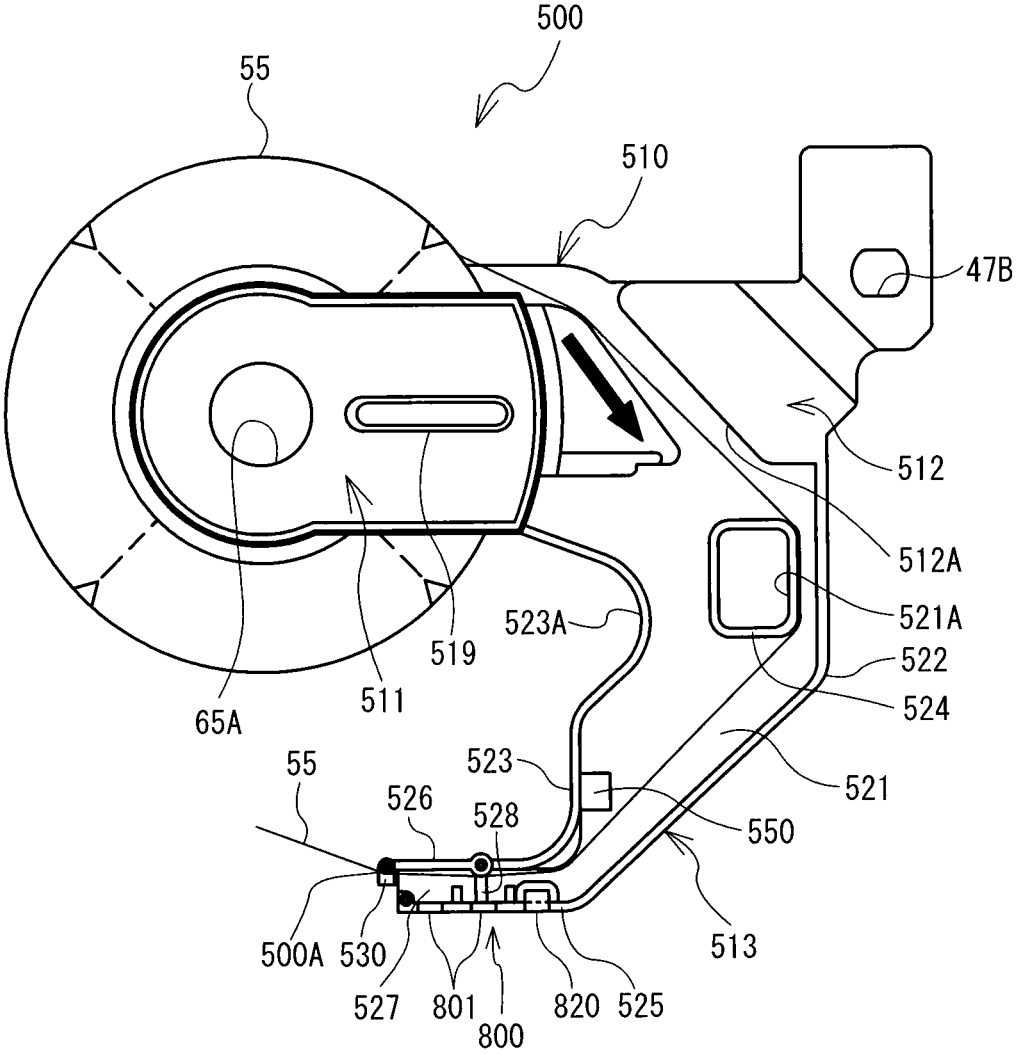
FIG. 16 is a plan view of a tape unit 500.

The tape unit 500 will be explained with reference to FIG. 13 and FIG. 16 to FIG. 18. As shown in FIG. 13 and FIG. 16, the tape unit 500 has the tape spool 40, on which the printing tape 55 is wound, and the tape holder 510 that rotatably supports the tape spool 40.

The tape spool 40 is a cylindrical body that has a shaft hole 40A formed penetrating in the up-down direction through its interior and that has substantially the same height dimension as the tape width of the printing tape 55. The printing tape 55 is a heat-sensitive paper tape having a base tape, one surface of which is formed of a heat-sensitive color developing layer, while a release paper is adhered via an adhesive layer to the other side. The printing tape 55 is wound around the outer peripheral surface of the tape spool 40, with the heat-sensitive color developing layer facing toward the inside.

The tape holder 510 is a plate-shaped member made of synthetic resin that has substantially the same shape as the unit housing portion 140 of the case body 38 in a plan view. The tape holder 510 has a rotation support portion 511, a connecting portion 512, a guide portion 513 and a lower spool 580. The rotation support portion 511 extends in a plan view from the shaft hole 40A of the tape spool 40 toward the outer diameter side (in the right direction in FIG. 16), and is opposed to and supports the top side surface of the printing tape 55 that is wound around the tape spool 40. An opening 65A is formed in an edge portion of the left end of the rotation support portion 511 such that it faces the winding center of the printing tape 55 (namely, the shaft hole 40A). An observation window 519 is formed in the rotation support portion 511, extending in the radial direction of the wound part of the printing tape 55 (here, to the right as seen from the opening 65A).

Figure 17:
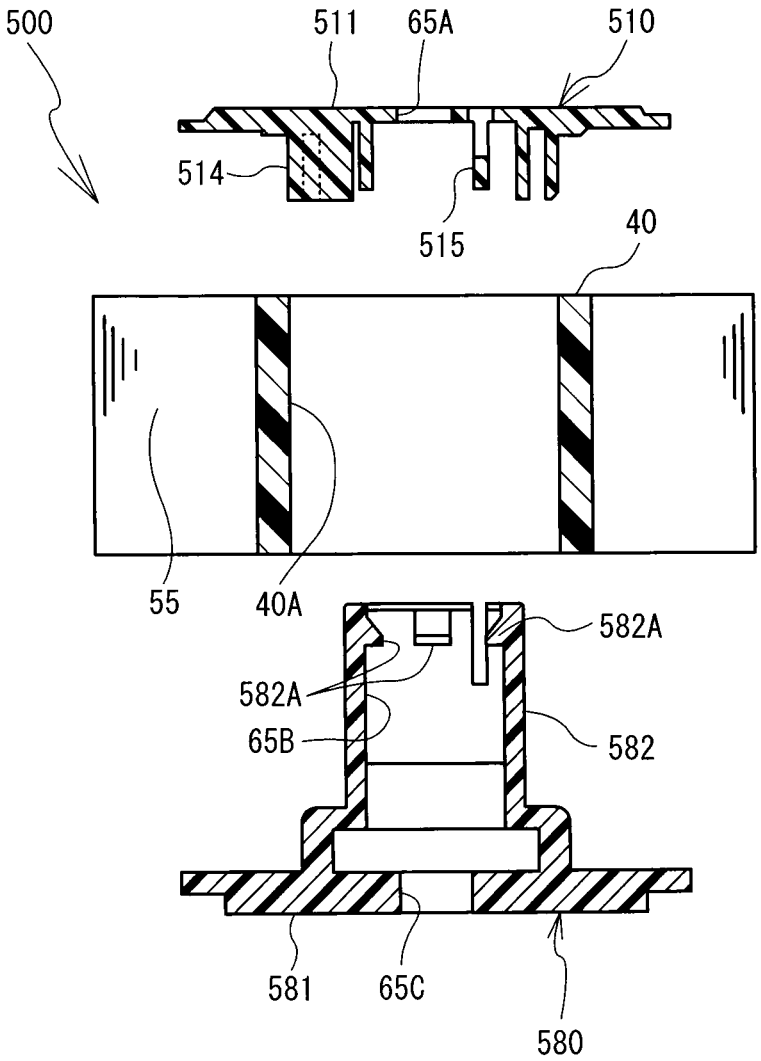
FIG. 17 is a longitudinal section view of the tape unit 500 in a state of being separated.
Figure 18:
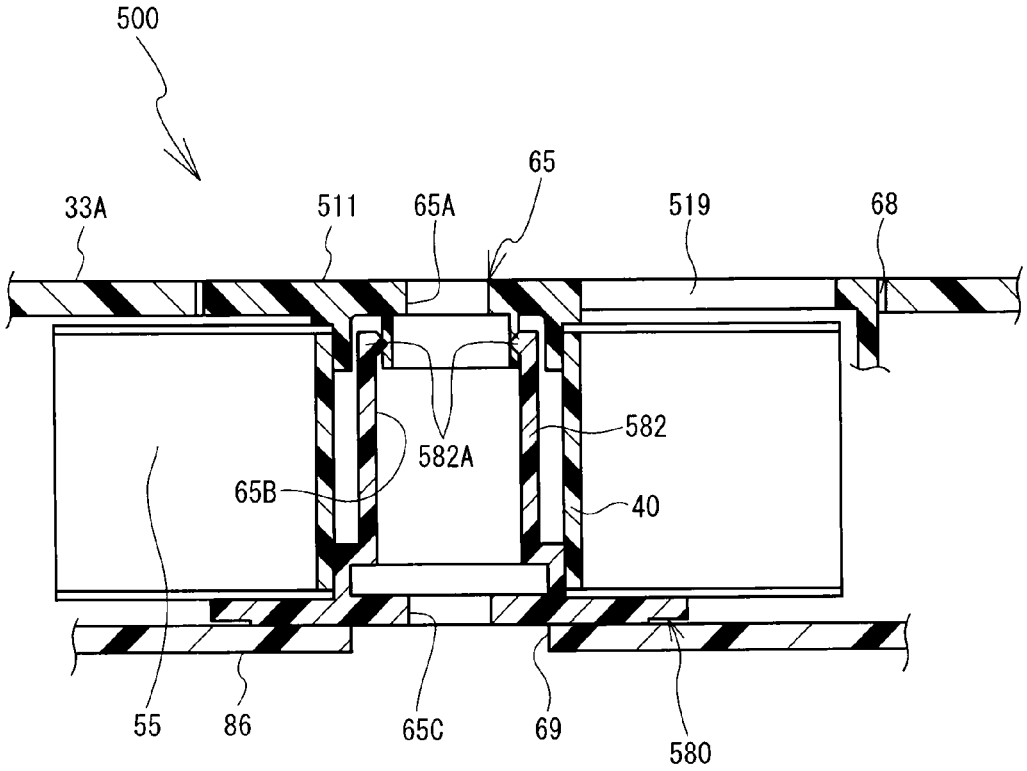
FIG. 18 is a longitudinal section view of the tape unit 500 in a state of being assembled.

As shown in FIG. 17 and FIG. 18, a projecting seat portion 514, which fits into the shaft hole 40A of the tape spool 40, is provided projecting downward from the bottom surface side of the rotation support portion 511. A plurality of latch holes 515 are provided in the outer periphery of the projecting seat portion 514. A plurality of latch tabs 582A are provided, projecting inwardly, on the inner wall surface of a cylinder portion 582 that protrudes in the upward direction from a flange portion 581 on the lower spool 580. The rotation support portion 511 and the lower spool 580 are coupled to each other when the cylinder portion 582 is inserted into the shaft hole 40A and each of the latch tabs 582A are latched into the corresponding latch holes 515. The tape spool 40 is held such that it is rotatable around the cylinder portion 582 in a gap between the rotation support portion 511 and the lower spool 580.

The lower spool 580 has a shaft hole 65B that penetrates in the up-down direction, and an opening 65C that is linked to the shaft hole 65B and opens in the downward direction. As described above, in a state in which the rotation support portion 511 and the lower spool 580 are coupled while sandwiching the tape spool 40 on which the printing tape 55 is wound (namely, in a state in which the tape unit 500 is assembled), the opening 65A, the shaft hole 65B and the opening 65C form the tape support hole 65 that is a penetrating hole linked in the up-down direction.

As shown in FIG. 13 and FIG. 16, the connecting portion 512 stretches along the right end portion of the rotation support portion 511 via a step and extends from the right end portion of the rotation support portion 511 toward the outer diameter side (toward the right side in FIG. 16). A guide groove 512A, which has a generally U shape in cross section and which guides the printing tape 55 that has been pulled from the tape spool 40 in the front right direction, is formed in substantially a center portion in the left-right direction of the connecting portion 512. A second guide forming hole 47B, which is part of the above-described guide hole 47, is formed penetrating in the up-down direction in the right end edge portion of the connecting portion 512. The second guide forming hole 47B will be described in more detail later.

The guide portion 513 extends from the connecting portion 512 along a winding direction (in the left downward direction in FIG. 16) of the printing tape 55 that is supported by the tape spool 40. In the interior of the guide portion 513, the printing tape 55 that has come via the guide groove 512A is guided to a discharge outlet 500A that is provided furthermost downstream in the tape feed direction in the tape holder 510. The guide portion 513 includes a bottom side guide wall 521, a front side guide wall 522, a rear side guide wall 523 and an inner side guide wall 524.

The bottom side guide wall 521 is a wall portion that is positioned opposite to the bottom edge of the printing tape 55 that is fed within the guide portion 513, and stretches at the same height as the bottom surface of the guide groove 512A. The bottom side guide wall 521 extends along the tape feed direction from the connecting portion 512 in the left frontward direction (the left downward direction in FIG. 16). A square hole 521A is formed in the bottom side guide wall 521 and it overlaps with the above-described square hole 144 when the tape unit 500 is housed in the interior of the case body 38. The inner side guide wall 524 is a wall portion that is provided in a vertical orientation along the square hole 521A, at a height corresponding to the tape width of the printing tape 55.

The front side guide wall 522 and the rear side guide wall 523 are wall portions provided in a vertical orientation along both edges of the bottom side guide wall 521, at a height corresponding to the tape width of the printing tape 55. In other words, the front side guide wall 522 and the rear side guide wall 523 are provided in parallel to a surface of the printing tape 55 that is pulled from the tape spool 40, and also along the feed path of the printing tape 55 in the guide portion 513. More specifically, as seen from the tape support hole 65 (refer to FIG. 18), the front side guide wall 522 is provided further toward the outer diameter side than the printing tape 55 that is guided on top of the bottom side guide wall 521. As seen from the tape support hole 65 (refer to FIG. 18), the rear side guide wall 523 is provided further toward the inner diameter side than the printing tape 55 that is guided on top of the bottom side guide wall 521. Note that a base portion side (the top side in FIG. 16) of the rear side guide wall 523 is a curved portion 523A that curves along an outer contour of the opening 67B in a plan view, when the tape unit 500 is housed in the interior of the case body 38.

The leading end of the front side guide wall 522 is the leading end front wall 525 that extends in parallel (in the left-right direction in FIG. 16) to the direction in which the connecting portion 512 extends. The leading end of the rear side guide wall 523 is a leading end rear wall 526 that extends in parallel to the leading end front wall 525 on the rear side (the top side in FIG. 16) of the leading end front wall 525. The leading end of the bottom side guide wall 521 is a leading end bottom wall 527 that is sandwiched between the leading end front wall 525 and the leading end rear wall 526. Specifically, the leading end front wall 525, the leading end rear wall 526 and the leading end bottom wall 527 are provided on the downstream side in the tape feed direction in the guide portion 513. An interval between the leading end front wall 525 and the leading end rear wall 526 (the length of the leading end bottom wall 527 in the front-rear direction) is smaller than the length in the front-rear direction of the arm portion 34. A gap that extends in the up-down direction that is formed between the respective left ends of the leading end front wall 525 and the leading end rear wall 526 is the above-described discharge outlet 500A.

The leading end front wall 525 has a width (the length in the left-right direction) and height (the length in the up-down direction) that substantially match the width and height of the above-described identification opening 35A. When the tape unit 500 is housed in the case body 38, the leading end front wall 525 is fitted into the identification opening 35A, thus forming part of the front surface of the cassette case 31 along with the arm front surface wall 35. The arm indicator portion 800 and the latch hole 820 are provided in the leading end front wall 525 and these will be described in more detail later.

The printing tape 55 that is pulled from the tape spool 40 is fed from the above-described guide groove 512A in the right frontward direction (the right downward direction in FIG. 16) and is guided between the front side guide wall 522 and the inner side guide wall 524. After moving along the right all of the inner side guide wall 524, the printing tape 55 is fed in the left frontward direction and is guided between the leading end front wall 525 and the leading end rear wall 526. After moving along the right end wall of the leading end rear wall 526, the printing tape 55 is fed in the leftward direction and discharged from the discharge outlet 500A. A bottom restraining portion 528 and a top restraining portion 530, which restrain movement of the printing tape 55 in the width direction, are provided on the leading end of the guide portion 513.

The bottom restraining portion 528 is a protrusion that protrudes slightly upward in a substantially central position in the left-right direction of the leading end bottom wall 527 and that extends in the front-rear direction over the leading end front wall 525 and the leading end rear wall 526. The top restraining portion 530 is a protruding piece that is provided on the top edge of the left end portion of the leading end rear wall 526 and that protrudes toward the front from the leading end rear wall 526. The bottom restraining portion 528 and the top restraining portion 530 respectively restrain the downward movement and the upward movement of the printing tape 55 that is guided between the leading end front wall 525 and the leading end rear wall 526. A distance in the up-down direction between the bottom restraining portion 528 and the top restraining portion 530 is the same as the width of the printing tape 55.

The bottom side guide wall 521 is provided with a support receiving portion 550 that is used to position the tape cassette 30 in the up-down direction when the tape cassette 30 is mounted in the tape printer 1. More specifically, the support receiving portion 550 is formed in a position that overlaps with the above-described cut out portion 50 (refer to FIG. 14) when the tape unit 500 is housed in the case body 38. The support receiving portion 550 is a recessed portion that formed by causing the bottom side guide wall 521 to be recessed upward, and that is also recessed to the right from the rear side guide wall 523.

The support receiving portion 550 has a support surface 550A that is a flat surface portion (a bottom section of the recessed portion) positioned above the bottom side guide wall 521. The distance between the position of the support surface 550A in the up-down direction (height direction) of the tape holder 510, and the central position in the width direction of the printing tape 55 housed in the cassette case 31 are constant, irrespective of the type of tape of the tape cassette 30, namely, even when the height of the tape holder 510 differs in the up-down direction. Thus, the larger the width of the printing tape 55 housed in the tape cassette 30, the greater the depth of the support receiving portion 550 as seen from the bottom side guide wall 521. Note that the support surface 550A is in a position that is separated an equal distance in the up-down direction from the central position in the width direction of the printing tape 55. More specifically, the support surface 550A is in the same height position in the tape holder 510. In the present embodiment, the central position in the width direction of the printing tape 55 and the central position in the up-down direction of the tape holder 510 match each other.

When the tape cassette 30 is mounted in the cassette mounting portion 8, the support surface 550A also functions as a portion that is supported from underneath by the cassette support portion 741 that is provided on the head holder 74. In addition, the support surface 550A is a reference surface for the tape holder 510. The reference surface is a surface that is used as a reference when setting dimensions and measuring dimensions of certain portions. In the present embodiment, the support surface 550A is provided as the reference surface with respect to the restraining portions (the bottom restraining portion 528 and the top restraining portion 530) that restrain the movement of the printing tape 55 in the width direction.

Expressed another way, the height positions of the bottom restraining portion 528 and the top restraining portion 530 in the up-down direction of the tape holder 510 are set using the support surface 550A as the reference surface. More specifically, a distance in the up-down direction between the projecting edge (the top edge) of the bottom restraining portion 528 and the support surface 550A and a distance in the up-down direction between the bottom edge of the top restraining portion 530 and the support surface 550A are set in accordance with the width of the tape. The restraining portions are in positions close to the support surface 550A that is the reference surface.

In known art, reference positions (for example, the bottoms of the pin holes 52. 53) that are used for setting the dimensions of the restraining portions and for measuring the dimensions after manufacture are in positions that are distant from the restraining portions, so the reference positions and the restraining portions are sometimes formed by different parts of the die. In those cases, the further away the part of the die of the reference position, the greater the dimensional errors of the restraining portions in the manufactured tape holder 510. Even if formed by the same part of the die, if the reference positions and the restraining portions are in positions distant from each other, measurement errors may occur, and dimensional accuracy may decrease. If the distance between the restraining portions and the reference surfaces is made shorter, as in the present embodiment, measurement errors decrease and there is a higher possibility of forming both the restraining portions and the reference surfaces using the same part of the die.

In addition, after the manufacture of the tape unit 500, dimensional control of each of the restraining portions can be performed easily using the support surface 550A as the reference. For example, at the time of inspection of the tape unit 500, the support surface 550A that is the reference surface is placed on a mounting surface of a jig, and dimensional measurement of each of the restraining portions is performed, at this time, because the distances between each of the restraining portions and the reference surface is shorter than in known art, an inspector can accurately measure the dimensions.

Further, the support surface 550A is provided at a constant distance in the up-down direction from a central position in the width direction of the tape held on the tape spool 40. Thus, the position in the up-down direction of the tape with respect to the position in the up-down direction of the support surface 550A is more accurate, and tape feed accuracy is further improved. In addition, in the present embodiment, the distance between the central position in the width direction of the tape and the support surface 550A is constant, irrespective of the tape width. Thus, with respect to a plurality of types of the tape units 500 that house tapes having different tape widths. the position of the support surface 550A can be made a comprehensive reference, and dimensional measurement and parts control of the tape holder 510 can be performed easily.

The cassette lid 33 will be explained with reference to FIG. 11 to FIG. 13. The cassette lid 33 is a rectangular plate-shaped member that has substantially the same shape and size as a portion that occupies the area of the case body 38 to the rear of the head insertion portion 39. A pair of latch tabs 33B are provided projecting in the downward direction in positions on both the left and right sides on the rear edge of the cassette lid 33. The elastic latch hook body 33C that has a generally U shape in a side view is provided, extending the cassette lid 33 in the downward direction from the top plate 33A, in a substantially central position in the left-right direction of the front edge of the cassette lid 33. A knob that is curved in the upward direction is formed on the leading end of the elastic latch hook body 33C.

A support opening 68, an opening 67A and a first guide forming hole 47A etc. are formed in the cassette lid 33, penetrating the top plate 33A in the up-down direction. The support opening 68 is an opening that is provided in a position facing the above-described tape housing portion 141 and that has a shape corresponding to the above-described rotation support portion 511. The opening 67A is provided in the front portion of the cassette lid 33 and is a hole portion that forms part of the above-described winding spool support hole 67. The first guide forming hole 47A is provided in the right rear portion of the cassette lid 33, and is a hole portion that forms part of the above-described guide hole 47. The support opening 68, the opening 67A and the first guide forming hole 47A will be described separately in detail later.

As shown in FIG. 13, when the tape cassette 30 is assembled, the tape unit 500 is housed in the unit housing portion 140 of the case body 38 from above. In this way, the tape spool 40 is housed in the tape housing portion 141 and the tape holder 510 is also housed in the holder housing portion 142, as shown in FIG. 5 and FIG. 6. The square hole 144 of the case body 38 is linked to the square hole 521A of the tape holder 510 in the up-down direction. The opening 67B of the case body 38 is exposed in the upward direction as it is not covered by the curved portion 523A of the tape holder 510.

Figure 19:
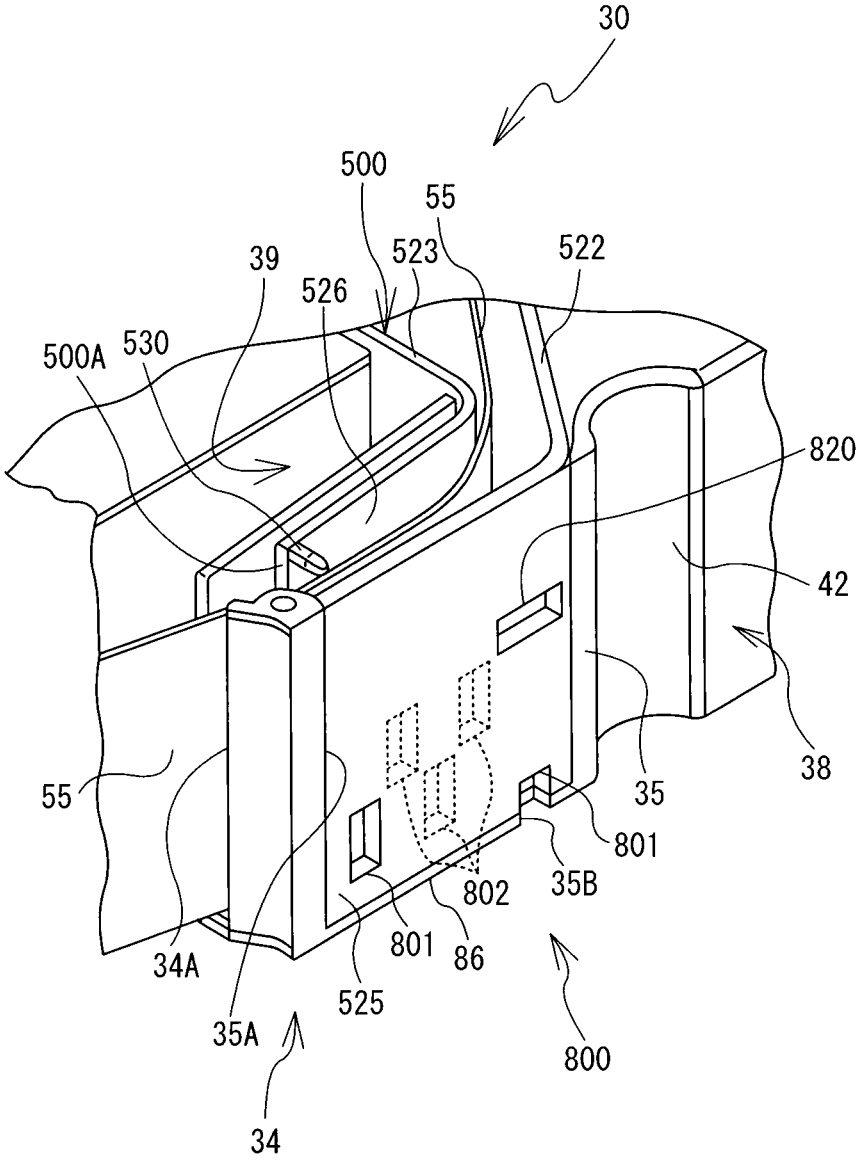
FIG. 19 is an enlarged oblique view of an arm portion 34 of the tape cassette 30.

In addition, as shown in FIG. 19, the leading end (the leading end front wall 525, the leading end rear wall 526 and the leading end bottom wall 527) of the guide portion 513 (refer to FIG. 13) is housed inside the arm portion 34 and the leading end front wall 525 is fitted into the identification opening 35A of the case body 38 from above. In this way, the arm indicator portion 800 and the latch hole 820 provided in the leading end front wall 525 are exposed to the front from inside the case body 38 (more specifically, the arm portion 34).

As shown in FIG. 12, when the tape unit 500 is housed in the case body 38, the tape support hole 65 (refer to FIG. 18) of the tape unit 500 is exposed underneath the tape cassette 30 via the tape opening 69. The support surface 550A of the tape holder 510 is exposed underneath via the cut out portion 50 of the case body 38. Note that, when the tape cassette 30 is mounted in the cassette mounting portion 8, the support surface 550A is positioned on an outer periphery of the head insertion portion 39 and faces the head insertion portion 39. Specifically, the support surface 550A is positioned on the upstream side in the tape feed direction, taking as a reference an insertion position (more specifically, the printing position) of the thermal head 10 (refer to FIG. 5 and FIG. 6).

Figure 20:
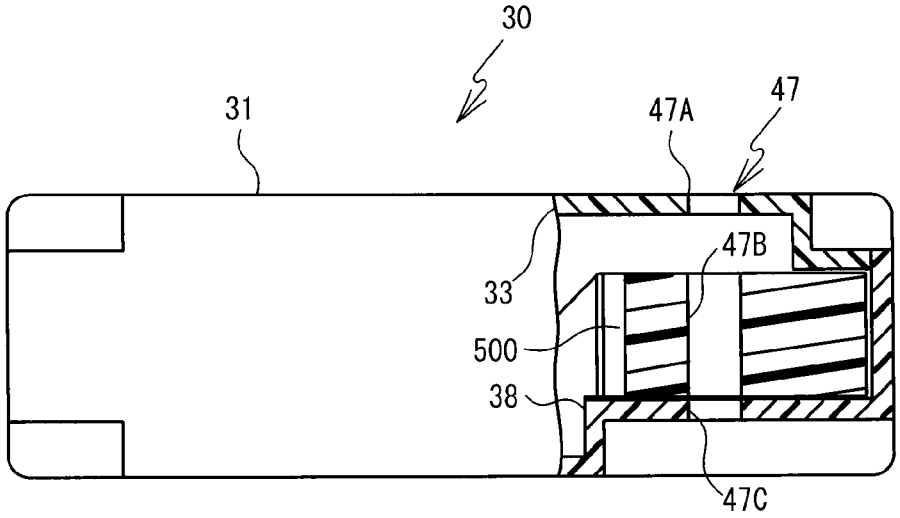
FIG. 20 is a right side view of the tape cassette 30 that shows a partial cross section of a guide hole 47.

When the tape unit 500 is housed in the case body 38, the tape cassette 30 is assembled by attaching the cassette lid 33. Thus, as shown in FIG. 3 and FIG. 13, the opening 67A of the cassette lid 33 and the opening 67B of the case body 38 are positioned opposite each other, and the winding spool support hole 67 that penetrates the cassette case 31 in the up-down direction is formed. The rotation support portion 511 of the tape unit 500 is fitted into the support opening 68 of the cassette lid 33. Via the support opening 68, the observation window 519 is exposed such that it can be viewed from above the tape cassette 30. As shown in FIG. 20, the first guide forming hole 47A of the cassette lid 33, the second guide forming hole 47B of the tape unit 500, and the third guide forming hole 47C of the case body 38 are linked and thus form the guide hole 47 that penetrates the cassette case 31 in the up-down direction.

The arm indicator portion 800 and the latch hole 820 will be explained in detail with reference to FIG. 19 and FIG. 21. The arm indicator portion 800 includes either a non-pressing portion 801 or a pressing portion 802 in each of the positions that respectively correspond to the above-described detection switches 210. Apart from a case in which the non-pressing portion 801 is formed along the bottom edge of the leading end front wall 525, the non-pressing portion 801 is a switch hole that has a vertically long rectangular shape in a front view and into which the switch terminal 222 can be inserted and removed. The pressing portion 802 is a surface portion into which the switch terminal 222 cannot be inserted and removed. The arm indicator portion 800 of the present embodiment has either the non-pressing portion 801 or the pressing portion 802, in positions corresponding to five locations of the five detection switches 210.

The non-pressing portion 801 and the pressing portion 802 are arranged in a specific pattern depending on the tape type of the tape cassette 30. The latch hole 820 is provided in the upper right of the leading end front wall 525 and is a through hole with a horizontally long rectangular shape in a plan view. Hereinafter, when the non-pressing portion 801 and the pressing portion 802 are collectively referred to, or when it is not specified which is which, they are simply referred to as an indicator portion.

The arm indicator portion 800 may include, as the indicator portion, at least one hole portion (the non-pressing portion 801 in the present embodiment), and indicate the type of tape. In the present embodiment, the arm indicator portion 800 is provided on the front side guide wall 522 (specifically, the leading end front wall 525) of the tape unit 500. As a result, by providing the arm indicator portion 800 on the wall portion (the leading end front wall 525 in the present embodiment) that guides the printing tape 55, it is not necessary for the tape unit 500 to be provided with a dedicated part in order to provide the arm indicator portion 800.

At least some of the indicator portions (the non-pressing portion 801 and the pressing portion 802) of the arm indicator portion 800 is provided within a range of a height T1 on the leading end front wall 525. More preferably, at least some of the indicator portions (the non-pressing portion 801 and the pressing portion 802) is provided within a common indicator portion 831 that is symmetrical in the up-down direction with respect to the center line N in the up-down (height) direction of the cassette case 31 on the leading end front wall 525.

The predetermined height T1 is a height dimension of the tape cassette 30 that has a minimum height, among the plurality of heights of the tape cassette 30. The area within the range of the predetermined height T1 on the leading end front wall 525 is referred to as the common indicator portion 831. Note that, with a wide width cassette with the cassette case 31 that has a height larger than the predetermined height T1, the indicator portion may be further provided in at least one of either above or below the common indicator portion 831.

The arm indicator portion 800 of the present embodiment includes five indicator portions 800A to 800E that are provided within the common indicator portion 831. The five indicator portions 800A to 800E are provided in three rows within the range of the height T1 of the common indicator portion 831, and positions of each of the indicator portions are different in the left-right direction. In other words, the five indicator portions 800A to 800E are arranged in a zigzag pattern such that they do not overlap in the up-down direction. Thus, a line that joins each of the indicator portions 800A to 800E intersects with the direction in which the tape cassette 30 is mounted and removed (namely, the up-down direction).

More specifically, in the common indicator portion 831, from the left side toward the right side, the five indicator portions 800A to 800E are arranged at substantially equal intervals in order of the non-pressing portion 801, the pressing portion 802, the pressing portion 802, the pressing portion 802 and the non-pressing portion 801. These five indicator portions 800A to 800E are arranged in three rows in the common indicator portion 831. The second and the fourth indicator portions 800B and 800D from the left side form a top row, the first and the third indicator portions 800A and 800C from the left side form a middle row and the fifth indicator portion 800E from the left side forms a bottom row. The indicator portion 800E of the present embodiment is the non-pressing portion 801 that is formed along the bottom edge of the leading end front wall 525. Thus, the non-pressing portion 801 corresponding to the indicator portion 800E has a length in the up-down direction that is smaller than that of the other non-pressing portion 801 (the indicator portion 800A), and is a notch that has a substantially square shape in a plan view.

The latch hole 820 is provided in a position corresponding to the above-described latch piece 225, and is a through hole that has a rectangular shape in a plan view with long sides in the left-right direction. The latch hole 820 of the present embodiment is provided above all the indicator portions of the arm indicator portion 800 and extends to the right from a position in the left-right direction that is substantially equal to that of the indicator portion positioned furthest to the right (the non-pressing portion 801 in the bottom row in the example shown in FIG. 21).

An arrangement pattern of the indicator portions (the non-pressing portion 801 and the pressing portion 802) of the arm indicator portion 800 is based on predetermined rules depending on the tape type. More specifically, the width (seven types from 3.5 mm to 36 mm, for example) of the tape housed in the tape cassette 30 is indicated by a combination of each of the non-pressing portion 801 and the pressing portion 802 of the indicator portions 800A, 800B and 800E. A printing format (normal image printing or mirror image printing, for example) of the tape housed in the tape cassette 30 is indicated by whether the indicator portion 800C is the non-pressing portion 801 or the pressing portion 802. Color information (whether a printing color is black or a color other than black, for example) of the tape housed in the tape cassette 30 is indicated by whether the indicator portion 800D is the non-pressing portion 801 or the pressing portion 802. By arranging the indicator portions of the arm indicator portion 800 in accordance with predetermined rules depending on the tape type in this way, a person can recognize the tape type by visually checking the arm indicator portion 800.

In the tape unit 500 of the present embodiment, the arm indicator portion 800 is disposed in the leading end front wall 525 that is positioned radially outside the tape spool 40 as seen from the shaft hole 40A. As a result, at the time of manufacture of the tape unit 500, for example, by checking the tape type indicated by the arm indicator portion 800 before the tape spool 40 is installed in the tape holder 510, an operator can recognize the type of the tape that should be installed in the tape holder 510. In addition, as the leading end front wall 525 is adjacent to the discharge outlet 500A, the operator can visually check the tape being pulled from the discharge outlet 500A at the same time as visually checking the arm indicator portion 800. Thus, after the tape spool 40 has been installed in the tape holder 510, the operator can verify whether or not the type of the tape being pulled from the discharge outlet 500A matches the tape type indicated by the arm indicator portion 800.

In the tape cassette 30 of the present embodiment, when the tape unit 500 is housed in the case body 38, the leading end front wall 525 is inserted into the identification opening 35A. As a result, at the time of manufacture of the tape cassette 30, for example, by checking the tape type indicated by the arm indicator portion 800 before housing the tape unit 500 in the case body 38, the operator can recognize the type of the tape that is installed in the tape holder 510. In addition, as the identification opening 35A is adjacent to the discharge outlet 34A, the user can visually check the tape being pulled from the discharge outlet 34A at the same time as visually checking the arm indicator portion 800. Thus, after the tape unit 500 has been housed in the case body 38, the operator can verify whether or not the type of the tape being pulled from the discharge outlet 34A matches the tape type indicated by the arm indicator portion 800.

This similarly applies to a case in which the user replaces the tape unit 500 being housed in the case body 38. Namely, before the tape unit 500 being housed in the case body 38 is replaced, the user can recognize the type of the tape installed in the new tape holder 510 by referring to the arm indicator portion 800. After the tape unit 500 has been housed in the case body 38, the operator can verify whether or not the type of the tape being pulled from the discharge outlet 34A matches the tape type indicated by the arm indicator portion 800. By providing the arm indicator portion 800 on the tape unit 500 in the manner described above, it is possible to inhibit the wrong type of tape from being housed in the cassette case 31.

It should be noted that, when the length of the arm indicator portion 800 in the up-down direction is smaller than a predetermined width, the indicator portion 800E that is provided bottom-most among the plurality of indicator portions 800A to 800E may have a smaller length in the up-down direction than the remaining indicator portions 800A to 800D. If this is the case, although the indicator portion 800E is the non-pressing portion 801, the switch terminal 222 of the detection switch 210 positioned opposite to the indicator portion 800E may come into contact with a bottom plate (namely, the bottom wall surface 86) of the case body 38 and may mistakenly be in the on state.

Figure 21:
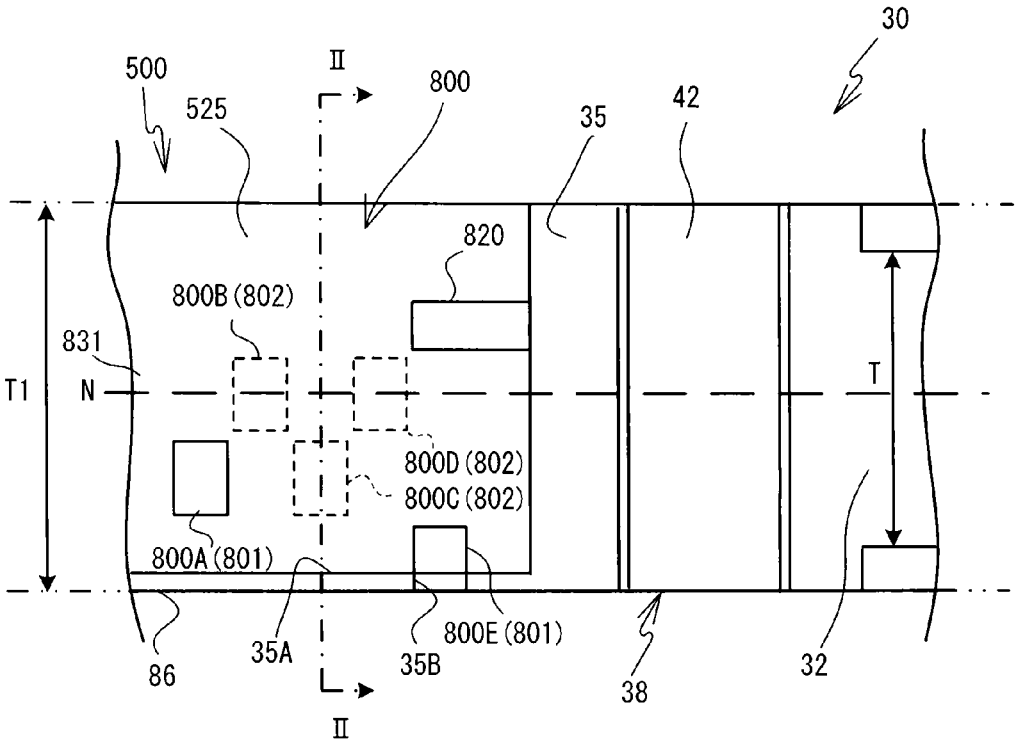
FIG. 21 is an enlarged front view of an arm front surface wall 35 of the tape cassette 30.

In the present embodiment, when the indicator portion 800E is the non-pressing portion 801, when the leading end front wall 525 is mounted in the identification opening 35A, this non-pressing portion 801 is linked in the up-down direction with the notch 35B that is formed in the identification opening 35A (refer to FIG. 19 and FIG. 21). In this way, even if the length in the up-down direction of the indicator portion 800E is smaller than the other indicator portions 800A to 800D, the detection switch 210 that is positioned opposite the indicator portion 800E does not come into contact with the bottom wall surface 86 and is correctly inserted into the non-pressing portion 801.

On the other hand, when the length of the arm indicator portion 800 in the up-down direction is larger than the predetermined width, the indicator portion 800E has the same length in the up-down direction as the other indicator portions 800A to 800D. Therefore, when the indicator portion 800E is the non-pressing portion 801, similarly to a case in which the other indicator portions 800A to 800D are the non-pressing portion 801, it is possible to have the hole that is open in the front surface of the tape cassette 30 only.

The positional relationships of various portions that are provided in the tape cassette 30 of the present embodiment will be explained with reference to FIG. 11 and FIG. 12. The broken line in FIG. 11 and FIG. 12 indicates a parting line K, which will be described later.

The roller support hole 64 is formed in a first hole forming area 30A that includes the fourth corner portion 324 positioned to the left front of the tape cassette 30. The first hole forming area 30A is adjacent to the left side of the head insertion portion 39 that is provided in the center of the front portion of the tape cassette 30. In other words, the first hole forming area 30A is positioned farther to the downstream side in the tape feed direction than is the head insertion portion 39. When the tape cassette 30 is mounted in its correct position in the cassette mounting portion 8, the fourth corner portion 324 included in the first hole forming area 30A is positioned opposite the above-described first shaft installation area 8C (refer to FIG. 4).

The guide hole 47 is formed in a second hole forming area 30B that includes the second corner portion 322 positioned to the right rear of the tape cassette 30. In other words, when the tape cassette 30 is seen in a plan view, the second hole forming area 30B and the first hole forming area 30A are positioned diagonally opposite one another. Thus, when the tape cassette 30 is mounted in its correct position in the cassette mounting portion 8, the second corner portion 322 included in the second hole forming area 30B is positioned opposite the above-described second shaft installation area 8D (refer to FIG. 4).

In a case where the tape cassette 30 is divided in a plan view along the parting line K that links the roller support hole 64 and the guide hole 47 in a plan view, the area to the rear of the parting line K is a first housing area 30C, and the area to the front of the parting line K is a second housing area 30D. The tape support hole 65 is formed at or near the center of gravity of the first housing area 30C (that is, at the point where the median lines for the three sides that form the first housing area 30C intersect), which forms a triangular shape in a plan view. The winding spool support hole 67 is formed at or near the center of gravity of the second housing area 30D (that is, at the point where the median lines for the three sides that form the second housing area 30D intersect), which forms a triangular shape in a plan view. Here, in a plan view, the tape support hole 65 and the winding spool support hole 67 are positioned substantially symmetrically in relation to the parting line K.

Due to the positional relationships that are described above, the weight distribution in the tape cassette 30 according to the present embodiment is as hereinafter described. As described above, in the interior of the tape cassette 30, the first tape spool 40 is rotatably supported by the tape support hole 65. This means that at least the rotational center of the first tape spool 40 (that is, the shaft hole 40A) is provided within the range of the first housing area 30C in a plan view. In other words, this means that the center of gravity of the printing tape 55 that is wound around the first tape spool 40 is positioned within the range of the first housing area 30C in a plan view.

As the tape cassette 30 of the present embodiment is not provided with another printing medium and ink ribbon, the weight of the first housing area 30C in which the center of gravity of the printing tape 55 is positioned is greater than the weight of the second housing area 30D. With the tape cassette 30 that has this kind of weight distribution, if, for example, the user pinches both the right and the left sides of the side wall 87 with his/her fingers, it is easy for the tape cassette 30 to tilt diagonally downwards to the side of the first housing area 30C, with the parting line K as the rotational center.

However, when the tape cassette 30 is mounted in the cassette mounting portion 8, the three guide shafts (the tape drive shaft IOU, the guide shaft 120 and the auxiliary shaft 110) provided in a vertical orientation in the cassette mounting portion 8 arc respectively inserted into the three guide holes (the roller support hole 64, the guide hole 47 and the tape support hole 65) provided in the tape cassette 30. The tape cassette 30 is guided into the correct position in the cassette mounting portion 8 along each of the guide shafts that are inserted into each of the guide holes.

Figure 22:
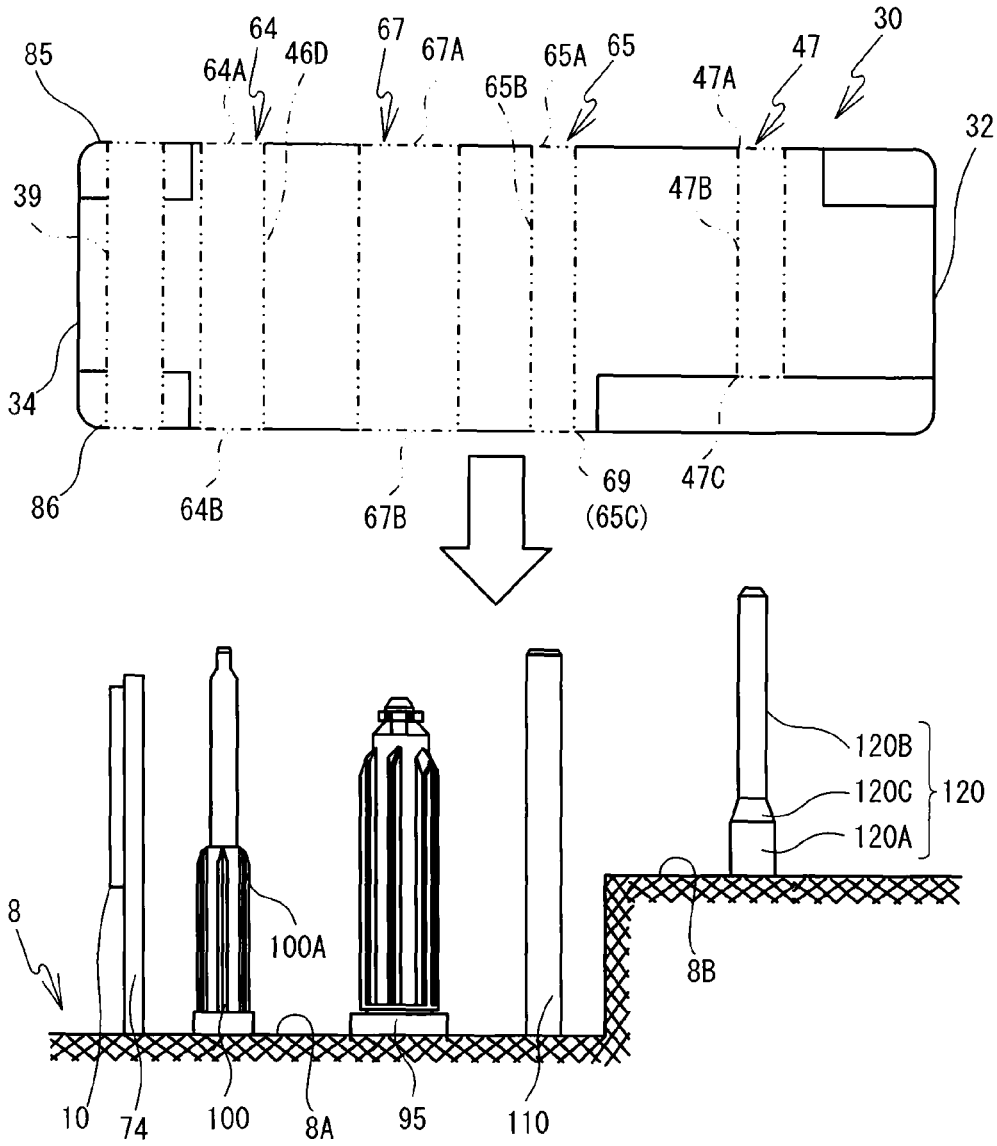
FIG. 22 is an explanatory diagram of the cassette mounting portion 8 before the tape cassette 30 is mounted, as seen from the right side.
Figure 23:
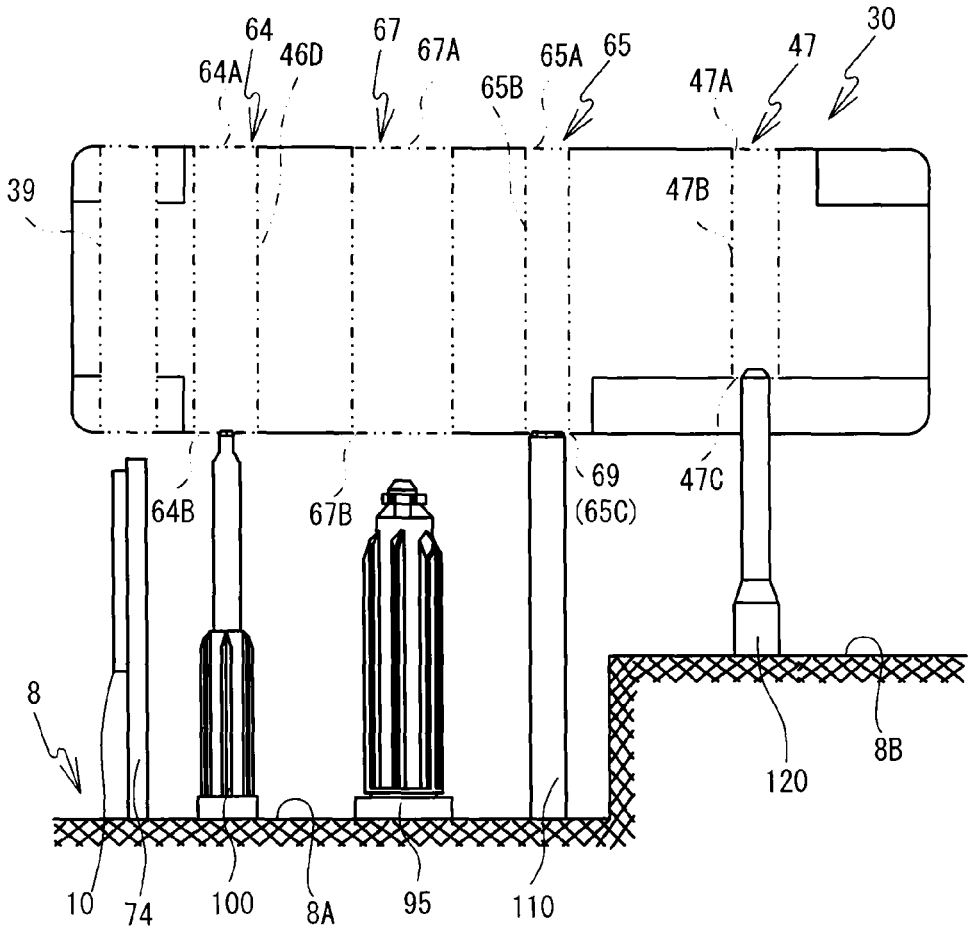
FIG. 23 is an explanatory diagram of the cassette mounting portion 8 while the tape cassette 30 is being mounted, as seen from the right side.
Figure 24:
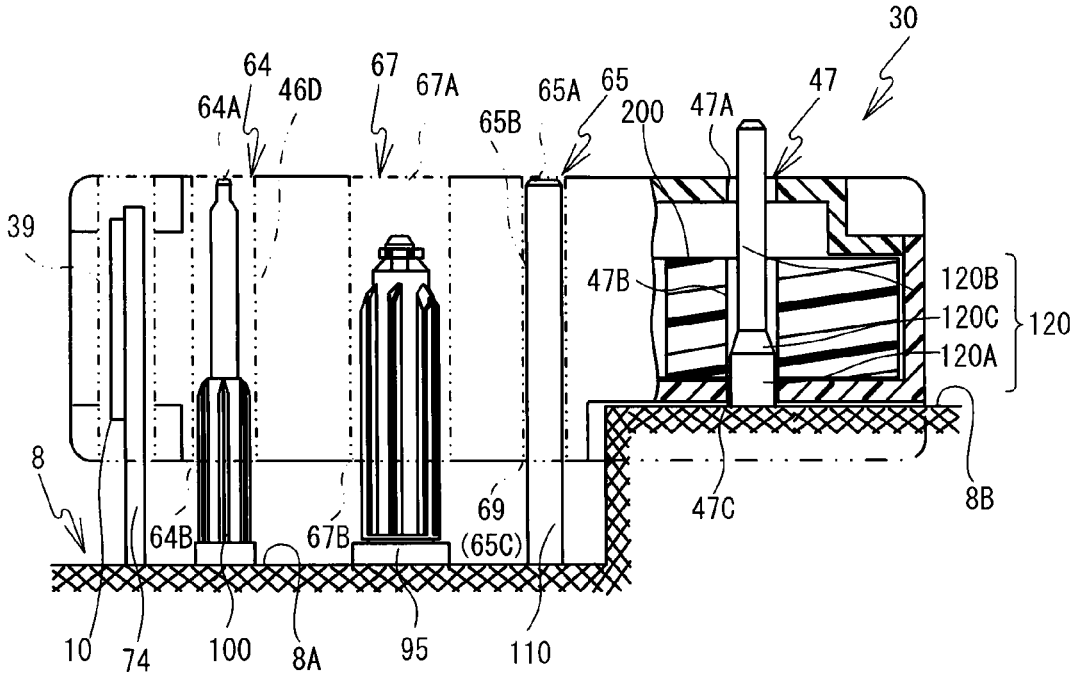
FIG. 24 is an explanatory diagram of the cassette mounting portion 8 after the tape cassette 30 has been mounted, as seen from the right side.

Hereinafter, the manner in the present embodiment, in which the tape cassette 30 is mounted in and removed from the cassette mounting portion 8, will be explained with reference to FIG. 22 to FIG. 27. In FIGS. 22 to 24, the right side of the tape cassette 30 is shown, and to facilitate understanding, only the holes that are related to the mounting and removal of the tape cassette 30 are shown as virtual lines (broken lines). Further, an overview cross section of the cassette mounting portion 8 as seen from the right side is shown, and to facilitate understanding, only the members that are related to the mounting and removal of the tape cassette 30 are shown in the drawings. In FIG. 24, the guide hole 47 and the area around it are shown in a sectional view as seen from the right side.

First, the height relationships among the various vertically oriented members that are provided in the cassette mounting portion 8 will be explained. The head holder 74, the tape drive shaft 100, the ribbon winding shaft 95, the auxiliary shaft 110, and the guide shaft 120 have shaft lengths (lengths in the up-down direction) that are at least greater than the height dimension of the common portion 32. Of these, the three guide shafts (that is, the tape drive shaft 100, the auxiliary shaft 110, and the guide shall 120) have shaft lengths that are substantially equal to each other. The shaft lengths of each of the tape drive shaft 100, the auxiliary shaft 110 and the guide shaft 120 are greater than the shaft length of the ribbon winding shall 95 and the vertical size of the head holder 74. Therefore, using the height position of the bottom surface of the cavity 8A as a reference, in a state in which the head holder 74, the tape drive shaft 100, the ribbon winding shaft 95 and the auxiliary shaft 110 are provided in a vertical orientation, the height positions of the upper ends of the tape drive shaft 100 and the auxiliary shaft 110 are highest, the height position of the upper end of the head holder 74 is next highest, and the height position of the upper end of the ribbon winding shaft 95 is lowest. The height position of the upper end of the ribbon winding shaft 95 is substantially equal to the height position of the upper end of the thermal head 10 that is affixed to the head holder 74.

As described above, the guide shaft 120 is provided in a vertical orientation on the corner support portion 8B, which is positioned higher than the cavity 8A. The height position of the upper end of the guide shaft 120 is higher than the upper ends of the head holder 74, the tape drive shaft 100, the ribbon winding shaft 95, and the auxiliary shaft 110. A height dimension (a length in the up-down direction) from each upper end of the tape drive shaft 100 and the auxiliary shaft 110 to the upper end of the guide shaft 120 is substantially equal to a height dimension (a length in the up-down direction) from the bottom wall surface 86 of the tape cassette 30 to the bottom surface of the common portion 32. In other words, the guide shaft 120 extends above the height positions of the tape drive shaft 100 and the auxiliary shaft 110, by as much as the thickness of the tape cassette 30 becomes smaller by a stepped shape of the common portion 32.

As shown in FIG. 22, in a case where the user mounts the tape cassette 30 in the cassette mounting portion 8, the user places the roller support hole 64, the tape support hole 65, and the guide hole 47 in positions that, in a plan view. substantially match the relative positions of the tape drive shaft 100, the auxiliary shaft 110, and the guide shaft 120, respectively, and vertically inserts the tape cassette 30 while maintaining the top wall surface 85 and the bottom wall surface 86 substantially horizontally. When the tape cassette 30 moves downward toward the cassette mounting portion 8, the upper ends of each of the tape drive shaft 100, the auxiliary shaft 110, and the guide shaft 120 respectively enter, at substantially a same timing, the opening 64B, the tape opening 69 (namely, the opening 65C) and the third guide forming hole 47C that are provided in the bottom wall surface 86 of the tape cassette 30, as shown in FIG. 23. On the other hand, the upper ends of the head holder 74 and the ribbon winding shaft 95 are in a state in which they are respectively positioned below the bottom wall surface 86, and they do not enter inside the tape cassette 30.

Figure 27:
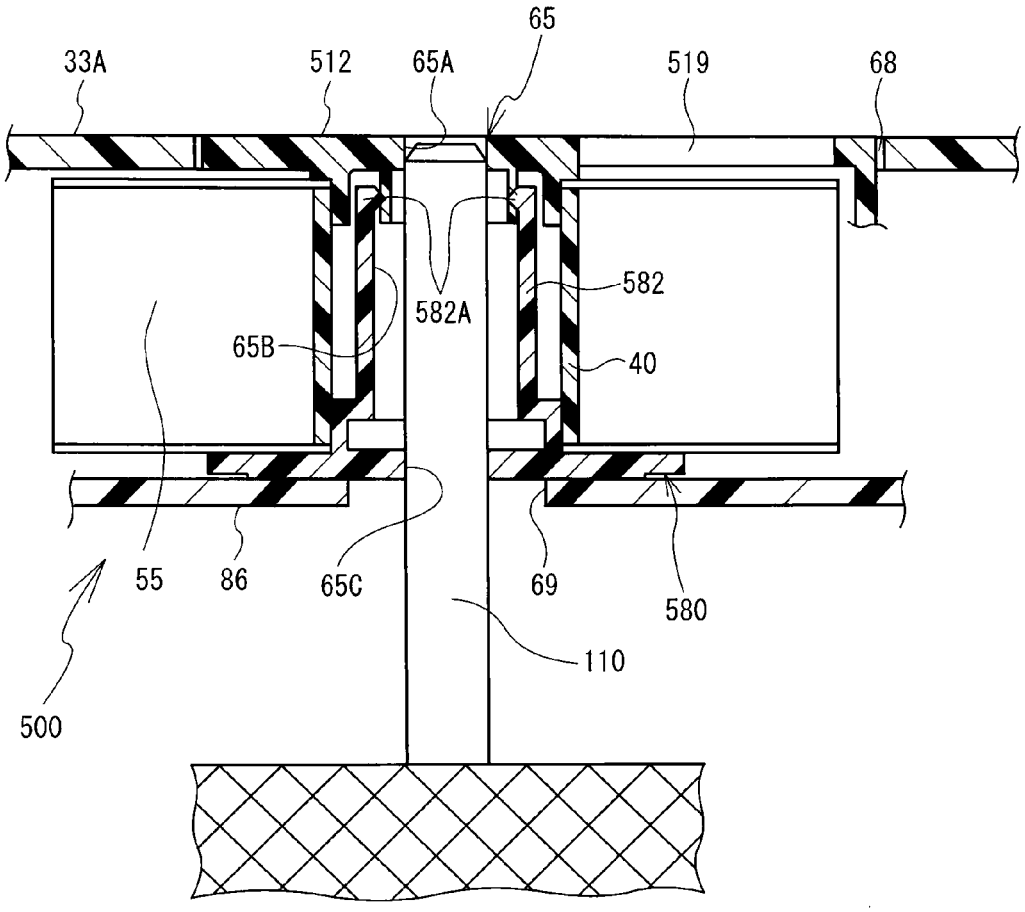
FIG. 27 is a longitudinal section view of the tape unit 500, into which an auxiliary shaft 110 is inserted, as seen from the front.

The tape opening 69 of the present embodiment has a shape and a size that encapsulate the tape support hole 65 (more specifically, the shaft hole 65B) in a bottom view (refer to FIG. 27). Thus, even if the horizontal positions of the shaft hole 65B and the tape opening 69 are slightly different, the shaft hole 65B is exposed to the underneath via the tape opening 69. As a result, even if vibration or tilting of the tape unit 500 inside the cassette case 31 occurs, the user can insert the auxiliary shaft 110 into the shaft hole 65B via the tape opening 69.

When the tape cassette 30 moves farther downward from the state that is shown in FIG. 23, the tape drive shaft 100, the auxiliary shaft 110, and the guide shaft 120 are respectively inserted from underneath into the shaft hole 46D, the shaft hole 65B, and the second guide forming hole 47B via the opening 64B, the opening 65C, and the third guide forming hole 47C. The movement of the tape drive shaft 100, the auxiliary shaft 110 and the guide shaft 120 is restrained in the circumferential direction by the inner walls of the shaft hole 46D, the shaft hole 65B and the second guide forming hole 47B, into which they are respectively inserted, while being in a state in which they can slide along the vertical direction (namely, in the up-down direction). In other words, the tape cassette 30 moves downward under the action of its own weight, while being guided along the vertical directions of the tape drive shall 100, the auxiliary shaft 110 and the guide shaft 120, which are respectively inserted into the roller support hole 64, the tape support hole 65 and the guide hole 47.

As described above, the aperture width of the guide hole 47 is larger than the shaft diameter of the top end of the guide shaft 120 (the above-described small diameter portion 120B), and in particular, the aperture width in the left-right direction is larger than then the aperture width in the front-rear direction. As a result, when the tape cassette 30 is mounted, the user can insert the guide shaft 120 into the guide hole 47, even if slight discrepancies occur in the relative positions of the guide shaft 120 and the guide hole 47 in a plan view. In this way, accurate positioning of each of the hole portions of the tape cassette 30 corresponding to all of the three guide shafts that are provided in the cassette mounting portion 8 is not necessary, and a burden on the user when mounting the tape cassette 30 is reduced. Further, at the time of manufacture of the tape cassette 30, in order to make the dimensional width of the roller support hole 64 and the guide hole 47 complete match the dimensional width of the tape drive shaft 100 and the guide shaft 120, a high degree of dimensional accuracy is required of the operator. On this point, by forming the guide hole 47 with some allowance in the left-right direction, a slight amount of error in forming the dimensional accuracy of the guide hole 47 is tolerated, and the burden at the time of manufacture of the tape cassette 30 is reduced.

As shown in FIG. 24, as the tape cassette 30 is guided downward along the tape drive shaft 100, the auxiliary shaft 110 and the guide shaft 120, the head holder 74 that is provided with the thermal head 10 is inserted from underneath into the head insertion portion 39, and the ribbon winding shaft 95 enters the opening 67B from underneath. Further, the guide hole 47, into which the small diameter portion 120E of the guide shaft 120 is inserted, is guided downward along the tapered portion 120C, and is fitted onto the above-described large diameter portion 120A. As described above, the shaft diameter of the large diameter portion 120A is substantially equal to the opening width of the guide hole 47, and the large diameter portion 120A is tightly engaged from the front and rear directions of the guide hole 47. Note that, although not shown in the drawings, the positioning pins 102, 103 are respectively inserted into the pin holes 52, 53. The movements of the tape cassette 30 are thus restrained in the front-rear and left-right directions.

When the tape cassette 30 is mounted in its correct position in the cassette mounting portion 8, the corner support portion 8B of the cassette mounting portion 8 is positioned opposite the bottom surface of each of the corner portions 321 to 324 of the cassette case 31 and supports the tape cassette 30. In this way, the movement of the tape cassette 30 that is mounted in the cassette mounting portion 8 is restrained in the downward direction.

Figure 25:
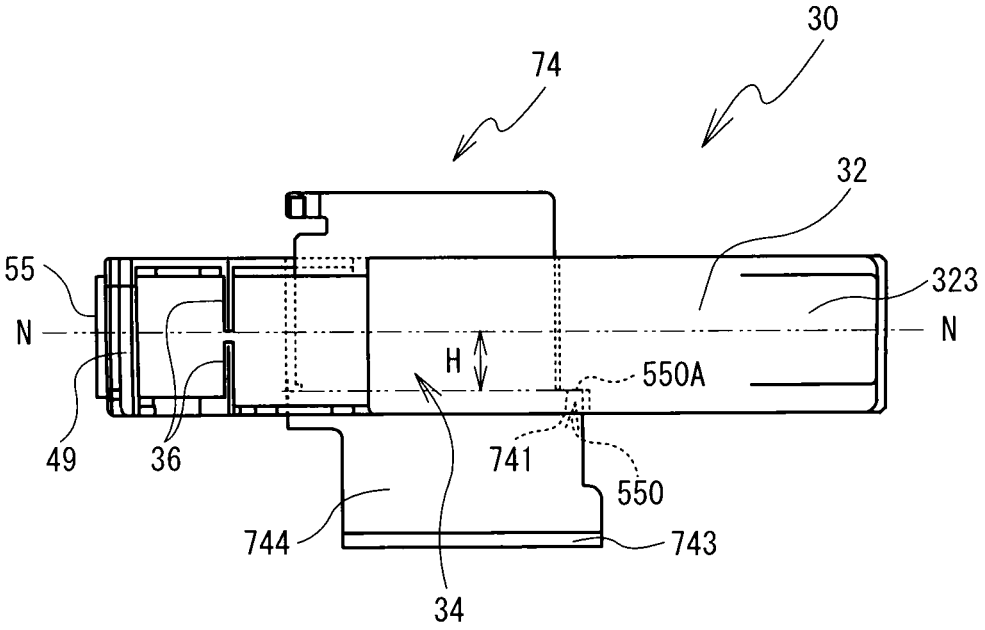
FIG. 25 is an explanatory diagram of the tape cassette 30 being supported by the head holder 74, as seen from the front.

As shown in FIG. 25, the cassette support portion 741 of the head holder 74 comes into contact from underneath with the support surface 550A provided on the tape holder 510, via the cut out portion 50 (refer to FIG. 12) provided in the case body 38. In this way, in a position that is close to the thermal head 10 that performs printing, the movement of the tape cassette 30 that is mounted in the cassette mounting portion 8 is restrained in the downward direction.

In addition, the tape cassette 30 is maintained in a state in which the support surface 550A that is the reference surface is supported from underneath by the cassette support portion 741 that is the reference of the central position of the thermal head 10 in the up-down direction. Thus, it is possible to accurately match the central position in the up-down direction of the printing by the thermal head 10 with the central position in the width direction of the printing tape 55.

The cassette support portion 741 supports the support surface 550A from underneath, and directly restrains the movement in the up-down direction of the tape unit 500 that is housed in the case body 38. The tape unit 500 is rotatably provided with the tape spool 40 that holds the printing tape 55, and is also provided with the tape holder 510 that includes a part of the feed path of the printing tape 55. As a result, pulling and feeding of the printing tape 55 are stable and it is possible to keep the central position in the width direction of the printing tape 55 constant.

In a state in which the tape cassette 30 is supported by the cassette support portion 741, a distance H between the support surface 550A in the up-down direction (the height direction) of the tape cassette 30 and a central position (the central line in the up-down direction of the cassette case 31) N in the up-down direction of the printing tape 55 that is housed in the cassette case 31 is constant, irrespective of the tape type of the tape cassette 30. Thus, a plurality of the tape cassettes 30 that have different heights can be used in the same tape printer 1. Even if the tapes have different widths, by feeding the tape at a position that matches the center of the tape in the width direction, it is possible to inhibit meandering, which occurs due to differences in pressure on the tape in the tape width direction when the center does not match in the tape width direction.

Furthermore, in the present embodiment, irrespective of the tape type of the tape cassette 30, a distance H1 between the bottom restraining portion 528 (refer to FIG. 16) and the center line N and a distance H2 between the top restraining portion 530 (refer to FIG. 16) and the center line N are set to be substantially equal. In this case, there is a good balance between the support of the tape cassette 30 from underneath and pressure on the tape cassette 30 from above. As a result, the positional relationship between the printing central position in the up-down direction by the thermal head 10 and the central position in the width direction of the printing tape 55 can be maintained appropriately.

Note that the printing by the thermal head 10 is performed along a direction that is orthogonal to the tape feed direction (here, the front-rear direction of the tape cassette 30). Therefore, in order to inhibit displacement of the printing position with respect to the tape, it is preferable for a mounting position of the tape cassette 30 to be restrained accurately in the front-rear direction and the up-down direction. In contrast, even if a slight amount of displacement occurs in the mounting position of the tape cassette 30 in the tape feed direction (here, the left-right direction of the tape cassette 30), this does not have a large impact on the printing quality. With the guide hole 47 of the present embodiment, as a slight amount of allowance in the left-right direction occurs with respect to the large diameter portion 120A when the guide shaft 120 is inserted into the guide hole 47, the printing quality is not compromised and the tape cassette 30 can be mounted and removed smoothly.

In this manner, in the present embodiment, the tape cassette 30 is guided to the correct position in the cassette mounting portion 8 by the three guide shafts (the tape drive shaft 100, the auxiliary shaft 110 and the guide shaft 120). The tape cassette 30 is positioned in the correct horizontal position by the guide shaft 120 and the positioning pins 102, 103, and is positioned in the correct height position by the cassette support portion 741 and the corner support portion 8B. In a state in which the tape cassette 30 is positioned in the correct position, the parting line J and the parting line K substantially match with each other in a plan view (refer to FIG. 5 and FIG. 6).

Figure 26:
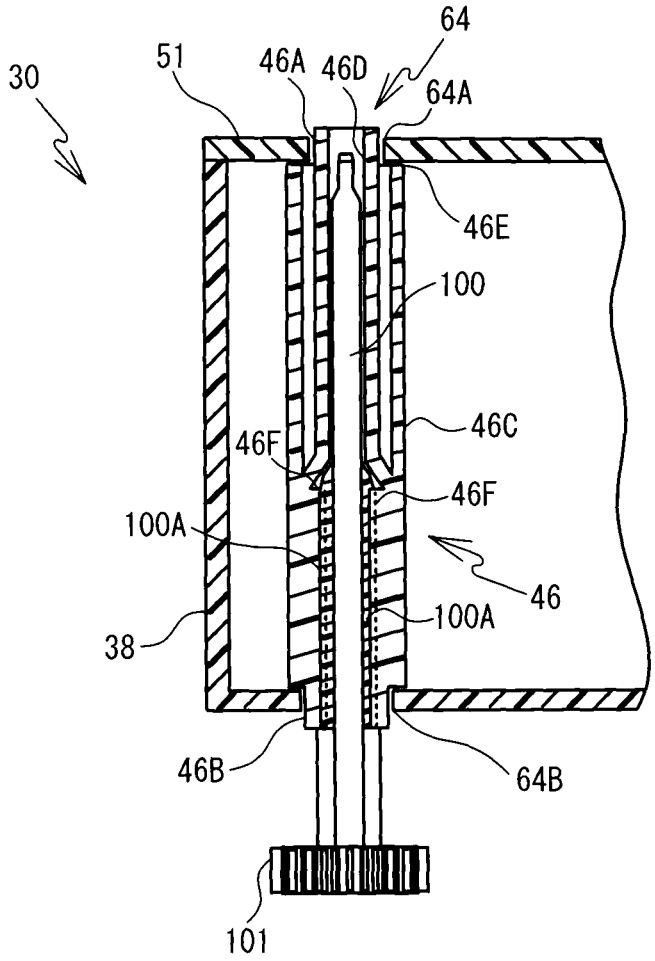
FIG. 26 is a longitudinal section view of the tape drive roller 46, into which a tape drive shaft 100 is inserted, as seen from the front.

In this state, as shown in FIG. 26, the tape drive shaft 100 is fittingly inserted correctly into the tape drive roller 46 without any shaft displacement, and the cam members 100A mesh correctly with the engaging ribs 46F. As shown in FIG. 5 and FIG. 6, the thermal head 10 provided on the head holder 74 is arranged in the correct printing position of the head insertion portion 39. As a result, in the tape printer 1, a risk of occurrence of faulty movement of the printing tape 55 and printing defects is significantly reduced, and it is possible to perform correct printing.

When the tape cassette 30 is removed from the cassette mounting portion 8, the user may pull the tape cassette 30 from the cassette mounting portion 8 upward while pinching both the left and right sides of the side wall 87 with his or her fingers, for example. Also at that time, the tape cassette 30 is guided in the upward direction by the three guide shafts (the tape drive shaft 100, the auxiliary shaft 110 and the guide shaft 120). Thus, in a process of removing the tape cassette 30 from the cassette mounting portion 8, it is possible to inhibit a risk of the tape cassette 30 tilting and becoming lodged in the inner wall etc. of the cassette mounting portion 8.

As described above, the tape cassette 30 of the present embodiment has the weight distribution that makes it easy to be tilted downward on the side of the first housing area 30C. However, the tape support hole 65 that penetrates the center of gravity of the printing tape 55 is provided in the first housing area 30C. The auxiliary shaft 110 that is inserted into the tape support hole 65 is provided in the tape printer 1. At the time of mounting or removing the tape cassette 30, the first housing area 30C that easily floats or tilts inside the cassette mounting portion 8, is guided in the up-down direction by the auxiliary shaft 110 being inserted into the tape support hole 65. Thus, at the time of mounting of the tape cassette 30, occurrence of floating and tilting of the tape cassette 30 caused by the downward tilting of the first housing area 30C is inhibited.

In the refill type tape cassette 30, if vibration and displacement etc. of the tape unit 500 occurs within the cassette case 31 at the time of mounting and removal, the weight distribution of the tape cassette 30 is not stable and there is a risk that floating and tilting may occur. On this point, when mounting and removing the tape cassette 30, the auxiliary shaft 110 is inserted into the tape support hole 65 that is provided on one end of the tape unit 500, and the guide shaft 120 is inserted into the guide hole 47 that is provided on the other end of the tape unit 500. In other words, inside the cassette case 31, the tape unit 500 is guided on both sides in the longitudinal direction along the auxiliary shaft 110 and the guide shaft 120. For that reason, vibration and displacement etc. of the tape unit 500 is inhibited at the time of mounting and removing the tape cassette 30 and the weight distribution of the tape cassette 30 can be stabilized.

As shown in FIG. 27, even after the tape cassette 30 has been mounted in the cassette mounting portion 8, displacement of the one end of the tape unit 500 is restrained in the front-rear and the left-right directions by the auxiliary shaft 110 that is inserted into the tape support hole 65. Displacement of the other side of the tape unit 500 is restrained in the front-rear and the left-right directions by the guide shaft 120 that is inserted into the guide hole 47 (refer to FIG. 24). In other words, the tape unit 500 that is housed inside the tape cassette 30 is held in the correct horizontal position on both sides in the longitudinal direction by the auxiliary shaft 110 and the guide shaft 120.

As a result, even in a case in which vibration occurs at the time of printing by the tape printer 1, an impact of the vibration on the tape unit 500 housed in the tape cassette 30 is inhibited, and it is possible to pull out and transport the printing tape 55 in a stable manner. In addition, the feed path (the guide groove 512A and the guide portion 513) of the printing tape 55 is provided between both sides of the tape unit 500. As a result, at the time of mounting and removing the tape cassette 30, for example, it is possible to inhibit vibration and tilting with respect to the feed path of the printing tape 55.

The tape cassette 30 is guided in the up-down direction at three points, namely, at diagonally opposite corner portions of the tape cassette 30 in a plan view (specifically, the roller support hole 64 and the guide hole 47) and at the center of gravity position of the printing tape 55 (specifically, the tape support hole 65). For that reason, in a process of mounting the tape cassette 30 in the cassette mounting portion 8, it is possible to appropriately inhibit the occurrence of positional displacement and tilting of the tape cassette 30. Note that, the overall center of gravity of the tape cassette 30 is preferably positioned within an area that links the roller support hole 64, the tape support hole 65 and the guide hole 47 in a plan view. In this case, the weight of the tape cassette 30 itself is evenly distributed and acts at the three points at which the tape cassette 30 is guided in a plan view (namely, the tape drive shaft 100, the auxiliary shaft 110 and the guide shaft 120). Then, the movement of the tape cassette 30 in the mounting and removal direction is smooth, and it is possible to reliably inhibit the occurrence of positional displacement and tilting in the process of mounting the tape cassette 30.

Further, the mounting and removal of the tape cassette 30 is guided at least two points, namely, the left front corner portion 324 in which the roller support hole 64 is provided, and the right rear corner portion 322 in which the guide hole 47 is provided and which is diagonally opposite to the corner portion 324. At the corner portion 324 and in its vicinity, tape delivery is performed by the tape drive roller 46 and also printing is performed by the thermal head 10. At the open portion 77 that is positioned in the vicinity of the corner portion 324, the printing tape 55 is exposed to the outside from the cassette case 31. As a result, positioning of the tape cassette 30 by the corner portion 324 has a significant impact on the printing quality and on the movement of the tape. Additionally, in order to deliver the tape, the tape drive shaft 100 is necessary to rotate the tape drive roller 46.

In the present embodiment, as the tape cassette 30 is guided in the mounting and removal direction along the tape drive shaft 100 that is inserted into the roller support hole 64 (namely, the tape drive roller 46), the positioning of the tape cassette 30 can be accurately performed in the vicinity of the corner portion 324. In addition, it is possible to inhibit the tape that is exposed to the outside in the process of mounting the tape cassette 30 from becoming entangled with other members (namely the occurrence of a jam). Further, by using the tape drive shaft 100 as one of the guiding shafts, it is not necessary to separately provide a shaft body in a vertical orientation to guide the corner portion 324, and the structure of the tape printer 1 can be simplified.

Furthermore, the tape cassette 30 is guided in the mounting and removal direction along the guide shaft 120 that is inserted into the guide hole 74. In other words, the tape cassette 30 is guided in the mounting and removal direction at both of diagonally opposite positions (namely, the corner portions 322 and 324) that can maintain a maximum distance between two points in a plan view. Thus, the tape cassette 30 can be guided more stably in the mounting and removal direction.

Additionally, the tape holder 510 has the shaft hole 65B that faces the tape opening 69. The tape spool 40, around which the printing tape 55 is wound, is held such that it is rotatable, by the cylinder portion 582 that is inserted with clearance from the opening 65C. Inside the cassette case 31, it is possible to smoothly guide the tape spool 40, which is a heavy object, along the auxiliary shaft 110 that is inserted into the tape support hole 65 (namely, the shaft hole 65B). With the cylinder portion 582 of the tape holder 510 as a center of rotation, the printing tape 55 can be stably pulled from the tape spool 40.

When the cassette cover 6 is closed in the state in which the tape cassette 30 is mounted in the correct position in the cassette mounting portion 8 as described above, the platen holder 12 moves from the stand-by position (refer to FIG. 5) toward the printing position (refer to FIG. 6). At that time, the arm detection portion 200 and the latch piece 225 provided on the cassette facing surface 12B of the platen holder 12 respectively move to positions opposite to the arm indicator portion 800 and the latch hole 820 provided in the leading end front wall 525 of the tape cassette 30. At that time, the latch piece 225 is inserted into the latch hole 820, and the tape type is detected in a manner described hereinafter.

Figure 28:
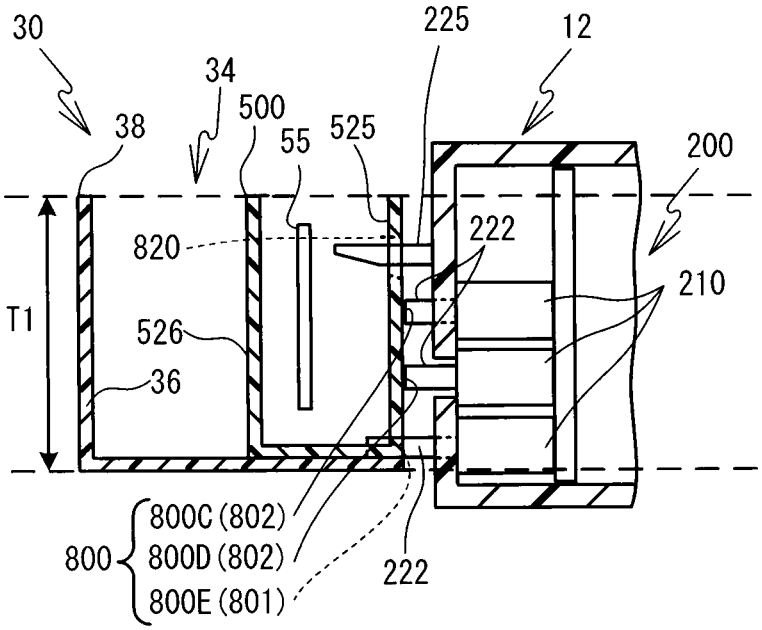
FIG. 28 is a sectional view looking in the direction of the arrows on the line 11-11 shown in FIG. 21, in a state in which the platen holder 12 is positioned opposite the tape cassette 30 shown in FIG. 21.

As shown in FIG. 28, each of the switch terminals 222 of the detection switches 210 protruding from the cassette facing surface 12B is positioned opposite one of the non-pressing portion 801 and the pressing portion 802 that are respectively provided in corresponding positions on the arm indicator portion 800, and the switch terminals 222 are selectively depressed. In other words, the switch terminal 222 of the detection switch 210 that is positioned opposite the non-pressing portion 801 is inserted into the non-pressing portion 801 and the detection switch 210 is thus in the off state. The switch terminal 222 of the detection switch 210 that is positioned opposite the pressing portion 802 comes into contact with the pressing portion 802 and the detection switch 210 is thus in the on state.

The tape type of the tape cassette 30 is identified based on combinations of the on and off states of the five detection switches 210 acquired in the manner described above. More specifically, a cassette identification table is stored in advance in the ROM 402 (refer to FIG. 10), on which the on and off combinations of the detection switches 210 are associated with the tape types. The CPU 41 (refer to FIG. 10) refers to the cassette identification table and identifies the tape type corresponding to the combination of the on and of states of the detection switches 210.

Note that, in the cassette identification table that is stored in the ROM 402, the combinations of the on and off states of the detection switches 210 are associated with the tape types using same patterns as the non-pressing portion 801 and the pressing portion 802 of the arm indicator portion 800. In the cassette identification table, the non-pressing portion 801 corresponds to the off state of the detection switch 210 and the pressing portion 802 corresponds to the on state of the detection switch 210.

In the present embodiment, the support surface 550A that is used for positioning in the up-down direction is provided in the vicinity of the leading end front wall 525 on which the arm indicator portion 800 is provided. The support surface 550A and the leading end front wall 525 are both provided on the tape holder 510. For that reason, the cassette support portion 741 directly positions the arm indicator portion 800 in the up-down direction, by supporting the support surface 550A from underneath. As a result, when the tape cassette 30 is mounted in the tape printer 1, the positional relationship between the detection switches 210 and the arm indicator portion 800 is accurately maintained and mistaken detection by the detection switches 210 can be inhibited.

On the other hand, in a case in which the tape cassette 30 is not sufficiently pushed in the downward direction and the tape cassette 30 is not mounted in the correct position in the cassette mounting portion 8, the latch piece 225 comes into contact with the surface of the arm front surface wall 35. As described above, the height of protrusion of the latch piece 225 is substantially the same as or greater than the height of protrusion of each of the switch terminals 222. Thus, when the latch piece 225 comes into contact with the surface of the arm front surface wall 35, all of the switch terminals 222 do not come into contact with the arm front surface wall 35, and all of the detection switches 210 are in the off state.

Further, the indicator portions that are provided in the arm indicator portion 801) are arranged in a zigzag pattern and none of the indicator portions are provided in a same position in the up-down direction. In other words, in a case in which the latch piece 225 of the tape printer 1 is damaged or missing, for example, if the tape cassette 30 is displaced in the up-down direction from the correct position, all of the detection switches 210 are in the on state.

Thus, if it is established in the above-described cassette identification table that an all off combination and an all on combination respectively indicate a state in which the tape cassette 30 is not mounted in the correct position, the tape printer 1 can detect a mounted state of the tape cassette 30. In this way, it is possible to reduce the risk of the tape printer 1 mistakenly detecting the tape type.

At the time of performing printing by the tape printer 1, the printing tape 55 is pulled from the tape spool 40 by the coordinated operations of the tape drive roller 46 that is driven to rotate via the tape drive shaft 100 and the movable feed roller 14. The printing tape 55 that is pulled from the tape spool 40 is fed along the feed path within the tape holder 510 and discharged from the discharge outlet 500A. The printing tape 55 that is discharged from the discharge outlet 500A is discharged to the open portion 77 from the discharge outlet 34A that is positioned slightly to the left side of the discharge outlet 500A. The printing tape 55 is fed between the thermal head 10 and the platen roller 15 and characters, graphics and symbols etc. are printed. The printing tape 55 that has been printed is fed toward the tape discharge portion 49 by the coordinated operations of the tape drive roller 46 and the movable feed roller 14 and is cut by the cutting mechanism 17.

The tape holder 510 of the present embodiment has the guide portion 513 that is used to feed the printing tape 55 that is pulled from the tape spool 40 to the vicinity of the discharge outlet 34A of the arm portion 34, in a state in which the tape holder 510 is housed in the case body 38. Thus, the feed path of the printing tape 55 in the tape unit 500 can be made longer, and the printing tape 55 that is pulled from the tape spool 40 can be fed in a stable manner. Further, as the leading end front wall 525 is fitted into the identification opening 35A, the downstream side in the tape feed direction in the tape unit 500 is fixed, and the movement of the printing tape 55 inside the cassette case 31 is stable.

In addition, the bottom restraining portion 528 and the top restraining portion 530 that restrain the printing tape 55 in the width direction are provided on the leading end of the guide portion 513. For that reason, the printing tape 55 that is discharged from the discharge outlet 34A is restrained in the width direction in the vicinity of the discharge outlet 500A. In addition, in the state in which the tape cassette 30 is mounted in the cassette mounting portion 8, the tape holder 510 is supported from directly underneath by the cassette support portion 741. As a result, the position of the printing tape 55 in the up-down direction is maintained in a state that matches the position of the thermal head 10 in the up-down direction, and the printing quality can be improved.

At the time of printing described above, the ribbon winding shaft 95 is also driven to rotate. However, as the tape cassette 30 of the present embodiment is not provided with the ribbon spool and the ribbon winding spool, the ribbon winding shaft 95 runs idle inside the winding spool support hole 67. In other words, even when the thermal type tape cassette 30 is used in the tape printer 1 that is provided with the ribbon winding shaft 95, the driven rotation of the ribbon winding shaft 95 does not have any impact on the printing operation on the printing tape 55 and the printing can be performed appropriately.

In the tape cassette 30 of the present embodiment, a remaining amount of the printing tape 55 that is wound on the tape spool 40 can be determined based on a winding diameter of the printing tape 55, that can be visually checked via the observation window 519. When the remaining amount of the printing tape 55 becomes low while printing is being performed by the tape printer 1, for example, the user can replace the tape unit 500 using the following procedure. First, the user removes the tape cassette 30 from the cassette mounting portion 8 and presses the knob of the elastic latch hook body 33C of the cassette lid 33. In this way, the engaging of the elastic latch hook body 33C with the latch oblong hole 139 is released and the cassette lid 33 can be removed from the case body 38.

Next, the user removes the tape unit 500 in which the remaining amount of the printing tape 55 is low from the unit housing portion 140 of the case body 38, and mounts the new tape unit 500 around which the unused printing tape 55 is wound into the unit housing portion 140. In the tape unit 500 of the present embodiment, the printing tape 55 is guided by the guide portion 513. Thus, the pulling out of the printing tape 55 is completed simply by the user pulling out the leading end of the printing tape 55 that is pulled out from the discharge outlet 500A further to the outside of the arm portion 34 via the discharge outlet 34A. After that, if the user attaches the cassette lid 33 to the case body 38 and mounts the tape cassette 30 in the cassette mounting portion 8, the tape printer 1 can perform printing using the printing tape 55 held in the new tape unit 500. In this way, in the tape cassette 30 of the present embodiment, the tape unit 500 is easily replaced.

It should be noted that the tape cassette and the tape unit according to the present disclosure are not limited to the above-described embodiment, and various modifications may of course be applied without departing from the spirit and scope of the present disclosure. For example, in the above-described embodiment, the tape spool 40 around which the printing tape 55 is wound exemplifies a tape roll. In place of that, the printing tape 55 may be a so-called coreless type tape roll that is wound without using the tape spool 40.

In the above-described embodiment, the shape, size, number and arrangement pattern of the arm indicator portion 800 (the non-pressing portion 801 and the pressing portion 802) are not limited to those exemplified in the above-described embodiment, and modifications are possible as appropriate. In the above-described embodiment, the non-pressing portion 801 of the arm indicator portion 800 is through holes with a vertically long rectangular shape in a front view, but another shape may be adopted. The non-pressing portion 801 provided on the arm indicator portion 800 may be a recessed portion formed in the leading end front wall 525. When the arm indicator portion 800 includes a plurality of the non-pressing portion 801, the arm indicator portion 800 may be a groove that connects the non-pressing portion 801 or may be a recessed portion that encompasses the non-pressing portion 801.

In the above-described embodiment, the three guide holes (the roller support hole 64, the guide hole 47 and the tape support hole 65) are all open in the up-down direction, but it is sufficient that mounting and removal of the guide shafts is possible in the same direction for each of the guide holes. More specifically, it is sufficient that each of the guide holes be at least open in the downward direction, such that the guide shafts can be inserted and removed from underneath.

In the above-described embodiment, the tape cassette 30 that is mounted in and removed from the cassette mounting portion 8 is guided along the three guide shafts (the tape drive shaft 100, the auxiliary shaft 110 and the guide shaft 120), but it may be guided along two of the guide shafts (the tape drive shall 100 and the guide shaft 120). In this case, the tape support hole 65 need not necessarily be provided in the tape cassette 30.

In the above-described embodiment, the top restraining portion 530 is provided on the top edge of the left end portion of the leading end rear wall 526, but a restraining portion that restrains the movement of the printing tape 55 in the downward direction may be provided on the bottom edge of the left end portion of the leading end rear wall 526. In this case, the movement of the printing tape 55 that is pulled out from the tape holder 510 is restrained in the up-down direction immediately before being discharged from the discharge outlet 500A. As a result, the position of the printing tape 55 in the up-down direction on which printing is performed by the thermal head 10 can be made constant and the printing quality is improved.

Hereinabove, the embodiment of the tape cassette and the tape unit according to the present disclosure is described. Each of the technical features of the tape cassette and the tape unit disclosed in the above-described embodiment may be used individually or may be used in a combination of a plurality of the technical features.

For example, in a known tape cassette, depending on the weight of a tape housed inside a cassette case, poor weight distribution may arise in some cases. If the tape cassette with poor weight distribution is grasped, it may tilt easily and there is a risk that it is difficult for a person to manipulate a position of the tape cassette. For example, in a case in which the person mounts the tape cassette in a cassette mounting portion, there is a risk that the tape cassette tilts inside the cassette mounting portion.

In particular, in the refill type tape cassette, the tape unit that is a heavy object may have a significant impact on the weight distribution of the tape cassette. If the tape unit vibrates inside the cassette case when the tape cassette is mounted, the weight distribution of the tape cassette may be thrown off balance and tilting may easily occur. In the tape printer, if printing is performed when the tape cassette is mounted in a tilted state in this way, there is a risk that tape movement defects and printing defects will occur.

Here, one or a plurality of the above-described technical features may be provided, as in a tape cassette explained hereinafter. Note that parentheses that are appended to the technical features that are hereinafter explained indicate the reference numerals for the structural elements that correspond to the individual technical features in the embodiment that is described above.

A tape cassette (30) is provided with: a box-shaped cassette case (31) that has a pair of wall surfaces (85, 86) each having a flat rectangular shape and arranged opposing each other, and a side wall (87) that is formed at a predetermined height around the outer edges of the pair of wall surfaces (85, 86); and a tape unit (500) which has a tape roll (40) that has a wound tape (55) that is a printing medium, and a tape holder (510) that rotatably holds the tape roll (40) and that can be freely mounted in and removed from an inside of the cassette case (31). The tape roll (40) is held by one end of the tape holder (510) and has a roll opening (40A) that faces a winding center of the tape (55). The cassette case (31) is provided with: a first opening (47C) that is provided in one corner portion (30A) of at least one of the pair of wall surfaces (85. 86); a second opening (64B) that is provided in another corner portion (30B) which is positioned diagonally opposite to the one corner portion (30A) on at least one of the pair of wall surfaces (85, 86); and a third opening (69) that is provided on at least one of the pair of wall surfaces (85, 86) and that faces the roll opening (40A) of the tape unit (500) that is mounted inside the cassette case (31).

In this case, even when the tape roll (40), which is a heavy object, is housed inside the cassette case (31), the tape cassette (30) may be guided along three guide shafts (the guide shall 120, the tape drive shaft 100, the auxiliary shaft 110, for example) that may be inserted into each of the three openings (47C, 64B, 69) and tilting of the tape cassette (30) can be inhibited. Thus, a person can accurately and easily mount and remove the tape cassette (30) with respect to the tape printer (1) and it is possible to inhibit the occurrence of tape movement defects and printing defects at the time of printing.

In the tape cassette (30), the tape holder (510) may have a holder opening (47B) that opens in the same direction as the roll opening (40A) on another end that is different to the one end, and the first opening (47C) may face the holder opening (47B) of the tape unit (500) that is mounted inside the cassette case (31).

In this case, at the time of mounting and removing the tape cassette (30), the guide shaft (the auxiliary shaft 110, for example) corresponding to the third opening (69) can be inserted into the roll opening (40A) and the guide shall (the guide shaft 120, for example) corresponding to the first opening (47C) can be inserted into the holder opening (47B). Both ends of the tape unit (500) inside the cassette case (31) can be guided along the two guide shafts (the auxiliary shaft 110 and the guide shaft 120, for example). As a result, vibration and tilting of the tape unit (500) inside the cassette case (31) can be inhibited, and weight distribution of the tape cassette (30) at the time of mounting and removal can be stabilized.

In the tape cassette (30), the tape holder (510) may be extended from the one end to the other end across a feed path of the tape (55) that is pulled out from the tape roll (40) inside the cassette case (31) and fed, and a groove portion (512A) that is formed between the tape roll (40) and the holder opening (47B) and that guides the tape (55) may be a part of the feed path.

In this case, inside the cassette case (31), the groove portion (512A) that forms a part of the feed path of the tape (55) can also be guided along the two guide shafts (the auxiliary shaft 110 and the guide shaft 120, for example). As a result, positional displacement of the groove portion (512A) can be inhibited at the time of mounting and removal of the tape cassette (30), and a risk of damage to the tape (55) on the feed path can be reduced.

In the tape cassette (30), a cylinder-shaped shaft portion (582) which is provided with a shaft hole (65B) that faces the third opening (69) and which is inserted with clearance into the roll opening (40A) may be provided on the one end of the tape holder (510), and the tape roll (40) may be held such that it is rotatable around the shaft portion (582) that is inserted with clearance into the roll opening (40A).

In this case, inside the cassette case (31), the guide shaft (the auxiliary shaft 110, for example) can be inserted into the shaft hole (65B) that faces the third opening (69). The tape roll (40) that is a heavy object can be smoothly guided along the guide shaft that is inserted into the shaft hole (65B). In addition, the tape (55) can be stably pulled out from the tape roll (40) that has as its rotational center the shaft portion (582) of the tape holder (510).

In the tape cassette (30), the third opening (69) may have a shape and size that encompass the shaft hole (65B) and may face the whole of the shaft hole (65B). In this case, even if positions in a plan view of the third opening (69) and the shaft hole (65B) are slightly different, the shaft hole (65B) can be exposed via the third opening (69). Thus, even if vibration and tilting of the tape unit (500) occur inside the cassette case (31), the guide shaft (the auxiliary shaft 110, for example) can be inserted into the shaft hole (65B) via the third opening (69). In other words, the tape roll (40) that is a heavy object can be guided along the guide shaft.

In the tape cassette (30), taking a center of the longitudinal direction of the rectangular shape in the plan view of the cassette case (31) as a reference, the first opening (47C) may be formed on an opposite side to a position of the center of gravity of the tape roll (40). In this case, the tape cassette (30) can be smoothly guided at three points, including the third opening (69) that is provided in the position of the center of gravity of the tape roll (40) that is a heavy object, and the first opening (47C) that is provided at a position separated from the position of the center of gravity of the tape roll (40).

In the tape cassette (30), a cylinder-shaped tape drive roller (46) may be provided that pulls out the tape (55) from the tape roll (40) and that is rotatably provided between the pair of wall surfaces (85, 86), the tape drive roller (46) may have an insertion fitting hole (46D) into which is inserted and fitted a roller support shaft (100) that rotatably supports the tape drive roller (46), and the second opening (64B) may face the insertion fitting hole (46D) of the tape drive roller (46). In this case, it is possible to accurately guide and position the tape drive roller (46) and its vicinity along the roller support shaft (100), the tape drive roller (46) having a significant influence on the tape movement and the printing quality. In addition, it is not necessary to separately provide a guide shaft that is inserted into the second opening (64B), and the structure on the side of the tape printer (1) can be simplified.

In the tape cassette (30), the direction in which the pair of wall surfaces (85, 86) oppose each other may be the direction in which the tape cassette (30) is mounted in and removed from the tape printer (1), and the first opening (47C), the second opening (64B) and the third opening (69) may be, of the pair of wall surfaces (85, 86), provided on a first wall surface (86) that is positioned opposite the tape printer (1) when the tape cassette (30) is mounted. In this case, when the tape cassette (30) is mounted, it is possible to cause the guide shafts (the guide shaft 120, the tape drive shaft 100 and the auxiliary shall 110, for example) to be inserted, respectively, into the corresponding first opening (47C), the second opening (64B) and the third opening (69).

In the tape cassette (30), the first opening (47C) may be an oblong hole that has an opening width into which at least part of side walls of the guide shaft (120) are closely engaged when the guide shall (120) that is provided on the tape printer (1) corresponding to the first opening (47C) is inserted. In this case, when the tape cassette (30) is mounted in the tape printer (1), the tape cassette (30) can be positioned with respect to the direction in which the first opening (47C) is closely engaged with the guide shaft (120).

In the tape cassette (30), the center of gravity of the tape cassette (30) may be positioned within an area formed by lines joining the first opening (47C), the second opening (64B) and the third opening (69) on the cassette case (31). In this case, when the tape cassette (30) is guided along the three guide shafts (the guide shaft 120, the tape drive shaft 100, the auxiliary shaft 110, for example) that are respectively inserted into the three openings (47C, 64B, 69), as the weight of the tape cassette (30) itself is evenly distributed and acts over the three guide shafts, it is possible to mount and remove the tape cassette (30) more smoothly.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape unit that holds a tape roll that has a wound tape that is a print medium, and that is adapted to be mounted in and removed from a cassette case, the tape unit being characterized by comprising:

a holder shaft portion that is inserted into a shaft hole formed in a winding center of the tape roll and that rotatably supports the tape roll;

an indicator portion that is disposed radially outside the tape roll which is supported by the holder shaft portion, and that includes at least one hole portion and indicates a type of the tape;

a path wall that is provided underneath the tape that is pulled out from the tape roll, and that extends along the feed path of the tape and forms a bottom surface of the tape unit;

a bottom side recessed portion that is a recessed portion that is formed by causing a part of the bottom surface in the path wall to be recessed upward, and that has a reference surface that is a flat surface positioned above the bottom surface; and a bottom restraining portion that is provided on the feed path on the path wall, and that restrains a movement of the tape in a downward direction, in a position separated from the reference surface in an up-down direction of the tape unit by a predetermined distance.

2. The tape unit according to claim 1, further comprising:

a guide wall that is provided in parallel to a surface of the tape that is pulled out from the tape roll, and that is provided along a feed path of the tape, wherein the indicator portion is provided in the guide wall.

3. The tape unit according to claim 2, further comprising:

a tape discharge portion that is provided on an end portion on a downstream side of the feed path and that discharges, from the tape unit, the tape that has been fed on the feed path, wherein the guide wall is provided adjacent to the tape discharge portion and includes a downstream side wall portion that extends along the most downstream side of the feed path, and the indicator portion is provided on the downstream side wall portion.

4. The tape unit according to claim 1, further comprising:

a top restraining portion that is provided on the feed path on the path wall, and that restrains a movement of the tape in an upward direction, in a position separated from the reference surface in the up-down direction by a predetermined distance.

5. The tape unit according to claim 4, wherein in a state in which the tape roll is supported by the holder shaft portion, the reference surface is provided at a constant distance in the up-down direction from a central position in a width direction of the tape.

6. The tape unit according to claim 5, wherein the distance in the up-down direction between the central position and the reference surface is constant, irrespective of the width of tape.

7. The tape unit according to claim 1, further comprising:

a tape discharge portion that is provided on an end portion on a downstream side of the feed path and that discharges, from the tape unit, the tape that has been fed on the feed path, wherein the bottom restraining portion is provided on the tape discharge portion or in the vicinity of the tape discharge portion.

8. The tape unit according to claim 7, wherein the bottom side recessed portion is provided in the vicinity of the bottom restraining portion in the path wall.

9. The tape unit according to claim 1, further comprising:

a tape feed portion in which is fed the tape that is pulled out from the tape roll that is supported by the holder shaft portion;

a first holder opening that is provided in the holder shaft portion and that opens in a same direction as the shaft hole of the tape roll; and a second holder opening that is provided on an opposite side to the first holder opening across the tape feed portion and that opens in the same direction as the first holder opening.

10. A tape cassette including a tape unit that holds a tape roll that has a wound tape that is a print medium, and a cassette case into which the tape unit can be mounted and from which the tape unit can be removed, the tape cassette being characterized in that:

the tape unit includes a holder shaft portion that is inserted into a roll opening that is a shaft hole formed in a winding center of the tape roll, and that rotatably supports the tape roll, and an indicator portion that is disposed radially outside the tape roll which is supported by the holder shaft portion, and that includes at least one hole portion and indicates a type of the tape; and the cassette case includes an indicator exposure portion that, in a state in which the tape unit is mounted inside the cassette tape, exposes the indicator portion to an outside of the cassette case, a case side discharge portion that, in a state in which the tape unit is mounted in the cassette case, discharges from the cassette case the tape that is pulled out from the tape roll, and a case side guide portion that forms, between the case side guide portion and the case side discharge portion, a tape exposure part, and guides the tape that is discharged from the case side discharge portion; and the indicator exposure portion is provided in a position that is adjacent to the tape exposure part.

11. The tape cassette according to claim 10, wherein the tape unit includes a tape feed portion in which is fed the tape that is pulled out from the tape roll that is supported by the holder shaft portion, the cassette case includes a bottom surface, a front surface, a rear surface and a pair of side surfaces, and an arm portion that includes a part of the front surface, and that, in a state in which the tape unit is mounted inside the cassette case, houses at least a downstream side of the feed path in the tape feed portion, the tape feed portion includes a tape discharge portion that, in a state in which the tape unit is mounted inside the cassette case, discharges to an inside of the arm portion the tape that has been fed on the feed path, and the case side discharge portion is provided in the arm portion and discharges, to the outside of the cassette case, the tape that has been discharged from the tape discharge portion to the inside of the arm portion.

12. The tape cassette according to claim 11, wherein the tape feed portion includes a guide wall that is provided in parallel to a surface of the tape that is pulled out from the tape roll, and that is provided along the feed path, at least a part of the guide wall on which the indicator portion is provided is substantially parallel to the front surface, in a state in which the tape unit is mounted inside the cassette case, and the indicator exposure portion is provided on a side wall forming a part of the front surface of the arm portion.

13. The tape cassette according to claim 12, wherein the guide wall is provided adjacent to the tape discharge portion and includes a downstream side wall portion that extends along the most downstream side of the feed path, a shape and a size of the indicator exposure portion substantially match the shape and the size of the downstream side wall portion, and in a state in which the tape unit is mounted inside the cassette case, the downstream side wall portion is fitted into the indicator exposure portion and forms a part of the side wall of the arm portion.

14. The tape cassette according to claim 10, wherein the tape unit includes a tape holder having the holder shaft portion provided on one end, and the cassette case includes a pair of wall surfaces that are arranged opposing each other and that each form a rectangular flat surface, and a side wall that is formed at a predetermined height along peripheral edges of the pair of wall surfaces, a first opening that is provided in one corner portion of at least one of the pair of wall surfaces, a second opening that is provided in the wall surface on which the first opening is provided, and that is positioned diagonally opposite to the one corner portion, and a third opening that is provided in the wall surface on which the first opening is provided, and that faces the roll opening in a state in which the tape unit is mounted inside the cassette case.

15. The tape cassette according to claim 14, wherein the tape holder includes a holder opening that opens in a same direction as the: roll opening and that is provided on another end that is different to the one end on which the holder shaft portion is provided, and the first opening faces the holder opening in a state in which the tape unit is mounted inside the cassette case.

16. The tape cassette according to claim 15, wherein the tape holder extends from the one end toward the other end across the feed path that feeds the tape that is pulled out from the tape roll inside the cassette case and fed.

17. The tape cassette according to claim 14, wherein the holder shaft portion includes a shaft hole that the third opening faces, in a state in which the tape unit is mounted inside the cassette case, and the third opening has a shape and a size that wholly include the shaft hole of the holder shaft portion and that face a whole of the shaft hole.

18. The tape cassette according to claim 14, wherein in a state in which the tape unit is mounted inside the cassette case, the first opening is formed on an opposite side to a position of a center of gravity of the tape roll, taking as a reference a central point in a longitudinal direction of the rectangular flat surface of the cassette case.

19. The tape cassette according to claim 14 further comprising:

a cylinder-shaped tape drive roller that is rotatably provided between the pair of wall surfaces and that pulls out the tape from the tape roll;

wherein the second opening faces an insertion fitting hole of the tape drive roller.

* * * * *